US011560717B2

(12) United States Patent
Yaakov et al.

(10) Patent No.: US 11,560,717 B2
(45) Date of Patent: Jan. 24, 2023

(54) GALVANIZED STEEL STRUCTURES

(71) Applicants: Eliyahu Yaakov, Moshav Matzliah (IL); Avraham Yaakov, Moshav Matzliah (IL)

(72) Inventors: Eliyahu Yaakov, Moshav Matzliah (IL); Avraham Yaakov, Moshav Matzliah (IL)

( * ) Notice: Subject to any disclaimer, the term of this patent is extended or adjusted under 35 U.S.C. 154(b) by 0 days.

(21) Appl. No.: 16/792,959

(22) Filed: Feb. 18, 2020

(65) Prior Publication Data

US 2021/0254339 A1 Aug. 19, 2021

(51) Int. Cl.

| | |
|---|---|
| ***E04C 3/11*** | (2006.01) |
| ***E04C 3/40*** | (2006.01) |
| ***E04C 3/04*** | (2006.01) |

(52) U.S. Cl.

CPC ..... *E04C 3/11* (2013.01); *E04C 3/40* (2013.01); *E04C 2003/0486* (2013.01)

(58) Field of Classification Search

CPC ..... E04H 15/00; E04H 15/58; E04H 15/34; E04H 15/36; E04C 2003/0486; E04C 2003/0404; E04C 2003/0413; E04C 2003/0465; E04C 2003/0491; E04C 2003/0495; E04C 3/38; E04C 3/40; E04C 3/205; E04C 3/02; E04C 3/04; E04C 3/16; E04C 3/18; E04C 3/11; E04C 3/127

See application file for complete search history.

(56) References Cited

U.S. PATENT DOCUMENTS

| | | | | |
|---|---|---|---|---|
| 2,458,606 A * | 1/1949 | Knabe | E04C 3/40 | 52/93.1 |
| 2,764,107 A * | 9/1956 | Niswonger | E04B 1/34326 | 52/643 |
| 4,201,021 A * | 5/1980 | Aldag | E04B 1/24 | 52/639 |
| 4,245,828 A * | 1/1981 | Aldag | E04C 3/40 | 269/228 |
| 4,435,940 A * | 3/1984 | Davenport | E04B 7/022 | 52/639 |
| 4,748,784 A * | 6/1988 | Dividoff | E04C 3/11 | 29/897.31 |
| 4,961,297 A * | 10/1990 | Bernard | E04B 1/34315 | 52/655.1 |
| 5,577,353 A * | 11/1996 | Simpson | E04B 7/022 | 403/170 |
| 6,293,057 B1 * | 9/2001 | Amos Hays | E04B 1/24 | 52/639 |
| 7,513,085 B2 * | 4/2009 | Moody | E04B 9/00 | 52/635 |

(Continued)

*Primary Examiner* — Jessica L Laux

(74) *Attorney, Agent, or Firm* — Mark M. Friedman

(57) ABSTRACT

A metal canopy structure, including: arches arranged in parallel formation, equally spaced apart, the arches having a planar construction and disposed on a plane running along a first axis; a plurality of cross beams arranged in parallel formation and disposed on a second axis perpendicular to the first axis and mechanically coupled to the plurality of arches; a plurality of support poles, each of the arches mechanically coupled to a pair of support poles; a plurality of coupling poles, the coupling poles disposed along the second axis and mechanically coupled to the plurality of support poles, at least a portion of the coupling poles arranged in a parallel formation.

3 Claims, 36 Drawing Sheets

(56) References Cited

U.S. PATENT DOCUMENTS

| | | | | |
|---|---|---|---|---|
| 8,141,318 | B2 * | 3/2012 | Dunbar | E04C 3/07 52/636 |
| 8,156,706 | B2 * | 4/2012 | Moody | E04C 3/11 52/639 |
| 8,528,268 | B1 * | 9/2013 | Reaves | E04C 3/42 52/93.1 |
| 8,627,633 | B2 * | 1/2014 | Davies | E04C 3/02 52/653.2 |
| 8,671,642 | B2 * | 3/2014 | Green | E04C 3/42 52/643 |
| 10,947,727 | B1 * | 3/2021 | Rushing | E04C 3/42 |

* cited by examiner

FIG. 12
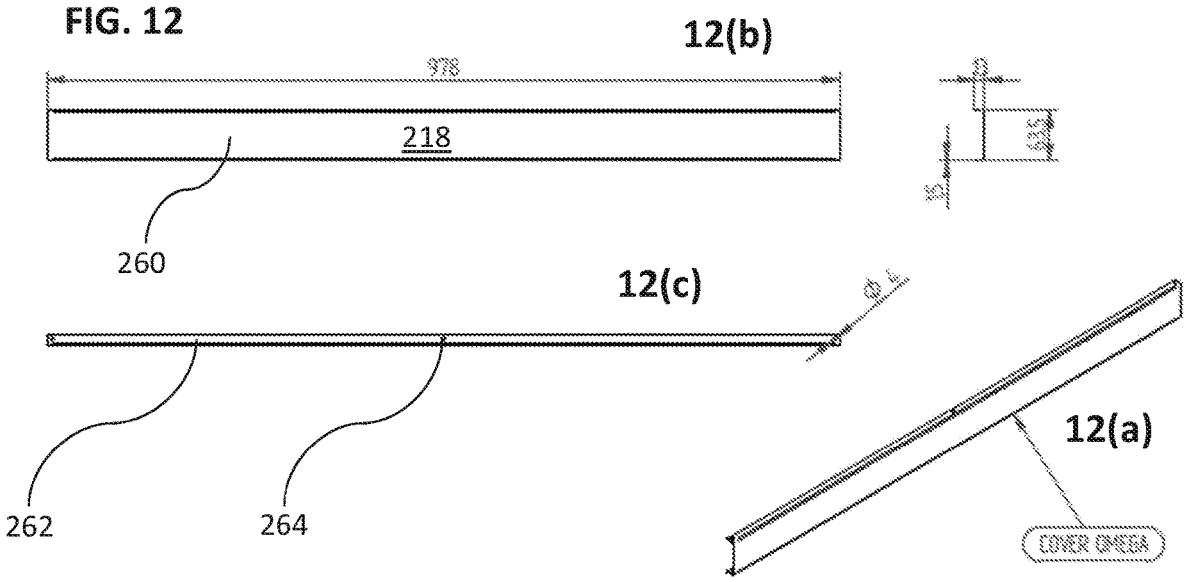
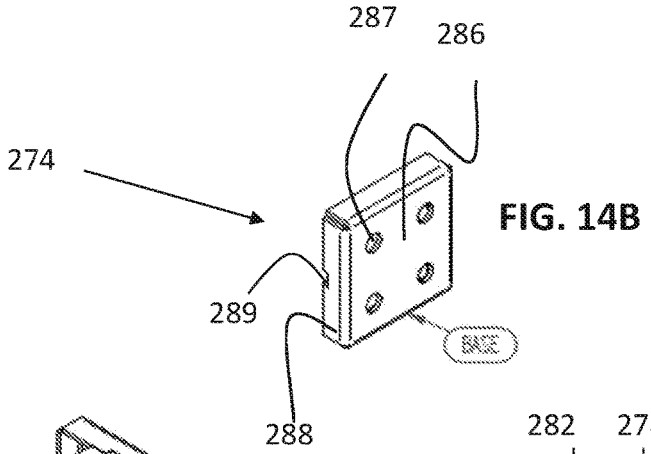
FIG. 14B
FIG. 14
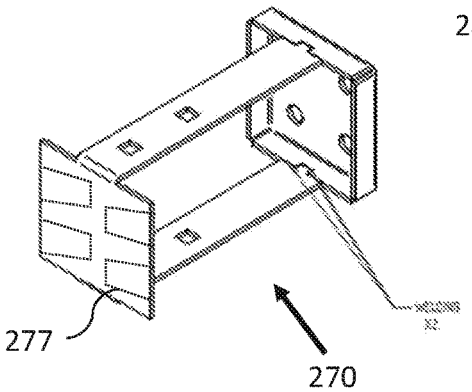
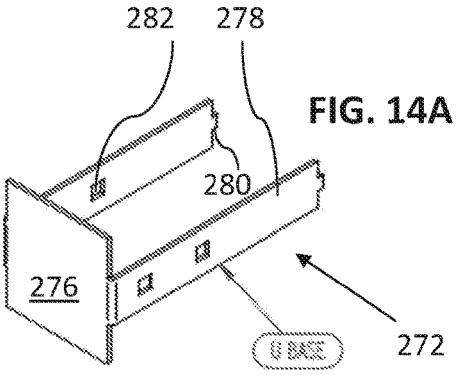
FIG. 14A 301
15(a)
302R
302F
302L
15(b)
302L
312
313
15(c)
302F
314
15(d)
302R
318
316
312
15(e)
320
322

305
314
306R
306F
312
313
316
306L

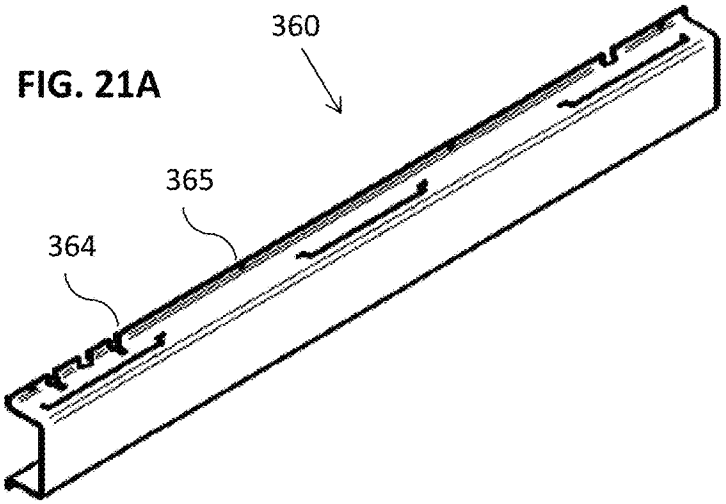
FIG. 21A
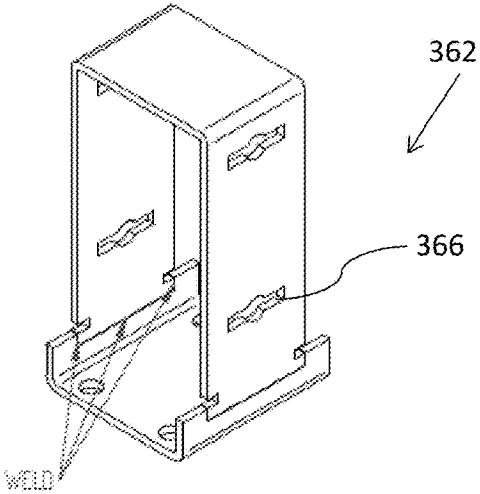
FIG. 21B
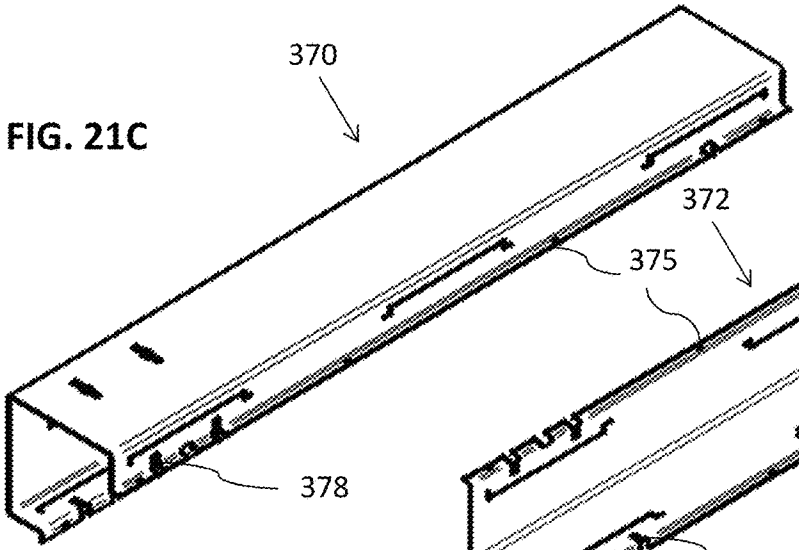
FIG. 21C
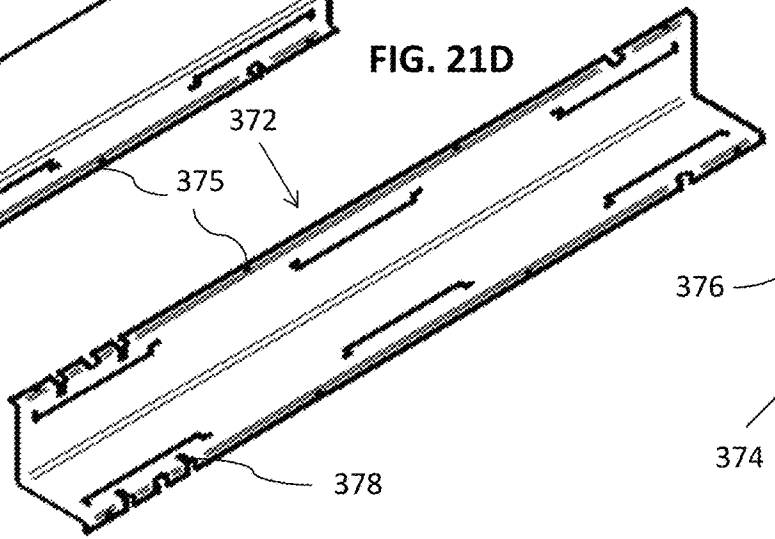
FIG. 21D
FIG. 21E 25(d)
40
3
25(b)
3000
87°
406

25(c)
404
404
Ø 10
25(a)
PILLAR R
402

2802
402
87°

460
462

464
466

470
472
474
476
478
450
451
453
2 LEFT+2 RIGHT
31(a)
31(b)
31(c)
31(d)
31(e)

SECTION E-E 480
34(d)
34(b)
480
F
34(c)
481
480
VIEW F
34(a)
482
480
ANGLE OUT 484
486
ANGLE IN

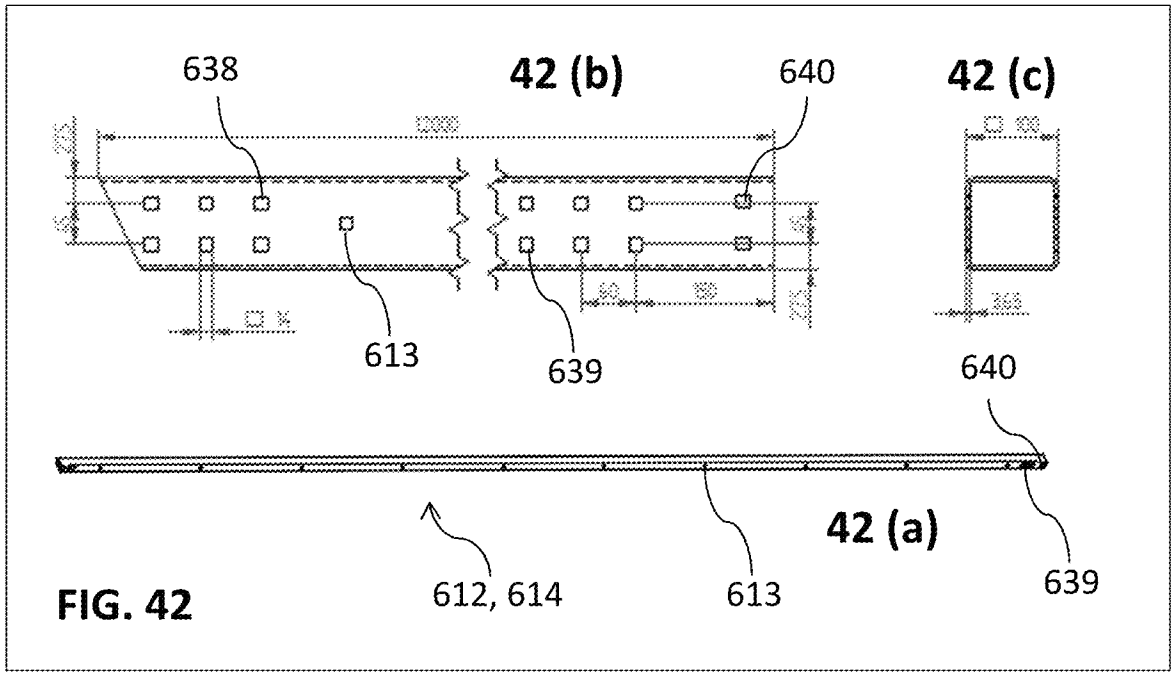
FIG. 42
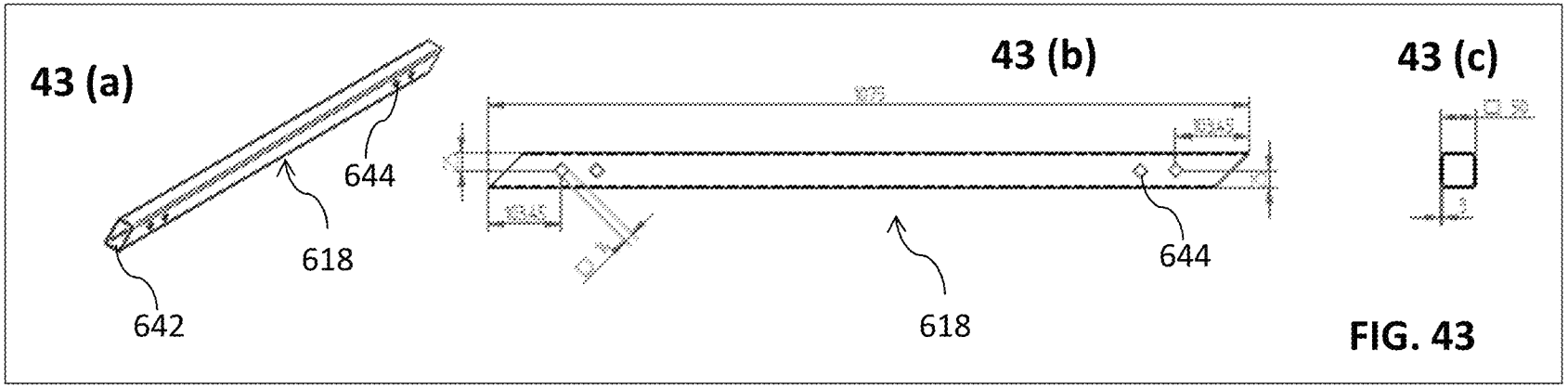
FIG. 43
FIG. 41
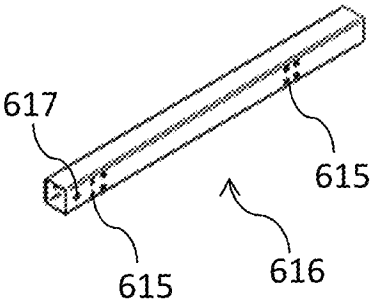
FIG. 43
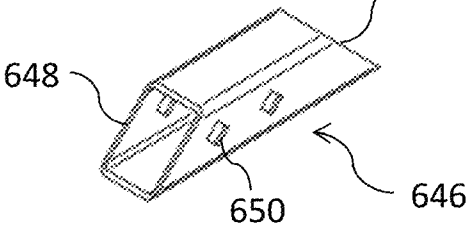

FIG. 56
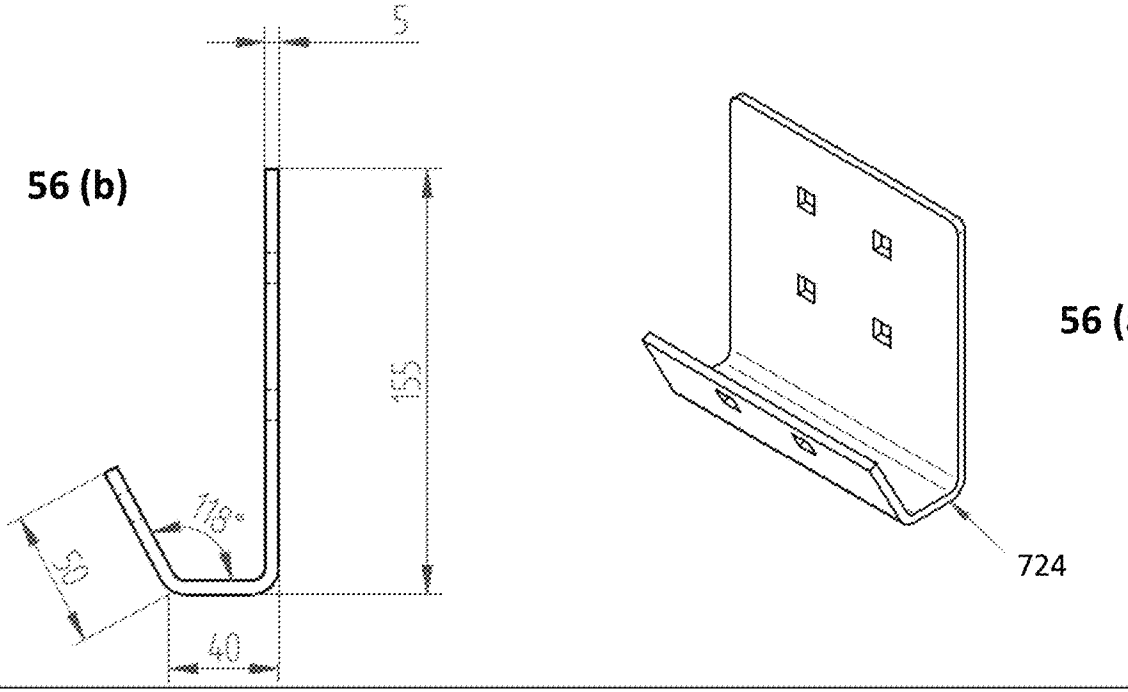
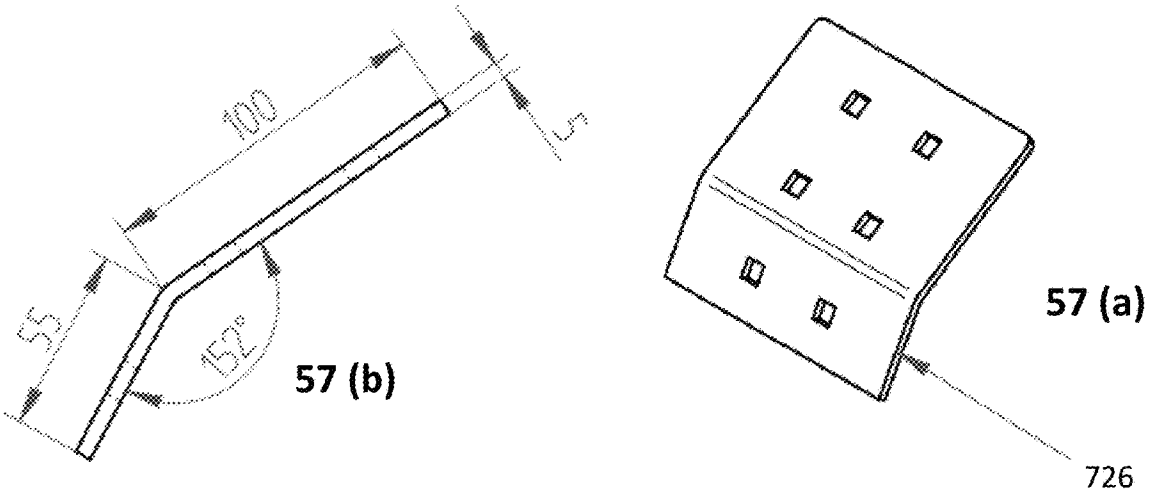
FIG. 57

GALVANIZED STEEL STRUCTURES

FIELD OF THE INVENTION

The present invention relates to a galvanized steel structures and, more particularly, to structures that can be assembled laser cut pieces fastened together with fasteners There is no need for excessive manpower, or any on-location cutting or welding.

BACKGROUND OF THE INVENTION

Almost all steel structures suffer from inadequacies during assembly. Similar pieces are bought in bulk and cut to size, bent to shape and welded in place as necessary. The on-location activities extend the assembly period, necessitate additional manpower and man hours of work and are wasteful of the building materials. Furthermore, galvanized steel is protected by the elements as a result of the galvanization process. However, the galvanized pieces are generally subjected to on-location changes (cutting, bending, welding, etc.), most of which ruin the weather-proof seal of the galvanization. As a result, the assembled pieces look dirty, scorched and defaced as well as suffering from early corrosion at the joins, seams and welding points.

SUMMARY OF THE INVENTION

There are provided herein various structures that are assembled from laser cut galvanized steel pieces and fasteners. No changes need to be to the pieces, leaving the weather-proof finish intact and obviating the need for on-location manipulation of the pieces (i.e. no welding, cutting, bending etc.). The pieces arrive from the factory precut to exact dimensions and galvanized. There is no excessive transportation of materials. Assembly is fast and can be accomplished with a small team of two to four workers.

According to the present invention there is provided a metal canopy structure, including: (a) a plurality of arches arranged in parallel formation, equally spaced apart, each of the arches having a planar construction and disposed on a plane running along a first axis; (b) a plurality of cross beams, at least a portion thereof arranged in parallel formation, each of the cross beams disposed on a second axis perpendicular to the first axis and mechanically coupled to at least a portion of the plurality of arches; (c) a plurality of support poles, wherein each of the arches is mechanically coupled to a pair of the plurality of support poles; (d) a plurality of coupling poles, the coupling poles disposed along the second axis and mechanically coupled to the plurality of support poles, at least a portion of the coupling poles arranged in a parallel formation; wherein each of the plurality of arches comprises: (i) a vertical profile, disposed along a third axis, the third axis perpendicular to both the first axis and the second axis; (ii) a left hand upper profile and a right hand upper profile mechanically coupled to the vertical profile; (iii) a left hand lower profile and a right hand lower profile both mechanically coupled to the vertical profile, the upper and lower profiles each disposed at an acute angle relative to the vertical profile; (iv) a plurality of short profiles, a first half of the short profiles disposed between the left hand upper and lower profiles and a second half of the short profiles disposed between the right hand upper and lower profiles, the short profiles mechanically couples to the upper and lower profiles.

According to further features in preferred embodiments of the invention described below the right and left hand upper profiles are secured to an upper portion of the vertical profile by sandwiching adjacent portions of the right and left hand upper profiles and the vertical profile between two holder legs and affixing the holder legs thereto with fasteners.

According to still further features in the described preferred embodiments the short profiles have a width that is equal to half a width of the upper or lower profile, and wherein the short profiles are disposed in a crisscross arrangement whereby a bottom end of one of the short profiles overlaps with a bottom end of a first adjacent the short profile and a top end of thereof overlaps with a top end of a second adjacent the short profile, wherein the overlapping entails being located side by side widthwise along a shared portion on a length of the upper or lower profile.

According to further features the metal canopy further includes upper and lower holders, wherein the upper and lower holders are securely affixed to the upper and lower profiles and the short profiles with fasteners.

According to further features the vertical profile includes two parallel holes at a top end thereof by which each of the arches can be raised by a lifting mechanism. According to further features the plurality of short profiles includes: (A) a plurality of vertical short profiles, each of the plurality of vertical short profiles being disposed parallel to the vertical profile; and (B) a plurality of angled short profiles, each of the plurality of angled short profiles having a first end thereof proximal a first adjacent vertical short profile and a second end thereof proximal a second adjacent vertical short profile.

According to further features the each of the plurality of vertical short profiles is a parallelepiped with a front face, a back face and side faces, wherein each of the side faces has disposed therein a first rectangular opening near one end and near another end there is a second opening, the second opening formed from a large rectangle having same dimensions as the first rectangular opening and a small rectangle abutting the large rectangle and having smaller dimensions than the large rectangle; wherein the first rectangular opening and the larger rectangle of the second opening are adapted to receive there-through the upper profile or the lower profile; wherein the small rectangle of the second opening is adapted to receive one of the angled short profiles therein; and wherein positions of the first rectangular opening and the second opening are reversed on each of the side faces.

According to another embodiment there is provided a structure, including a plurality of laser cut, galvanized steel pieces; and fasteners, wherein the metal structure is assembled by arranging the plurality of pieces and affixing the plurality of pieces in place only using the fasteners.

According to further features the plurality of pieces includes: a spaced apart frame; two pairs of horizontal bars; and a plurality of vertical bars disposed between the pairs of horizontal bars within the spaced apart frame.

According to further features the plurality of pieces includes: a plurality of pillars; a plurality of slats interposed between adjacent the pillars; a plurality of decorative members interposed between adjacent the pillars, each decorative member interposed between two of the plurality of slats.

According to further features the plurality of pieces includes: a plurality of vertical front rods; a plurality of vertical rear rods, the vertical front rods shorter in length than the vertical read rods; a plurality of vertical side rods; a plurality of floor profiles disposed between the vertical front rods and the vertical rear rods; a bottom frame structure coupling the vertical rods and the floor profiles, the bottom frame structure comprised of: front length-wise profiles, rear length-wise profiles and left and right side width-wise profiles; and a plurality of top covering pieces, including: front top covering pieces, rear top covering pieces and side top covering pieces.

BRIEF DESCRIPTION OF THE DRAWINGS

Various embodiments are herein described, by way of example only, with reference to the accompanying drawings, wherein:

FIG. 7-14, 14A-B illustrate components of a first embodiment of a fence;

FIG. 21A-E illustrate components of a third embodiment of a fence;

FIG. 22-38 illustrate components of a housing structure;

FIG. 39-43 illustrate components of a first embodiment of a metal canopy;

FIG. 44-57 illustrate components of a second embodiment of a metal canopy.

DESCRIPTION OF THE PREFERRED EMBODIMENTS

Figure 1:
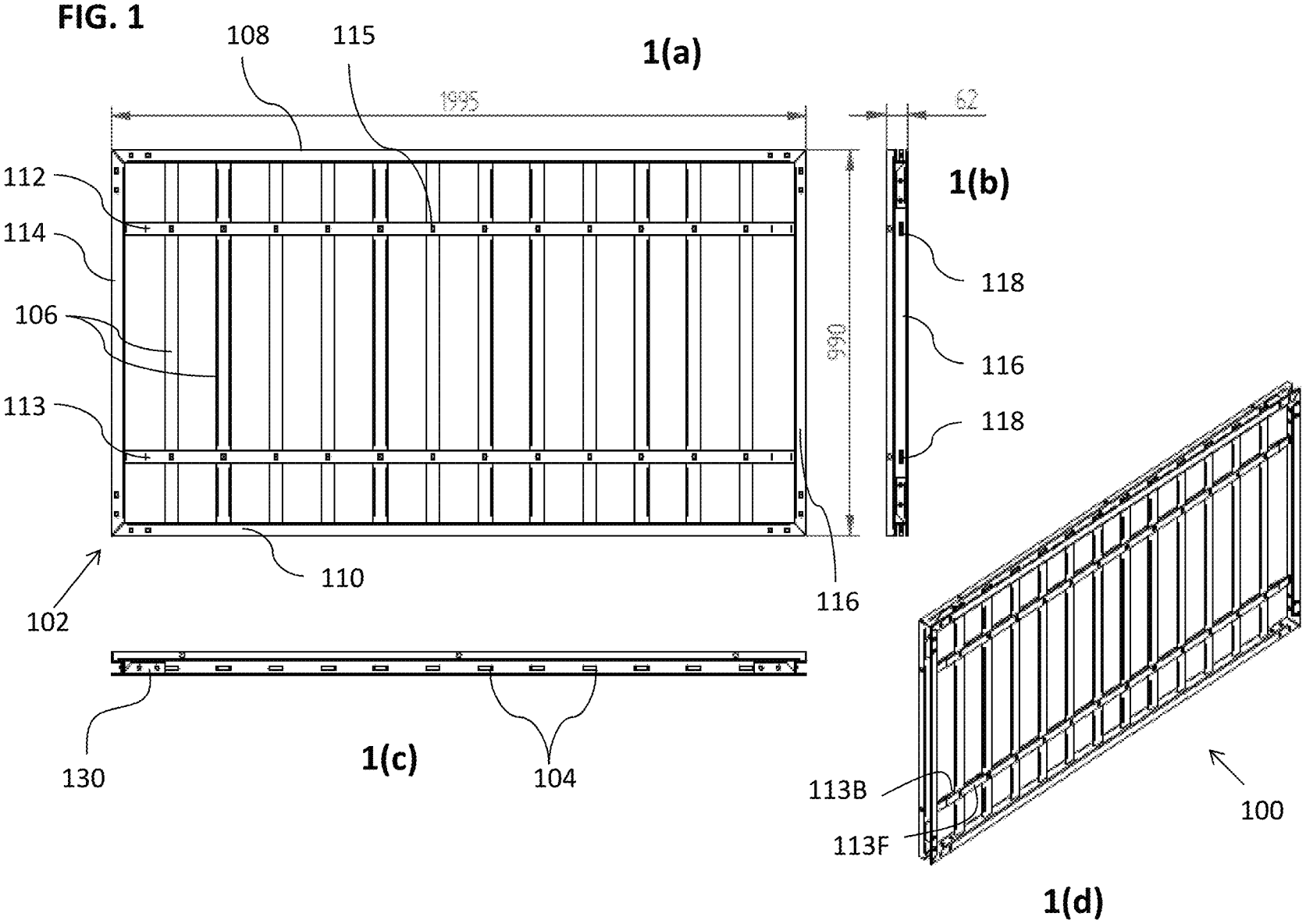
FIG. 1 is a illustrate various views of the innovative windows bars according to a first embodiment.

The principles and operation of a series of assemble-able constructions according to the present invention may be better understood with reference to the drawings and the accompanying description.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical 8 improvement over technologies found in the marketplace, or to enable others of ordinary skill in the art to understand the embodiments disclosed herein.

As used herein, the singular form "a", "an" and "the" include plural references unless the context clearly dictates otherwise. The word "exemplary" is used herein to mean "serving as an example, instance or illustration". Any embodiment described as "exemplary" is not necessarily to be construed as preferred or advantageous over other embodiments and/or to exclude the incorporation of features from other embodiments. It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting. Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways. Initially, throughout this document, references are made to directions such as, for example, upper and lower, top and bottom, and the like. These directional references are exemplary only to illustrate the invention and embodiments thereof.

Window Bars Assembly

Referring now to the drawings, FIGS. 1(*a*)-(*d*) illustrate various views of the innovative windows bars according to a first embodiment. FIG. 1(*a*) is a front view of the bars. FIG. 1(*b*) is a side/profile view of the bars. FIG. (c) is a bottom view of the bars and FIG. 1(*d*) is an isometric view of the bars.

Window bars assembly 100 includes an external frame 102 with openings 104 for numerous vertical bars 106 in the top 108 and bottom 110 profiles. Two horizontal bars 112, 113 run across the vertical bars. Each of the two horizontal bars is actually each made up of two thin, flat, elongated, rectangular pieces 112F, 112 B. One piece 112F is positioned in front of the vertical bars 106 and the other piece 112B is positioned behind the vertical bars. All in all there are four horizontal pieces, excluding the frame. Preferably, all the pieces are made from galvanized steel.

Figure 2A:
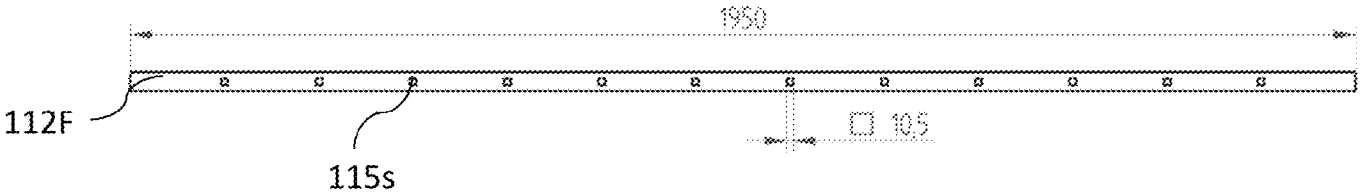
FIG. 2A is a front view of a front horizontal piece 112F, 113F.
Figure 2:
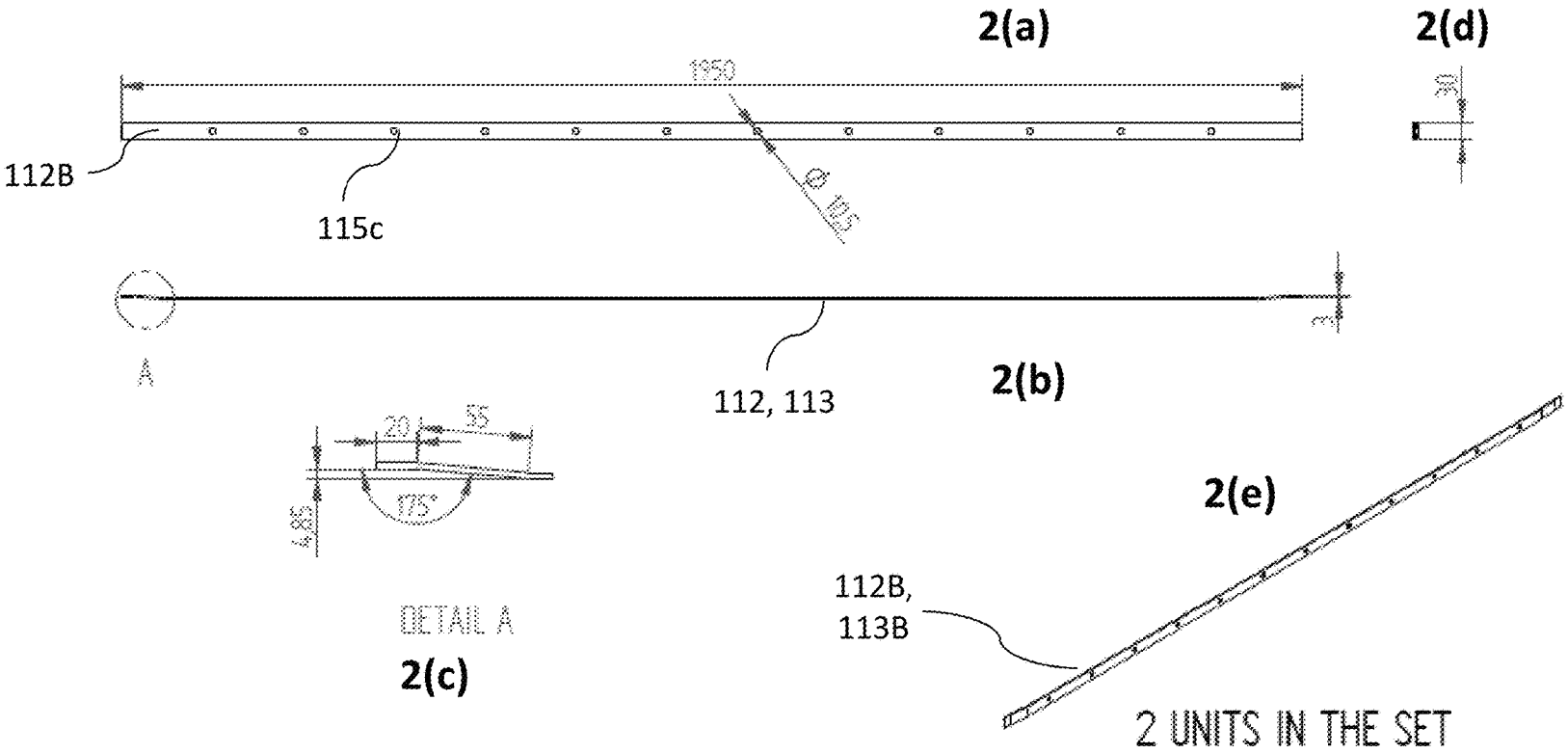
FIG. 2 is an exemplary horizontal piece 112, 113 from various views and magnifications.

FIG. 2 is an exemplary horizontal piece 112, 113 from various views and magnifications. FIG. 2(*a*) is a front view of an exemplary, back horizontal piece 112B, 113B. FIG. 2(*b*) is a profile view of the horizontal piece. FIG. 2(*c*) is a magnified and detailed view of area A of FIG. 2(*b*). FIG. 2(*d*) is a partial front view with measurement. FIG. 2(*e*) is an isometric view of the piece. The exemplary piece is 1950 mm in length, 30 mm in width and 3 mm thick. Each end of the horizontal piece is stepped-up by a differential of 175°. When two horizontal pieces are placed back to back (on opposite sides of the vertical bars) the ends of the pieces touch each other (whereas the rest of the pieces are spaced apart, on either side of the vertical bars) and can be inserted into corresponding apertures 118 formed in the left and right hand profile pieces 114, 116 of frame 102 (FIGS. 1(*a*) and 1(*b*)).

FIG. 2A is a front view of a front horizontal piece 112F, 113F. The front piece is distinguished from the back piece in that the front pieces have square openings 115*s* (twelve in each of the exemplary, depicted pieces) whereas the back pieces have circular openings 115*c*. For the sake of simplicity, all screw/rivet openings are generally referred to as openings 115. The openings 115 and securing pieces or fasteners (e.g. carriage bolts) are discussed in detail below and apply throughout the description mutatis mutandis.

Figures 3A, 3B:
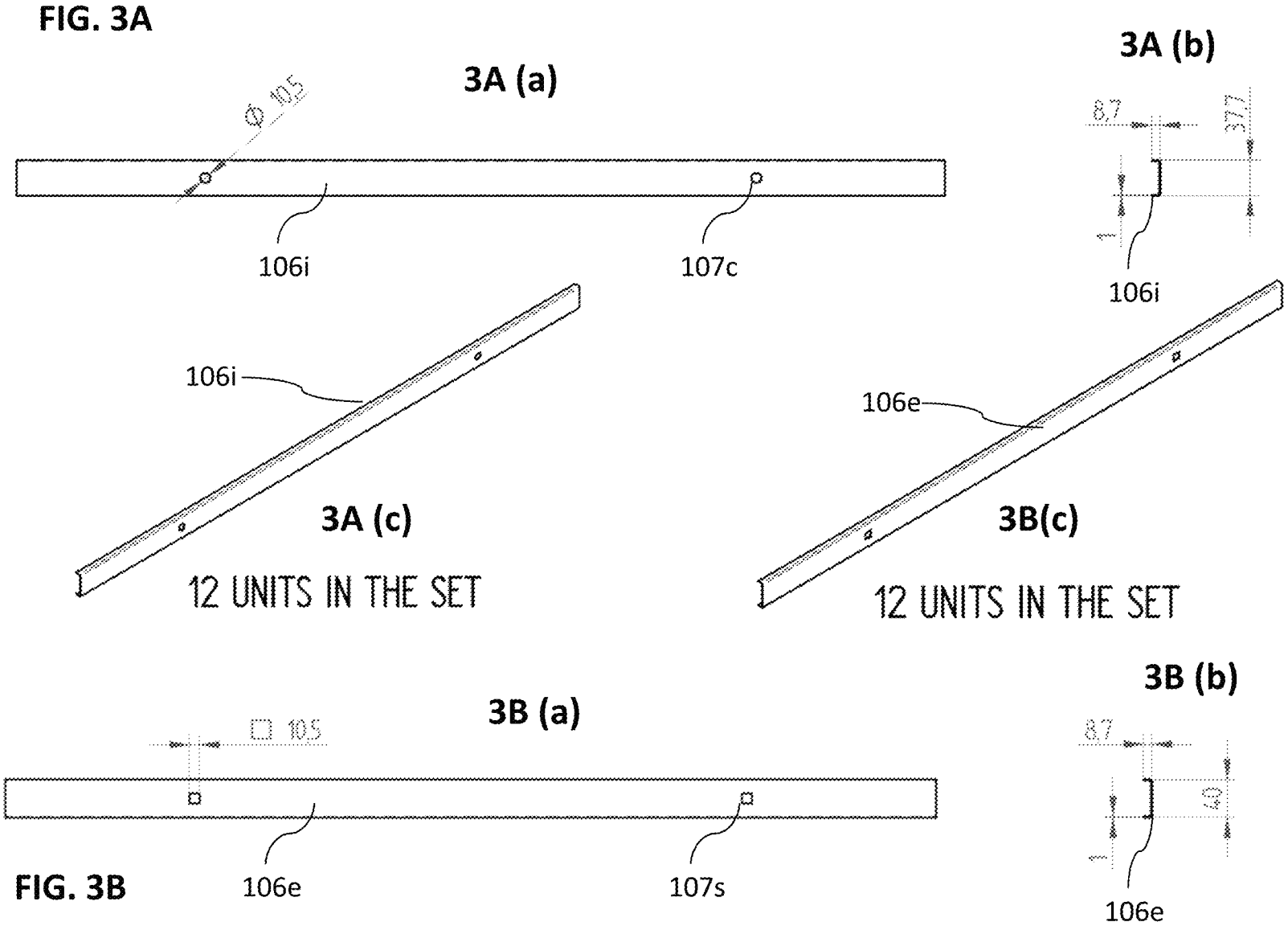
FIGS. 3A and 3B include various views of vertical bar 106*i*/106*e;*

Each vertical bar 106 is made up of two pieces, an internal piece 106*i* and an external piece 106*e*. FIG. 3A illustrates various views of vertical bar 106*i*. FIG. 3A (a) is a front view of the internal piece 106*i* of the vertical bar 106. FIG. 3A (b) is a side or profile view of the internal piece. The exemplary height of the internal piece is shown as 37.7 mm. FIG. 3A (c) is an isometric view of the internal piece. Note that there are two openings 107, where each opening is circular, and designated 107*c*.

FIG. 3B illustrates various views of vertical bar 106*e*. FIG. 3B (a) is a front view of the external piece 106*e* of the vertical bar 106. FIG. 3B (b) is a side or profile view of the external piece. Both the internal and external pieces have a square bracket ("[") shape, with one long side bookended by two short sides. The exemplary height of the external piece is shown as 40 mm. The internal piece 106*i* fits inside the external piece 106*e* with the open sides of the pieces facing each other. The short sides are 8.7 mm in length. Therefore, when inserted one in the other, the pieces define an empty rectangle between them of about 8.7 mm depth, running along the entire length of the bar. FIG. 3B (c) is an isometric view of the external piece. Note that the two openings 107 are square, and designated 107*s*.

In the exemplary assembly depicted in FIG. 1, there are 12 vertical bars 106. Each bar has two openings 107 for receiving screws or rivets there-through. Each opening corresponds in position to one of twelve openings 115 in the horizontal pieces 112, 113. Each coupling member or fastener (screw, rivet, etc.) traverses four pieces, the front horizontal piece 112F, 113F, the vertical bar internal 106*i* and external 106*e* pieces, and back horizontal piece 112B, 113B, via the corresponding apertures in each piece. The front piece 112F abuts the external piece 106*e* and the back piece 112B abuts the internal piece 106*i*. Note that the openings on the front and external pieces are square and the openings on the back and internal pieces are round.

Preferably, the type of fastener used is a screw called a carriage bolt (also called a coach bolt or round head square neck bolt). A carriage bolt is distinguished from other bolts by its shallow mushroom head and that the shank cross-section of the bolt is circular for most of its length, as usual, but the portion immediately beneath the head is formed into a square section. The square section fits inside the square openings. The circular, threaded end of the screw is preferably flat-ended to receive a nut.

Figure 4:
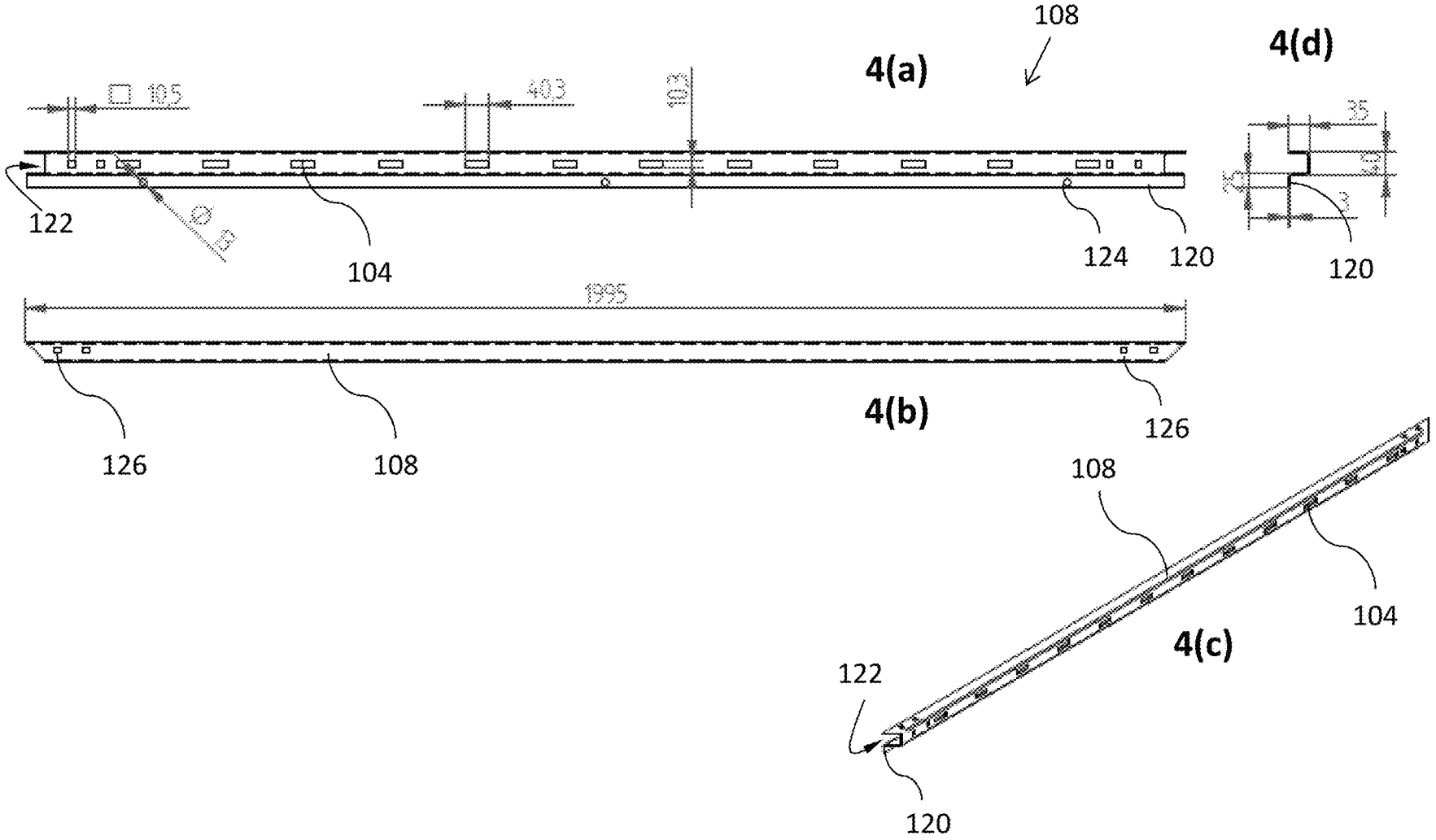
FIG. 4 includes various views of top profile 108.

FIG. 4 illustrates various views of top profile 108. Bottom profile 110 is an exact copy of the top profile 108. FIG. 4(*a*) is a top down view of top profile 108. FIG. 4(*b*) is a front view of the top profile. FIG. 4(*c*) is an isometric view of the top profile and FIG. 4(*d*) is a cross-sectional, side or profile view of the top profile 108. The profile is beveled at either end. The left and right hand profile pieces 114, 116 are correspondingly beveled, in order to fit together with the top and bottom profiles. As can be seen from the profile view of FIG. 4(*d*), the profile has a U-shape with a lip 120 coming off one of the ends of the U. The bottom of the U faces inside the frame. This is the same for all the profiles. As a result, a channel 122 runs around the entire frame. The ends of the vertical bars 106 protrude through the apertures 104 into channel 122.

Figure 5:
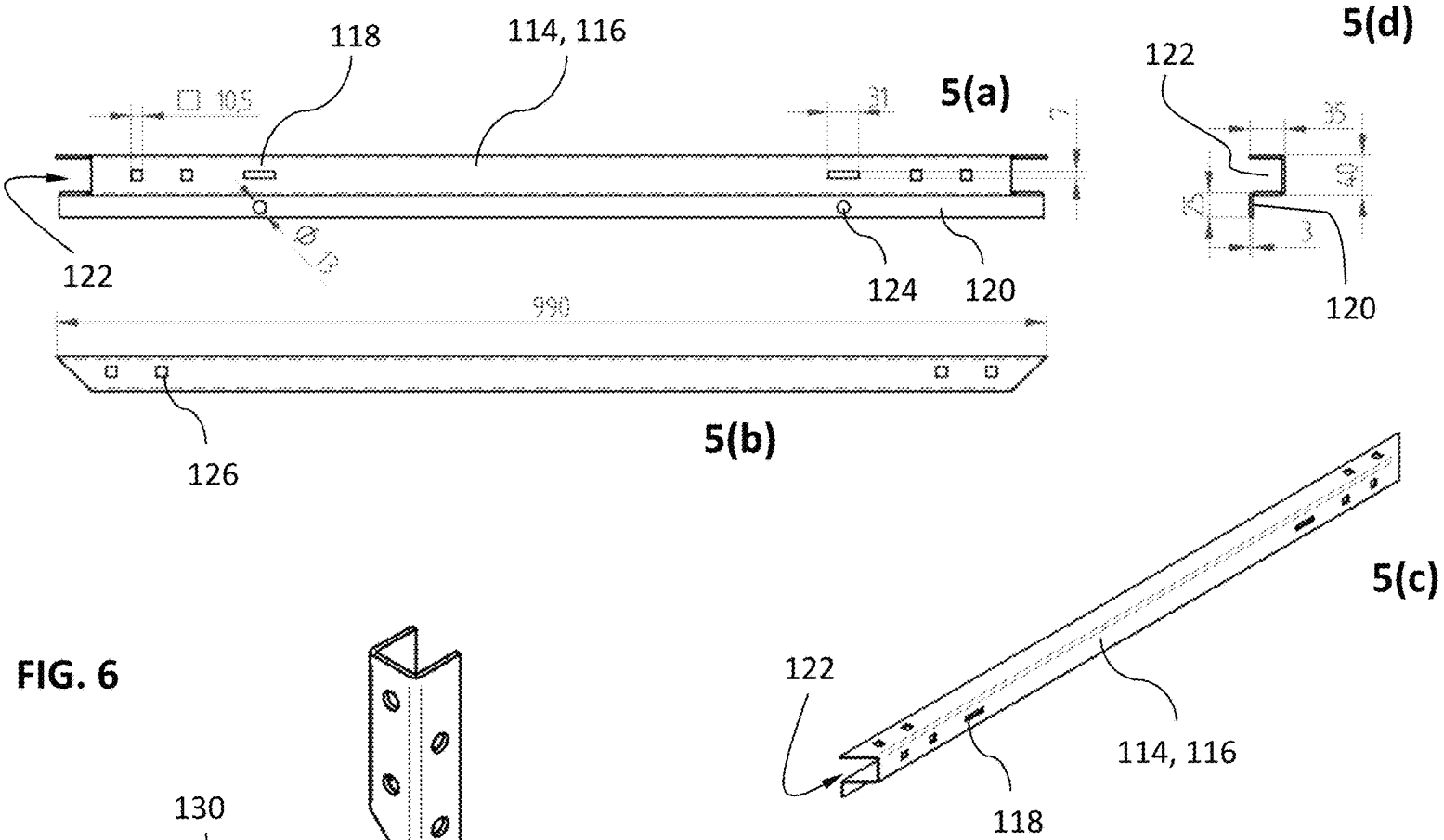
FIG. 5 includes various views of a side profile 114, 116.

FIG. 5 illustrates various views of a side profile 114, 116. The left and right side profiles are the same. FIG. 5(*a*) is a top down view of side profile 114, 116. FIG. 5(*b*) is a front view of the side profile. FIG. 4(*c*) is an isometric view of the side profile and FIG. 4(*d*) is a cross-sectional, side or profile view of the side profile 114, 116. The side profile 114, 116 is beveled at either end. The top and bottom profile pieces 108, 110 are correspondingly beveled, as mentioned above, in order to fit together with the side profile pieces. As with the top profile piece 108 discussed above, the side view of FIG. 5(*d*) shown that the side profile also has a U-shape with lip 120 coming off one of the ends of the U. The bottom of the U faces inside the frame. This is the same for all the profiles, as mentioned above. Channel 122 is likewise visible in FIGS. 4(*a*) and (*c*) and (*d*). The ends of the horizontal bars 112, 113 protrude through the apertures 118 into channel 122.

The window bars assembly 100 is configured to be installed inside a brick/cement window box. The top, side and bottom profiles are connected to the window box by appropriate screws which are inserted through holes 124 in the lip 120 into the cement window box. The lip 120, seen best in FIG. 4(*a*), runs around the entire frame, so that the frame can be secured from the top, sides and bottom of the frame. While exact measurements have been provided for the exemplary embodiment, it is clear that each window bars assembly 100 is adapted exactly to the specific dimensions of the window box into which the assembly is to be installed.

Figure 6:
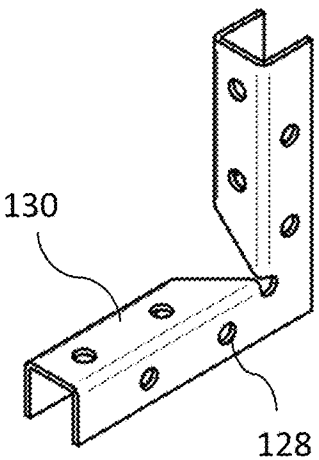
FIG. 6 is an isometric view of an L-shaped corner piece.

Four, L-shaped pieces 130 are inserted into channel 122 at the four corners of the frame 102. FIG. 6 illustrates an isometric view of an L-shaped corner piece 130. The corner piece 130 has U-shaped cross-sections. Each profile piece 108, 110, 114, 116 has six opening 126 on each end of the profile piece, two openings on each of the three sides of the U-shape of the profile piece. Each profile piece has a total of twelve openings 126. Screws or the like are inserted through the openings 126 into corresponding openings 128 in the L-shaped corner pieces 130, thereby securing the profile pieces together. Exemplarily, carriage bolts and appropriate nuts are used to secure the profile pieces to the corner pieces.

All the pieces described above are preferably laser cut, galvanized steel. No welding is needed. Installation of the assembly 100 is simple and clean and can performed by a single individual. It is well known in the art that whenever welding is involved, the galvanized finish of steel pieces is ruined and there is usually a need for a touch-up job with paint to cover over the scorch marks. All of this is obviated with the present assembly. The frame pieces can be modified slightly, at manufacture, so that the assembly can be mounted on the external face of a wall, outside a window box.

Fence I

Figure 7:
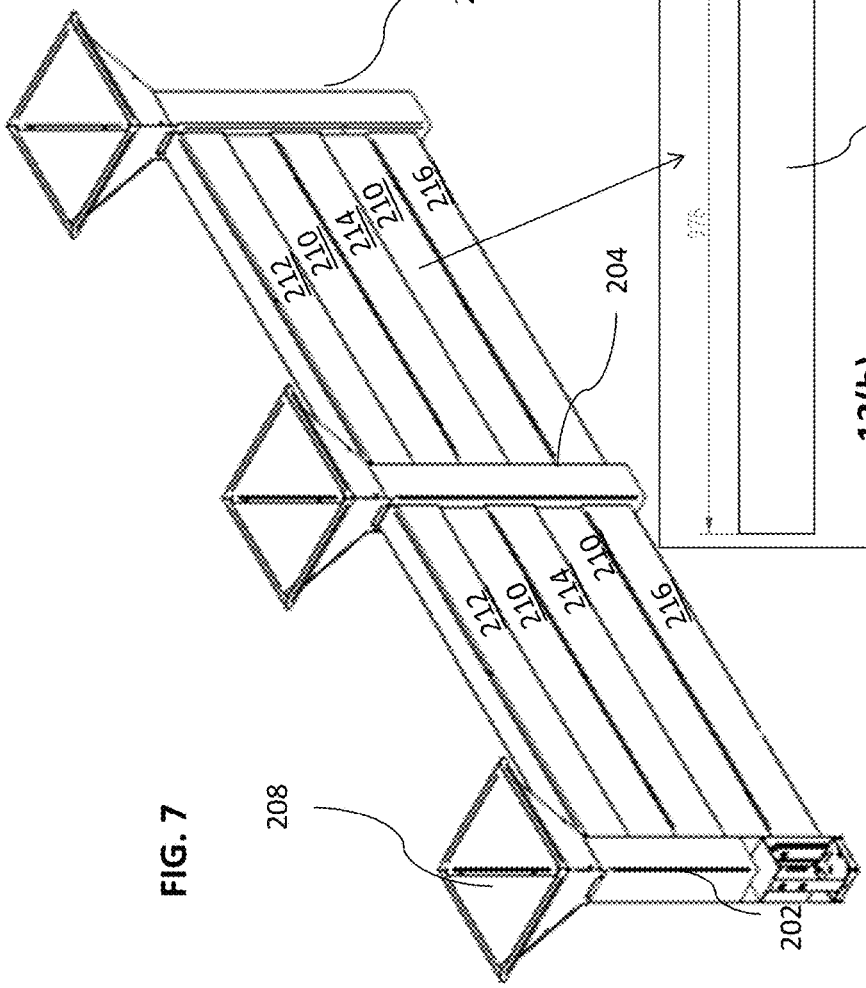

A garden fence 200 is depicted in FIG. 7. Fence 200 has three pillars, a left hand pillar 202, a middle pillar 204 and a right hand pillar 206. The left and right hand pillars are left and right ends of the fence. For a longer fence, additional middle pillars are added. The fence is therefore scalable to any length.

Exemplarily, pillars are topped with flower pots 208 which are decorative pieces. The pillars can alternatively be topped with simple pillar covers, instead of decorative pieces.

In the exemplary embodiment depicted in the figures, the slats between the pillars alternate between elongated, rectangular glass panes 210 (e.g. frosted glass, decorative glass etc.) and elongated, rectangular, thin steel slats. There are top slats 212, middle slats 214 and bottom slats 216. The fence has a front façade and a back façade, referred to alternatively as outer face 200out and inner face 200in respectively. For each pane or slate enumerated above, there is a parallel pane or slat on the back façade, inner face 200in.

When there is a need to distinguish between the inner and outer panes or slats, the inner slat will include the letter "i" appended to the reference number, e.g. 214*i*, and the parallel piece on the outer face will be identified with the letter "o" appended to the reference number, e.g. 214*o*.

Each façade, in the depicted fence, has two sections which, together, include two top slats, two middle slats and two bottom slats, as well as four glass panes. All in all, front and back, there are 12 slats and 8 glass panes. For each additional pillar, six slats and four glass panes are added. Materials other than glass may be used, such as hardened plastic, steel, wood, etc.

The top of each slat section, between the pillars, is covered with a thin, elongated, rectangular cover piece 218. The cover piece is laid horizontally over the top slats of the front and back façades. The facades are spaced apart, defining an empty volume there-between. Lights, piping (e.g. for watering the flower pots), electricity cables (e.g. connecting the lights to each other and to the power mains) and any other components can be placed inside the empty volume. Lights can be fitted behind the glass panes and connected to electrical outlets via electrical cables. Water pipes can be run between the flower pots, hidden inside the empty volume, and connected to water mains.

Figure 8:
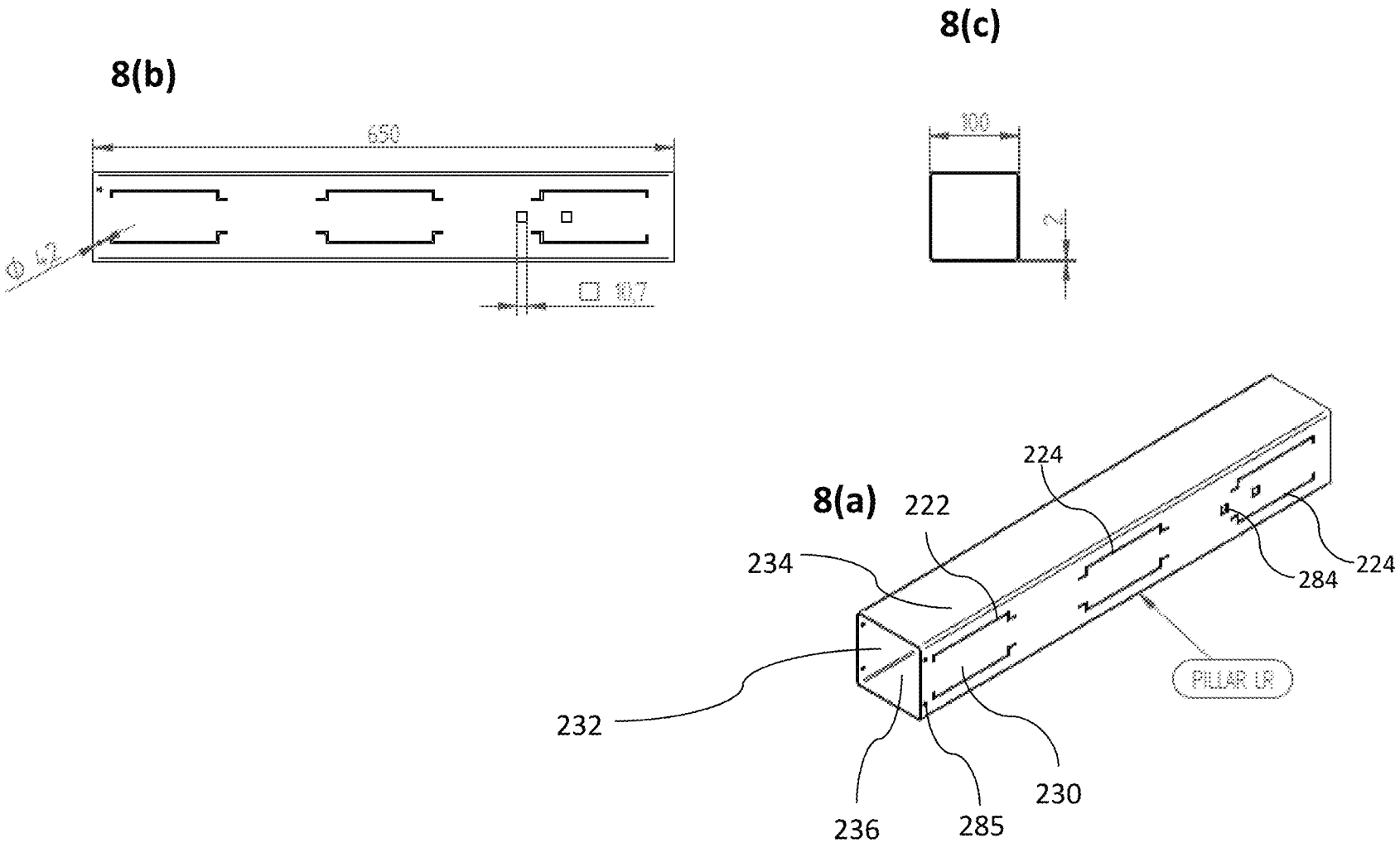

FIG. 8 illustrates various views of the left and right pillars 202, 206 which have the same structure and are referred to interchangeably herein and/or as the side pillar. Therefore reference to either of the pillars is understood to apply equally to both pillars, unless specifically stated otherwise.

FIG. 8(*a*) is an isometric view of the side pillar. FIG. 8(*b*) is a side view of the side pillar. FIG. 8(*c*) is a top-down or bottom-up view of the pillar, which incidentally illustrates the cross-section of the pillar. The pillar has a square shaped cross-section. The pillar has four faces: front, back, closed face and open face. The front and back faces of the pillar (as viewed from outside the fence and inside the fence respectively) are completely blank. Of course, any kind of design or indicia can be drawn, adhered or engraved on the pillar, but from a structural point of view, these faces are completely devoid of openings. One face of the pillar, the open face, is seen in FIGS. 8(*a*) and 8(*b*) and has a plurality of openings of various shapes and sizes (hence the term "open face"). The face opposite the face with the openings, the closed face, is almost completely devoid of openings (aside from two small screw holes near the top and two square screw holes near the bottom).

The two middle openings 224 have 'omega' shapes. Two openings 222 above (depicted in FIGS. 8(*a*) and (*b*) on the left of the middle openings) the omega-shaped openings 224 and the two openings 226 below (on the right) have partial or incomplete omega shapes. As will be discussed in further detail below, the middle metal slats 214 have an omega-shaped profile (or cross-section) and slide into the middle, omega-shaped openings 224. The top slats 212 have a partial omega-shaped profiles and slide into the openings 222. The bottom slats 216 also have partial omega-shaped profiles and fit into openings 226.

In addition, between openings 226, there are two, square-shaped screw openings 284 which will be discussed in further detail below in relation to the internal, U-shaped base/pillar support 270. Not shown are two circular screw holes on the closed face of the pillar, opposite the square screw holes 284. On the opposite end of the pillar, both on the closed and open faces of the pillar, are pairs of screw holes 285. The screw holes line up with corresponding screw holes on the bottom of the flower pots, for fastening the flower pots to the tops of the pillars. Both sets of screw holes are in both the open and closed faces of the side pillars.

Figure 9:
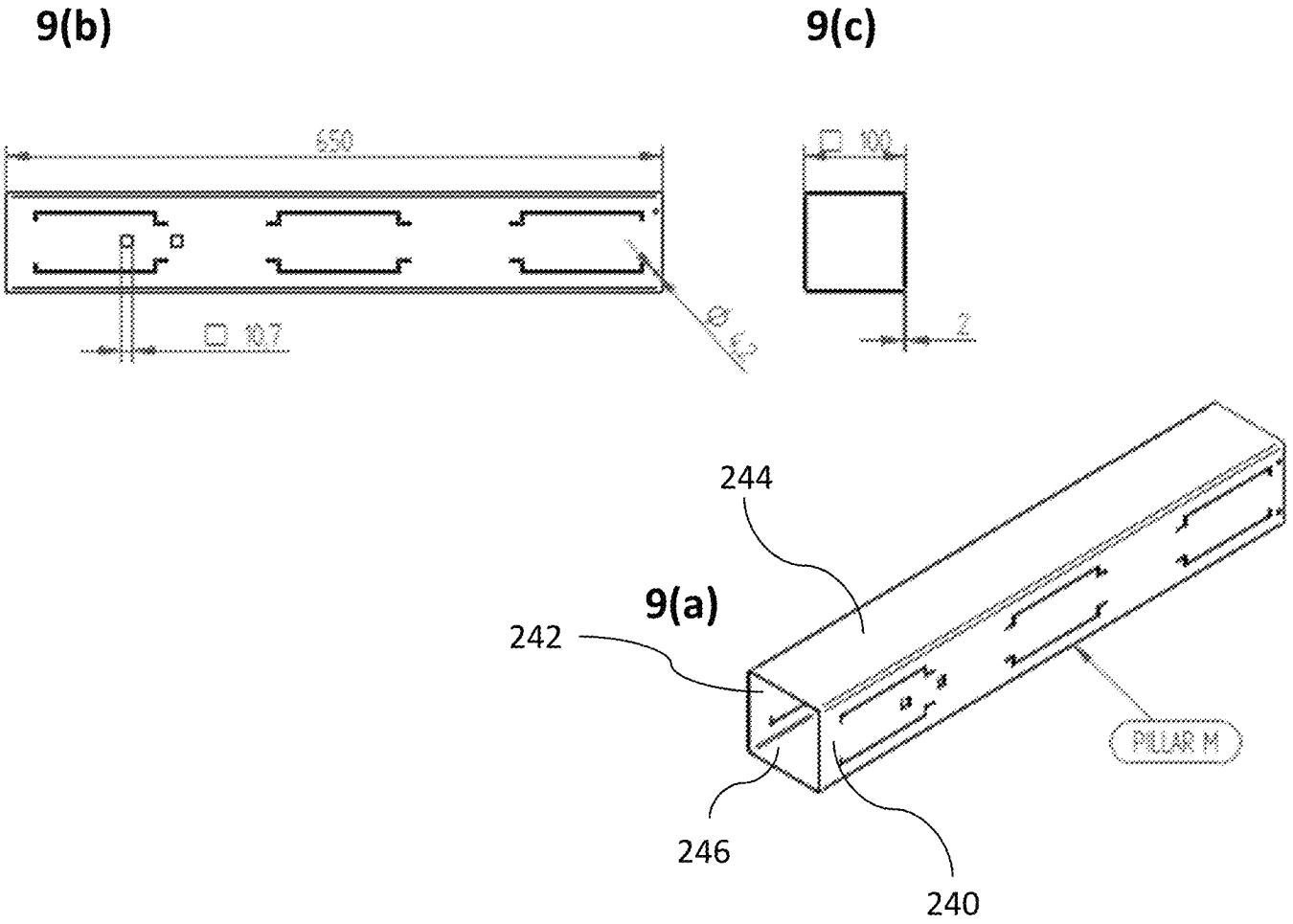

FIG. 9 illustrates various view of middle pillar 204. FIG. 9(*a*) is an isometric view of the middle pillar. FIG. 9(*b*) is a side view of the middle pillar. FIG. 9(*c*) is a top-down or bottom-up view of the middle pillar, which incidentally illustrates the cross-section of the pillar. The pillar has a square shaped cross-section. The pillar has four faces: front, back, two side faces. The front and back faces of the pillar (as viewed from outside the fence and inside the fence respectively) are completely blank, as with the side pillars. Here too, any kind of design or indicia can be drawn, adhered or engraved on the pillar, but from a structural point of view, these faces are completely devoid of openings.

One of the side faces of the middle pillar is clearly seen in FIGS. 9(*a*) and 9(*b*) and has a plurality of openings of various shapes and sizes. In contrast to the side pillars, both side faces of the middle pillar have similar openings. Otherwise, all the openings are the same and should be considered as if fully set forth here, mutatis mutandis for the second face with apertures. The distinction is due to the fact that metal slats are fitted into the middle pillar on both ends (and not just from one side, which is the case with the side pillars). The openings in the middle pillar are precisely the same as the openings in the side pillar, with the difference being that there are openings or apertures in two faces of the middle pillar as opposed to only one face in the side pillar, as mentioned above. Here too, however, between openings 226, there are two, square-shaped screw openings 284 which will be discussed in further detail below in relation to the internal, U-shaped base/pillar support 270. Not shown are two circular screw holes on the opposing face of the pillar, lined up with the square screw holes 284.

Figure 10:
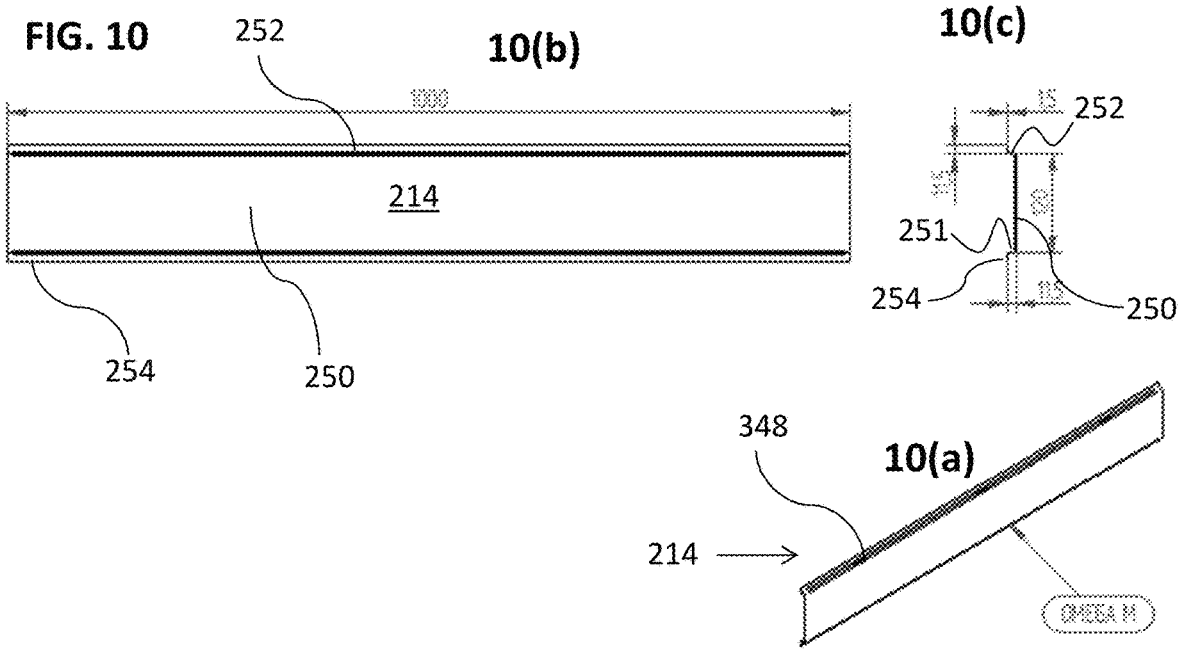

FIG. 10 illustrates various views of the omega-shaped middle slat 214. FIG. 10(*a*) is an isometric view of the middle slat 214. FIG. 10(*b*) is a front view of the middle slat. FIG. 10(*c*) is a profile view of the middle slat, which also illustrates the omega-shaped cross-section of the middle slat 214. The middle slat 214 has a main section 250 as well as an upper lip 252 and a lower lip 254. The omega shape gives the slat improved purchase inside the pillars as well as spreading out the weight of the slat. A straight slat concentrates all the pressure on the thin edge of the vertically oriented slat. With the omega configuration, there is a "step" 251 which is perpendicular to both the main section 250 and the lips 252, 254. Almost all the weight of the slat is supported by the wide step 251, between the main section and the bottom lip. The lower "step" in each of the slats performs a similar function for each of the slats.

Figure 11:
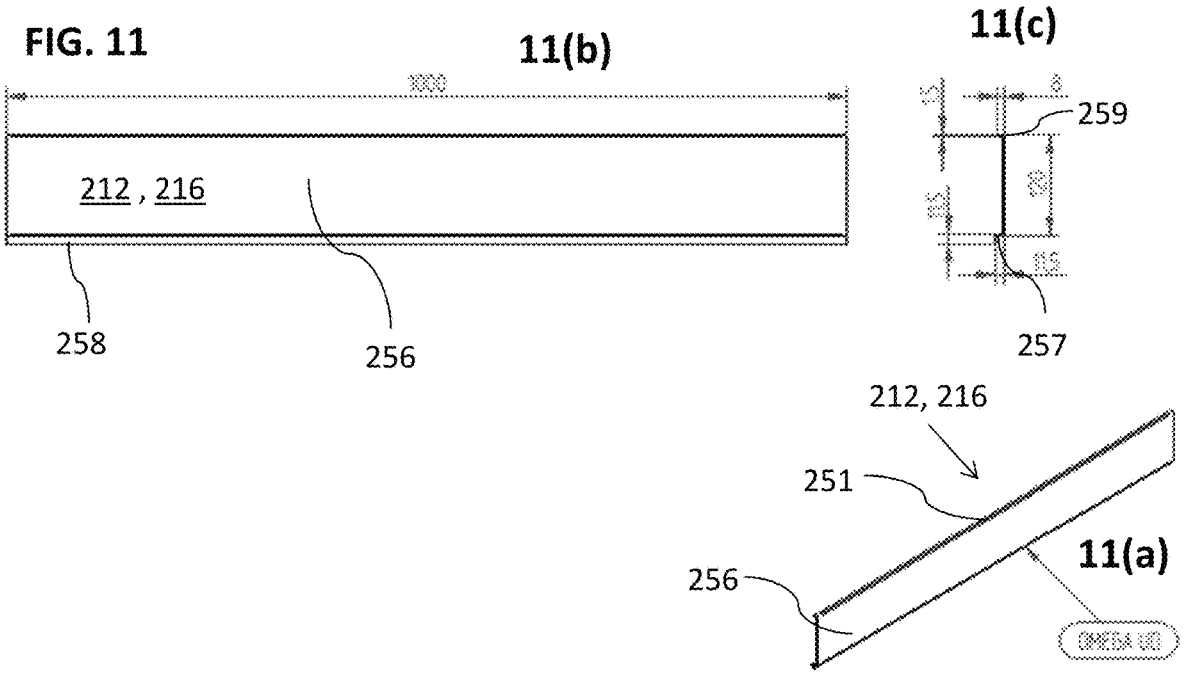

FIG. 11 illustrates various views of the partially omega-shaped top slat 212 or bottom slat 216, referred to collectively as an outer slat 212, 216. FIG. 11(*a*) is an isometric view of the outer slat 212, 216. FIG. 11(*b*) is a front view of the outer slat. FIG. 11(*c*) is a profile view of the outer slat, which also illustrates the partially omega-shaped cross-section of the outer slat. The outer slat 212, 216 has a main section 256 and a lip 258. The lip 258 is either a lower lip, if the slat is a top slat 212, or an upper lip, if the slat is a bottom slat 216. A glass pane 210 is adhered to the lower lip 258 of the top slat 212 and the upper lip 252 of the middle slat 214. In a similar fashion, another glass pane is adhered to the lower lip 254 of the middle slat 214 and the upper lip 258 of the bottom slat 216.

Similar to that which was described above, there is a wide step on the end of the slat with the proper omega configuration and on the end of the slat which has a truncated configuration. These steps support most of the weight of the slats. With the top slat 212, there is a step 257 between the main section 256 and the lip 258 shoulders the weight. In the bottom slat 216, a step 259 on the side of the slat that has the truncated configuration (i.e. the side without a lip) shoulders the weight. The aforementioned function is clear when viewing the corresponding openings on the pillars in FIGS. 8 and 9.

It is made clear that the fence can be scaled both in height and in length. The fence is scaled in height by adding requisite height to the pillars and additional middle slats. As such, in all fences of the instant structure, for each section of the fence, there is only one top slat and one bottom slat. The number of middle slats changes depending on the height of the fence. Glass panes are interspersed between metal slats. In a similar vein, as mentioned above, the length of the fence can be scaled up by adding middle pillars and corresponding slats and panes.

FIG. 12 illustrates various views of cover piece 218. FIG. 12(*a*) is an isometric view of the cover piece 218. FIG. 12(*b*) is a top-down view of the cover piece. FIG. 12(*c*) is a front view of the cover piece and FIG. 12(*d*) is a side or profile view of the cover piece. The cover piece has a "C" or bracket ("[") shaped profile with an elongated, rectangular main piece 260 with lips 262 on each side of the main piece, running the length of the rectangular piece. The lips are perpendicular to the main piece. The main piece has a width at least as large as the space between the front and back faces of the fence. The length of the main piece is slightly shorter than the metal slats, but equivalent to the length of space between the pillars. For example, in the depicted figures, a metal slat has an exemplary length of 1000 mm (1 meter), whereas a cover piece is 978 mm long. The difference in length is because the slats protrude into the pillars approximately 6 mm on each side. The 6 mm on each end of the slat gives the slat purchase in the pillars, supports the rest of the weight of the meter long slat.

Cover piece 218 is seated on top of the upper edges of the top slats 212 of the back and front faces of the fence. Three drill holes 264 are formed on the each of the lips 262. The cover is fixedly attached to the top slats 212 with screws (or the like) that are threaded through the screw holes 264 into the slats.

Figure 13A:
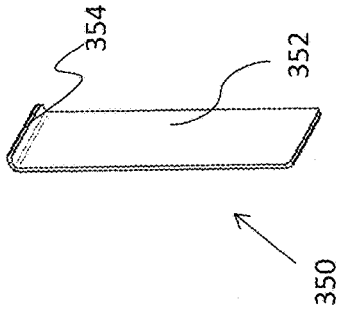
Figure 13:
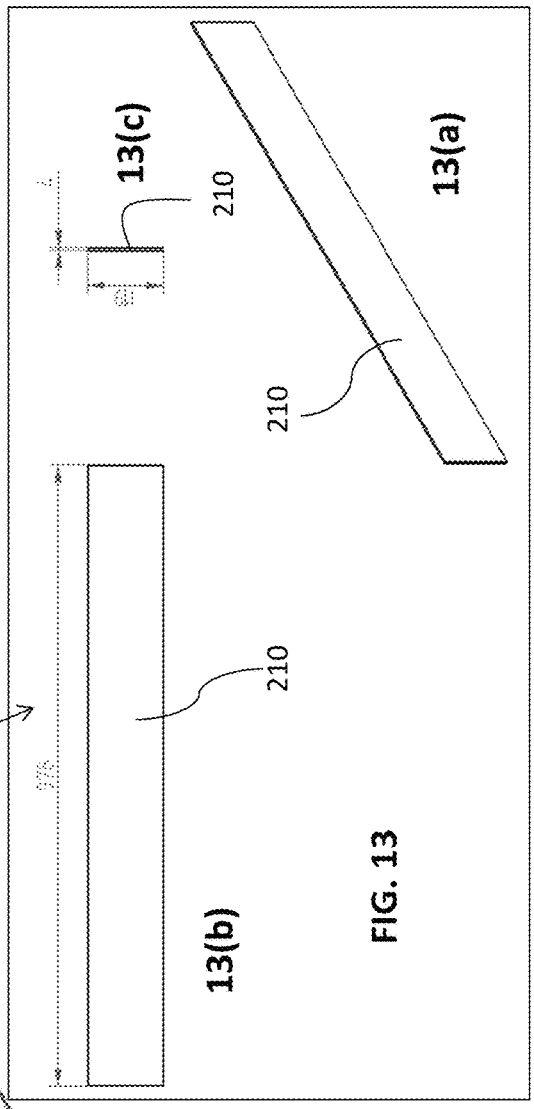

FIG. 13 illustrates various views of the glass pane 210. FIG. 13(*a*) is an isometric view of the pane. FIG. 13(*b*) is a front view of the pane and FIG. 13(*c*) is a side or profile view of the pane 210. The pane is the same length of the cover piece (e.g. 978 mm). As mentioned above, the top and bottom edges of the glass pane can be adhered to corresponding lips of the metal slats, e.g. with glue. Alternatively, the slats can be form with indentations on the step portions 251 that are structured to prevent the glass from falling out of the fence. The indentations may be contiguous along the length of the slats, forming channels into which the pane is slid. Alternatively, the indentations may be short in length and non-contiguous, with three or four of such indentations along the length of the slat.

The material of the pane is preferably glass, such as frosted or milky glass, however, it is made clear that this preference is in no way intended to be limiting. For example, the "pane" or panel 210 may actually be an elongated piece of some polymer such as hardened plastic, fiberglass, steel, wood, or any other relevant material. The use of glass or plastic (or the like), whether see-through, opaque or anywhere in between, allows for the aesthetic effect of light radiating out thereof from inside the space between the façades. Colors, etchings, designs and decorations can be applied to the pane/panel, where such indicia are enhanced by the back light from inside the fence (when dark).

FIG. 13A illustrates a glass pane holder 350. The holder 350 is an optional component for all three of the fence configurations described above. The holder is used to secure the glass panes or panels, when one of the other above-mentioned methods of securing the panes is not used. Glass holder 350 has a flat rectangular body 352 that is slightly longer than the height of a glass pane. One end of the piece is turned down to form a lip 354. The omega-shaped metal slats 214 (see FIG. 10(*a*)) include three apertures 348. Similar apertures are found on the omega steps 251 of the top and bottom slats as well, even though these are not visible in the drawings. To secure a glass pane between a top slat 212 and a middle 214, for example, the holder is inserted through the aperture of the top slate, from behind the slat. The straight end of the holder runs through the aperture, passes in front of the pane and enters into the corresponding aperture 348 on the top step 251 of the middle slat. At the same time, the turned-down end 354 of the holder comes to rest on the back face of the step 251 of the top slat 212. The holder rests on the step of the top slat and acts as a barrier that prevents the panes from falling out. Exemplarily, the holder is 130 mm long, 2 mm thick, and 30 mm wide.

FIG. 14 illustrates a pillar support 270. The pillar support 270 made of metal, such as galvanized steel (as is the preferred makeup of all the metal pieces described herein) is made up of two pieces which are welded together. In fact, this is the only case of welding in the entire structure, and this component is not visible from the outside. As mentioned elsewhere herein, and as relevant to all embodiments and configurations, the total or near-total lack of welding in these constructions is one of the most unique and beneficial features of the innovative structures. An alternative support component without any welding is discussed hereafter.

FIG. 14A illustrates a U-shaped support piece 272. FIG. 14B illustrates a square-shaped base piece 274. The U-shaped support piece 272 is made up of a square plate 276 which is flanked on two sides by thin, flat, elongated pieces 278 that are bent perpendicular to the plate. The elongated pieces terminate in protrusions 280. Two square-shaped screw holes 282 are formed in each of the elongated pieces 278. Holes 282 line up with corresponding square holes 284 in the pillars 202, 204, 206, and circular screw holes, which are not seen in these figures. The square and circular holes are configured to receive a specialized bolt that has a very long square neck and small portion of threads. During assembly, each carriage bolt with the elongated square neck is inserted into the square holes 284, 282, the square necks fitting into the square holes 284, 282 and 282. The circular threaded end of the bolt protrudes out of the circular screw hole (not shown). A nut is fixed onto the protruding threading, securing the bolt in place.

Base piece 274 has a square plate 286 with four large screw holes 287 formed therein. The square plate 286 is flanked on all four sides by smaller metal boundaries 288 which are bent up, perpendicular to the plate. Two of the metal boundaries 288 have indentations 289 which have a corresponding shape and size to the protrusions 280. The protrusions are welded to the indentations during assembly. The base piece 274 is secured to the ground by large diameter screws, such as concrete screws.

An alternative support component is envisioned which obviates the need for welding. The alternative support component is a single piece having basically the same structure as the pillar support 270 when welded. However, as a single piece, the workman would not be able to access the holes 287 in the base part. To solve this problem, the square plate 286 would need to have cutout holes to allow access to the screws and screw holes via a drill with an extended drill bit. Phantom indentations 277 are shown on plate 276 in the positions where cutaway holes are envisioned on the alternative support component.

Method of Assembly

The first step 290 is to lay concrete, if none present, at the location of each pillar. Thereafter, or if step 290 is not necessary, step 291 is to secure the base piece 274 to the concrete (or otherwise solid surface) with appropriate screws or bolts. Step 292 includes welding the U-shaped support 272 to the base piece 274. Thereafter, a side pillar 202, 206 is placed over the pillar support 270, lining up screw holes 282 of the pillar support with the screw holes 284 of the pillar. In step 293 the pillar is fixedly attached to the support with an appropriate screw or bold, in the manner described above. Preferably, the type of screw used is a carriage bolt (also called a coach bolt or round head square neck bolt) with an elongated square neck and short threading portion.

In steps 294 and 295, the process is repeated on the adjacent pillar and the slats 212, 214 and 216 of sheet metal (or galvanized steel) are installed in the openings of the side pillar and the middle pillar. The glass panes or panels 210 are installed in step 296. In optional step 297, water pipes and/or lights and cables are installed in the space between the front and back faces. In step 298, the cover piece 218 is secured over the opening between the façades. In step 299, the flower pot is assembled and installed on top of the pillar. The aforementioned steps are repeated as relevant for the next pillar. To scale up the fence in length, additional middle pillars 204 are added, repeating the steps for each pillar. It is made clear that while the steps have been presented in a specific order, one skilled in the art may group various steps together, or in a different order to that presented. Other "tricks of the trade" may be employed as well. It may be preferred to perform the same step for multiple pillars/posts and slat/panel sections before moving on to a subsequent step.

Fence II

Another possible configuration of the innovative pillars is shown in FIGS. 15-19. All components of fence 200 are the same as those of the instantly described variation, aside for the differences described specifically below. Therefore, any element or description that is lacking from the components described below is understood to be imported from the description of fence 200 above, mutatis mutandis, as if fully set forth herein. The aforementioned notwithstanding, where mentioned specifically, it is understood that components described below can be substituted with components described above. For example, the pillars described below can be covered on the top with a cover as described below or with the flower pot described with reference to fence 200.

Figures 15, 16:
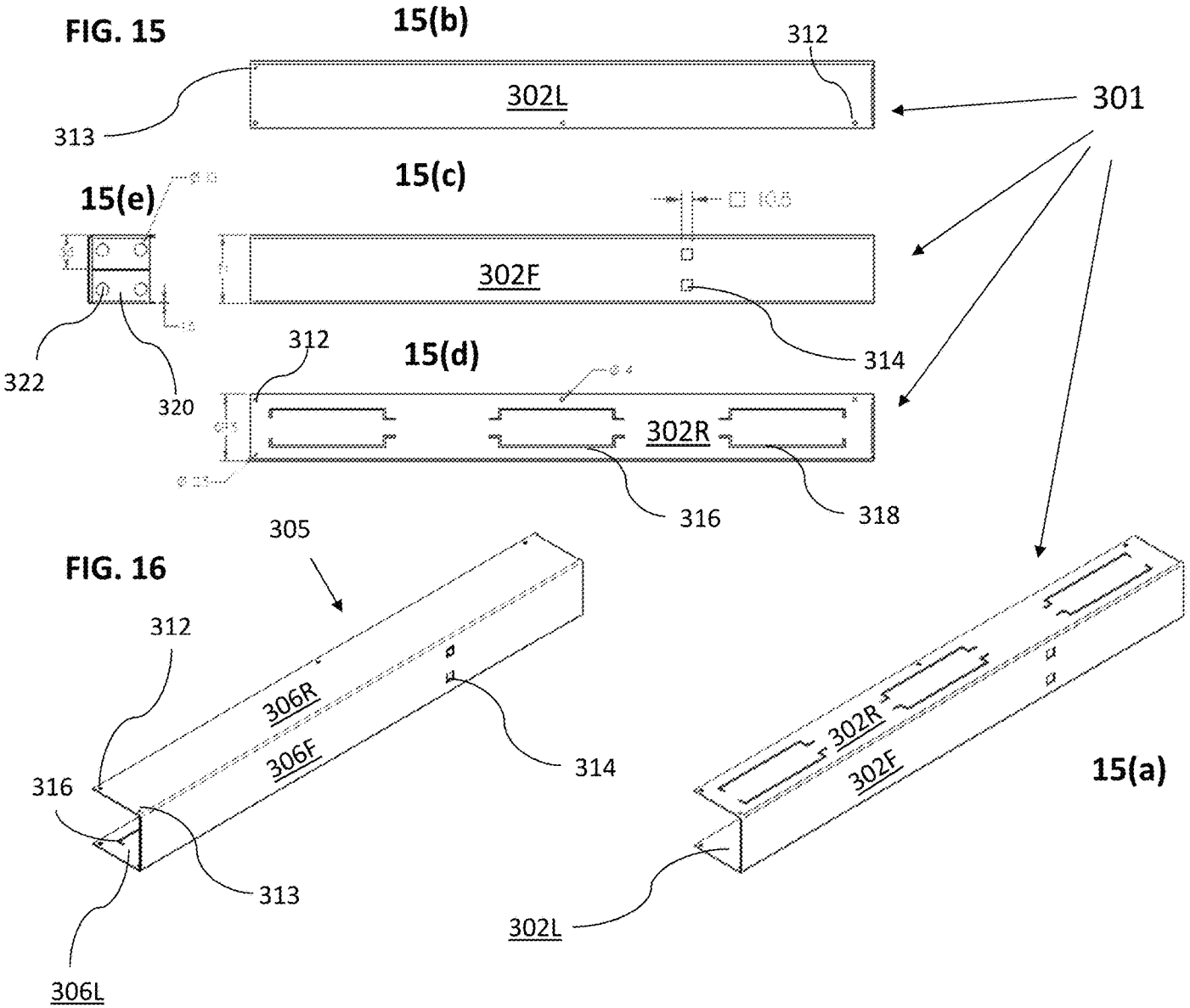
FIG. 15-19 illustrate components of a second embodiment of a fence.

FIG. 15 illustrates various views of a three sided profile piece 301, which is one component of a left hand side pillar 302. Pillar 302 is a variation of left hand side pillar 202 of fence 200. The second component is the back face cover piece discussed below. While the assembled pillar is not shown, each face of the pillar is referenced 302 with face direction denoted with the directional capital letter F, B, L or R appended to the reference number. FIG. 15(*a*) is an isometric view of profile piece 301. FIG. 15(*b*) is a left hand side view of the profile piece 301, showing face 302L. The left hand face 302L of the left hand pillar is devoid of apertures aside from three screw holes 312 along the edge of the length and a fourth screw hole 313 in the top left corner. The left hand side pillar 302 is the left hand peripheral post or pillar of the fence from the perspective of one standing outside the boundary formed by the fence.

FIG. 15(*c*) is front view of profile piece 301, showing the front or outer face 302F. The outer face 302F of the pillar or post 302 is the face that is viewed from outside the boundary formed by the fence. The outer face includes two square-shaped screw holes 314. The square screw holes are adapted to receive round head, square necked bolts, also called carriage bolts (as described above). The screw holes 314 are disposed side by side (as opposed to one on top of the other, in the pillars of fence 200). It is understood that the pillar support (not shown) for pillar 302 is similar to U-shaped support piece 272 described above or similar support arrangement. That is to say that the pillar support has a square plate (not shown, although similar to square plate 276) and two perpendicular thin, flat, elongated pieces (not shown). However, whereas support piece 272 has thin, flat, elongated pieces 278, here, the elongated pieces are the same width as the square plate. The elongated pieces include square openings in positions parallel to square screw holes 314, when installed. The distal edges of the elongated pieces are welded to the square base of the pillar (discussed below), during installation.

FIG. 15(*d*) is a right hand side view of the profile piece 301, showing the right hand face 302R. The right face 302R of the pillar or post 302 is populated by apertures through which the metal slats are inserted. Apertures 316 are omega-shaped apertures for receiving middle slats 214. Apertures 318 are partial omega-shaped openings for receiving top and bottom slats 212, 216. Three screw holes 312 are disposed along the edge of the face.

FIG. 15(*e*) is a top-down view of the profile piece 301, showing a base 320 of the pillar. The base 320 is a square plate with four large screw holes 322 formed therein. The pillar is attached to a solid surface by large diameter screws, such as concrete screws.

After the pillar is attached to the surface, the pillar support (not shown) detailed above is welded onto the base 320. A back face cover piece (see FIG. 18 below) is then screwed into place at screw holes 312 and carriage bolts installed at square screw holes 314 and secured with nuts.

FIG. 16 is an isometric view of a three sided profile piece 305 of a right hand side pillar 306. As with the left pillar 302, pillar 306 is a variation of right hand side pillar 206 of fence 200. Profile piece 305 is one component of pillar 306, the second component being a back face cover piece discussed below. While the assembled pillar is not shown, each face of the pillar is referenced 306 with face direction denoted with the directional capital letter F, B, L or R appended to the reference number. The right hand side pillar 306 is the right hand peripheral post or pillar of the fence from the perspective of one outside the boundary formed by the fence.

The right hand face 306R of the pillar is devoid of apertures aside from three screw holes 312 and a fourth screw hole 313. The outer face or front face 306F of the pillar or post 306 is the face that is viewed from outside the boundary formed by the fence. The outer face includes two square-shaped screw holes 314 (as described above). The left face 306L of the pillar or post 306 (only partially visible) is populated by apertures 316 through which the metal slats are inserted. Profile piece 305 is the mirror image of profile piece 301, and includes all details and elements of profile piece 301, mutatis mutandis, as if fully set forth herein.

Figure 17:
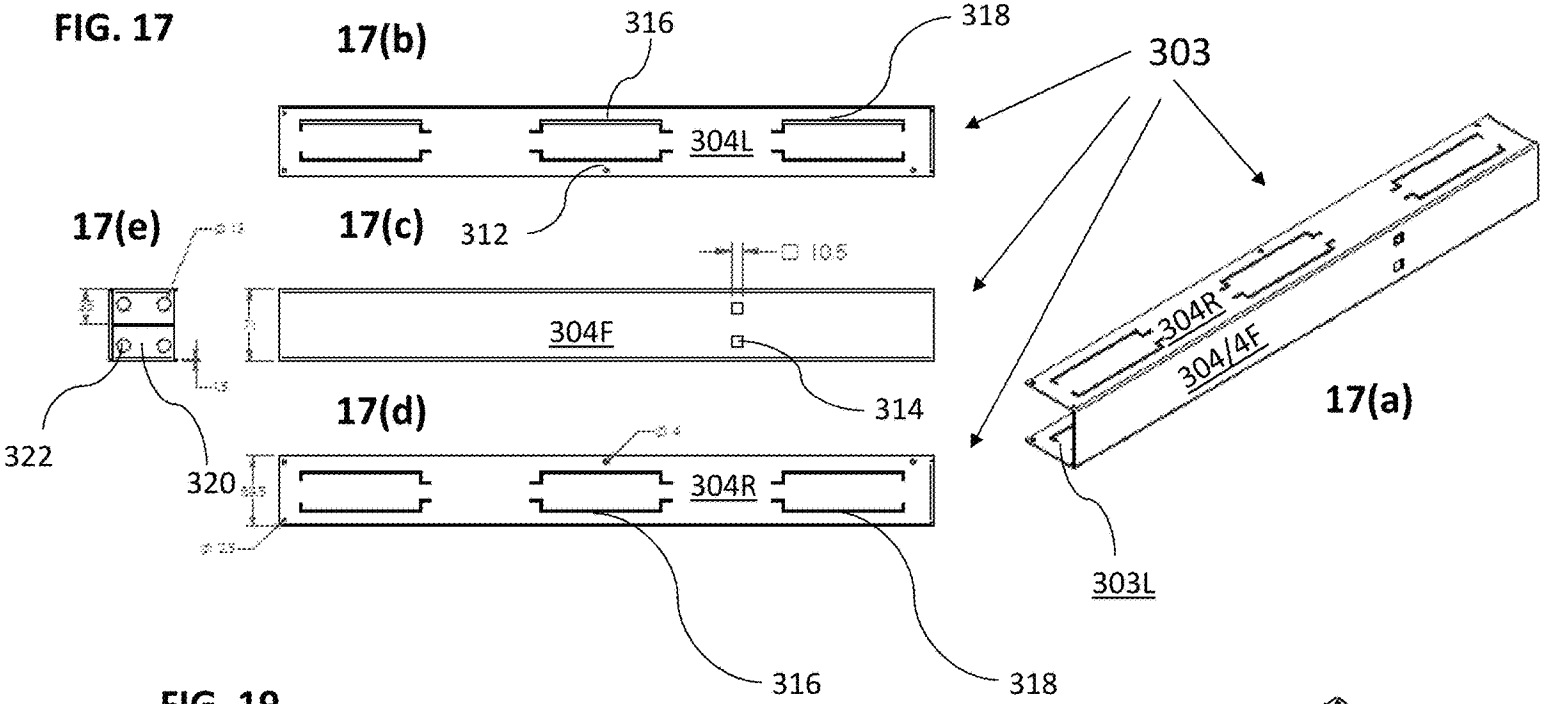

FIG. 17 illustrates various views of a three sided profile piece 303, which is one component of a middle pillar 304. Middle pillar/post 304 is a variation of middle pillar 204.

The second component is the back face cover piece discussed below. FIG. 17(*a*) is an isometric view of profile piece 303. While the assembled pillar is not shown, each face of the pillar is referenced 304 with face direction denoted with the directional capital letter F, B, L or R appended to the reference number. As with fence 200 described above, the instant fence can be lengthened by adding additional middle pillars 304 and corresponding sections of slats and panels/panes.

FIG. 17(*b*) is a left hand side view of the profile piece 303, showing face 304L. The left hand face 304L of the middle pillar is populated by apertures through which the metal slats are inserted. Apertures 316 are omega-shaped apertures for receiving middle slats 214. Apertures 318 are partial omega-shaped openings for receiving top and bottom slats 212, 216. Three screw holes 312 are disposed along the edge of the face.

FIG. 17(*c*) is front view of profile piece 303, showing the front or outer face 304F. The front/outer face 304F of the pillar or post 304 is the face that is viewed from outside the boundary formed by the fence. The outer face includes two square-shaped screw holes 314. The square screw holes are adapted to receive round head, square necked bolts, also called carriage bolts (as described above). The pillar support has been discussed above.

FIG. 17(*d*) is a right hand side view of the profile piece 303, showing the right hand face 304R. The right face 304R of the pillar or post 304, like the left hand face 304L, is populated by apertures through which the metal slats are inserted. Apertures 316 are omega-shaped apertures for receiving middle slats 214. Apertures 318 are partial omega-shaped openings for receiving top and bottom slats 212, 216. Three screw holes 312 are disposed along the edge of the face.

FIG. 17(*e*) is a top-down view of the profile piece 303, showing a base 320 of the pillar. The base 320 is a square plate with four large screw holes 322 formed therein. The pillar is attached to a solid surface by large diameter screws, such as concrete screws.

Figure 18:
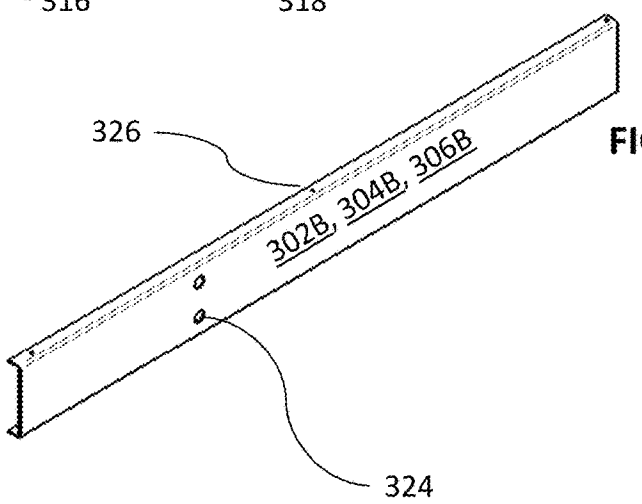

FIG. 18 is an isometric view of back face cover piece 302B, 304B, 306B of left, middle and right pillars 302, 304, 306. The cover piece is formed of a central panel and lips on either side of the central panel. The lips lie perpendicular to the central panel. The cover piece has two circular screw holes 324 formed therein. Screw holes 324 line up with square holes 314, and are adapted to received the threaded ends of the carriage bolts, so that nuts can be fastened onto the threaded ends.

The cover piece 302B, 304B, 306B further includes three small screw holes 326 on each of the lips that lie perpendicular to the central panel of the piece. For each of the pillars, the cover piece is positioned within the open side of the profile pieces 301, 303, 305, such that screw holes 326 line up with corresponding screw holes 312. The cover pieces are fixedly attached to the profile piece with six small screws.

Exemplarily, the front face of the pillar is 71 mm in width; the width of the cover piece is 67.5 mm. Considering the thickness of the profile and the lips of the cover piece (e.g. 1.5 mm), the cover piece fits snugly inside the open face of the profile piece.

Figure 19:
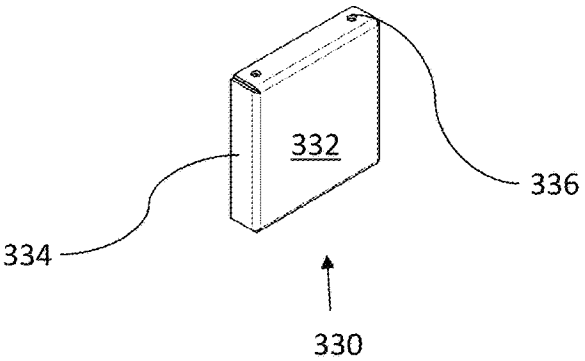

FIG. 19 is an isometric view of a pillar lid 330. The pillar lid is a square top cover for the pillars of the fence. The lid 330 can be substituted with the flower pot 208 of fence 200 and vice versa. The lid is square in shape with a central square portion 332 and four turned-down sides 334 that lie perpendicular to the central square portion. Two of the turned-down sides 334 each have a pair of screw holes 336 for securing the lid to the top of the pillar. The screw holes 336 line up with the top most screw hole 312 and screw hole 313. A such, two of the four screw couple the lid, profile piece and cover piece together while the other two only couple the lid to the profile piece.

In summary, Pillar 302 is comprised of profile piece 301, back face cover piece 302B, and lid 330; Pillar 304 is comprised of profile piece 303, back face cover piece 304B, and lid 330; and Pillar 306 is comprised of profile piece 305, back face cover piece 306B, and lid 330. The pillars are secured in place by pillar supports (not shown for this variation, but similar to support piece 270).

Fence III

Figure 20C:
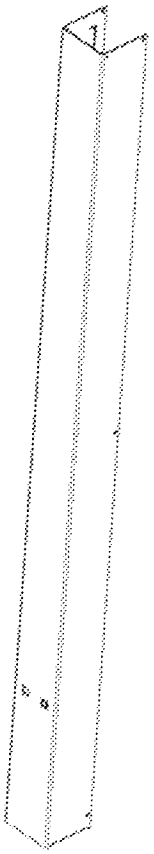
FIG. 20A-C illustrate a variation of the second embodiment.
Figure 20B:
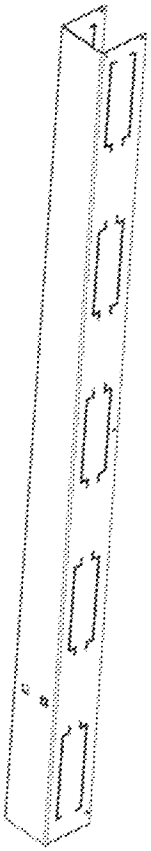
Figure 20A:
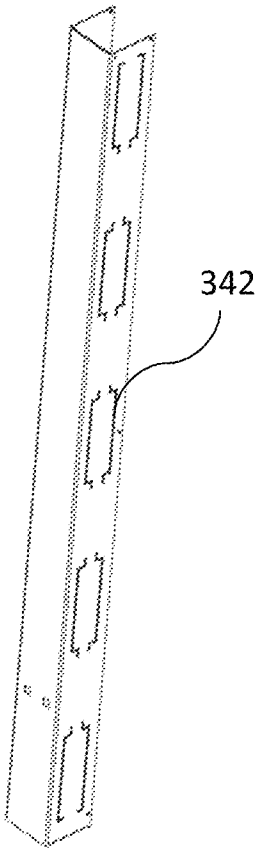

Yet another configuration of the pillars is shown in FIGS. 20A, 20B and 20C. FIGS. 20A, 20B and 20C illustrate three profile pieces of respective left hand, middle and right hand pillars of the innovative fence, according to another embodiment. FIG. 20A illustrates a three-sided profile piece 340 of a left-hand pillar. The left-hand profile piece 340 has all the same features, elements and characteristics of profile piece 301, with the exception of that which is detailed immediately here-below. Likewise, the middle and right-hand profile pieces are comparable to the middle and right-hand profile pieces 303 and 305 respectively. As such, it is considered as if all the details for those pieces are fully set forth herein relative to the instant profile pieces, mutatis mutandis.

Profile piece 340 differs from profile pieces 301 in that profile piece 340 includes three pairs of omega-shaped apertures 342, whereas profile piece 301 only has one pair of omega-shaped apertures. Accordingly, the instantly detailed pillar and fence are higher than those of the previously described configurations. Obviously, the completed fence includes additional metal slats and panes or panels, corresponding to the number and configurations of the apertures. Corresponding features are found in middle profile piece 344 shown in FIG. 20B and right-hand profile piece 346, shown in FIG. 20C.

Still another pillar configuration is FIGS. 21A to 21E. The instant set of pillars is made up of corner pillars and middle pillars as with the previous configurations. Each of the instant pillars is made up of two pieces length-wise pieces (similar to the previous configuration) and a base. FIG. 21A depicts one side 360 of the two sides that make up the middle pillar. The two sides are assembled together around a base support which is installed prior to assembly. FIG. 21B depicts base support 362. Another feature unique to the instant configurations is the keyhole screw mounting openings 364 and 366. The keyhole openings 364 on the middle pillar are split exactly in half, so that the keyhole opening is formed when the two sides are brought together around the installed base. The keyhole openings 366 on the base support are located on the vertical arms, which are similar, mutatis mutandis, to elongated pieces 278. All the details described with regards to the pillar support 270, are relevant, mutatis mutandis, to the instant base support. Furthermore, the envisioned modification which obviates the need for welding, discussed above, can be applied equally here.

The two side pieces 360 are screwed together via screw holes 365 on the lips of the side pieces. The keyhole openings 364 and 366 are lined up parallel to each other. A screw (not shown) is inserted head first into the bore of the keyhole openings 364 and 366 and then slid to one side. The threaded end of the screw is the fastened with a nut to secure the pillar to the base support. A second screw can be inserted in the same manner into the same bore of the same opening and slid to the opposite side and fastened in place in the same manner. The second screw is optional. The action is repeated for all the openings.

FIG. 21C depicts one of the two parts of the corner pillar. Corner part 370 has two full flat sides at right angles with each other and two partial sides perpendicular, one perpendicular to each of the full flat sides.

FIG. 21D depicts the closed part of the corner piece. Closing part 372 fits together with corner part 370, both of which are assembled around a square base 374. FIG. 21E depicts square base 374. Square base 374 has four vertical sides, a bottom surface (not shown) with four holes for concrete screws and an open top (to allow access for a workman to install the screws into the four holes. Two keyhole openings 376 are located on each vertical side, off-center. The keyhole openings in the square base correspond to, and are arranged parallel to, keyhole openings 378 that are formed in the lower section of the corner pillar when the corner and closing parts are assembled together. The closing and corner parts are fastened together with screws via screw holes 375. Installation of the corner pillar is similar to that of the middle pillar. The remaining elements of the fence are similar, mutatis mutandis, to the fence configurations detailed above and are installed in a similar fashion as would be clear to one skilled in the art.

Housing Structure

Figure 22:
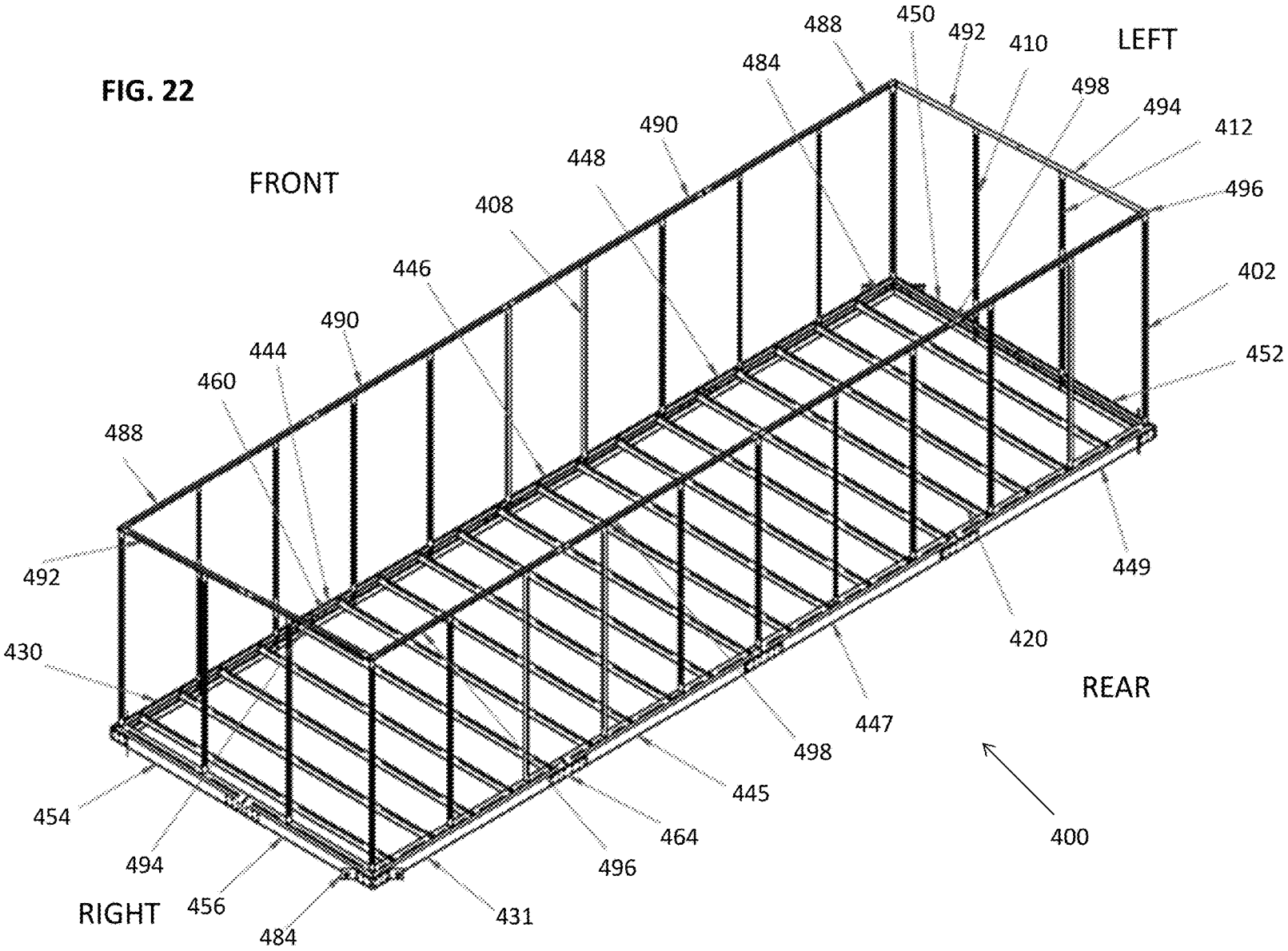

FIG. 22 illustrates an isometric top view of a framework of a housing structure 400 which serves as the frame of a small housing unit. As with the structures above, the various pieces described below are metal and preferably galvanized steel. The components are laser cut to specification and ready for assembly. No welding is involved. The unit can be scaled up or down as desired, by using more or less pieces as will be mentioned below. There are 34 different items (types), where the quantity differs from item to item. The screws, bolts and nuts are not included in the aforementioned.

The terms 'front' and 'rear' are relative terms, nonetheless these terms are used herein to distinguish between similar components based on their respective position in the drawings. Importantly, the rear end of the structure is closer to the viewer while the front end of the structure is further from the viewer. Importantly, the rear of the structure is higher than the front of the structure so that a roof (not shown) will be at a slant, where the angle declines towards the front of the structure (e.g. rain would therefore run down the front of the structure).

The terms 'right' and 'left' are also relative terms, but are to be understood, with respect to housing structure 400, to be from the perspective of the viewer of the figure. I.e. the right hand side is on the right side of the page and the left hand side is on the left of the page.

Figure 23:
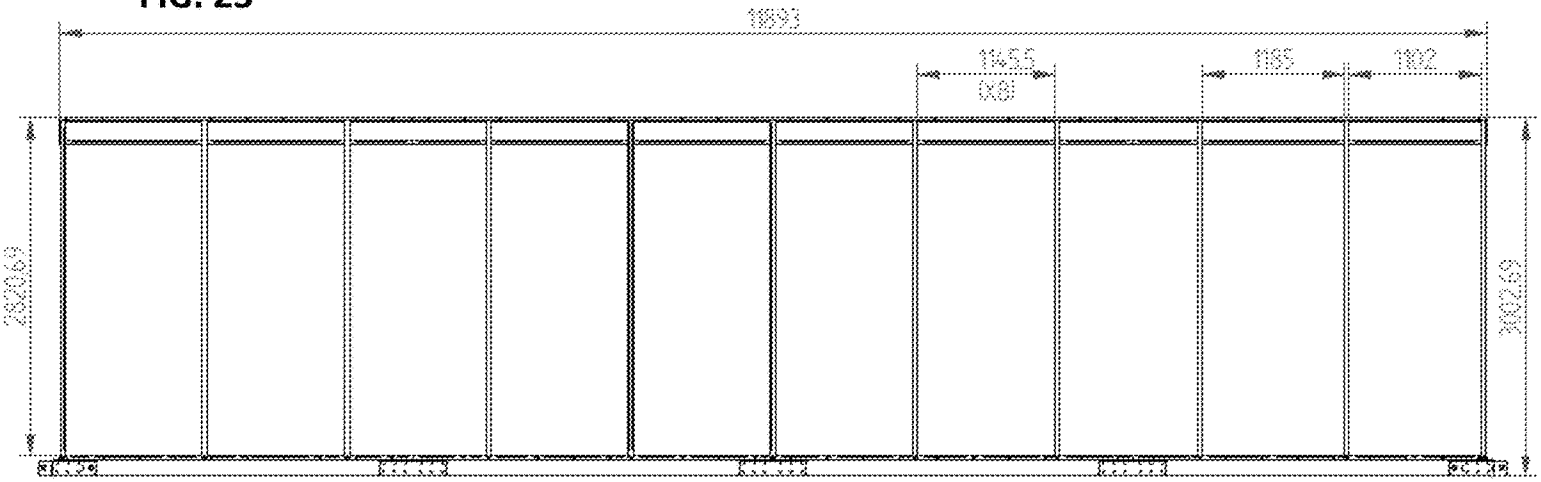
Figure 24:
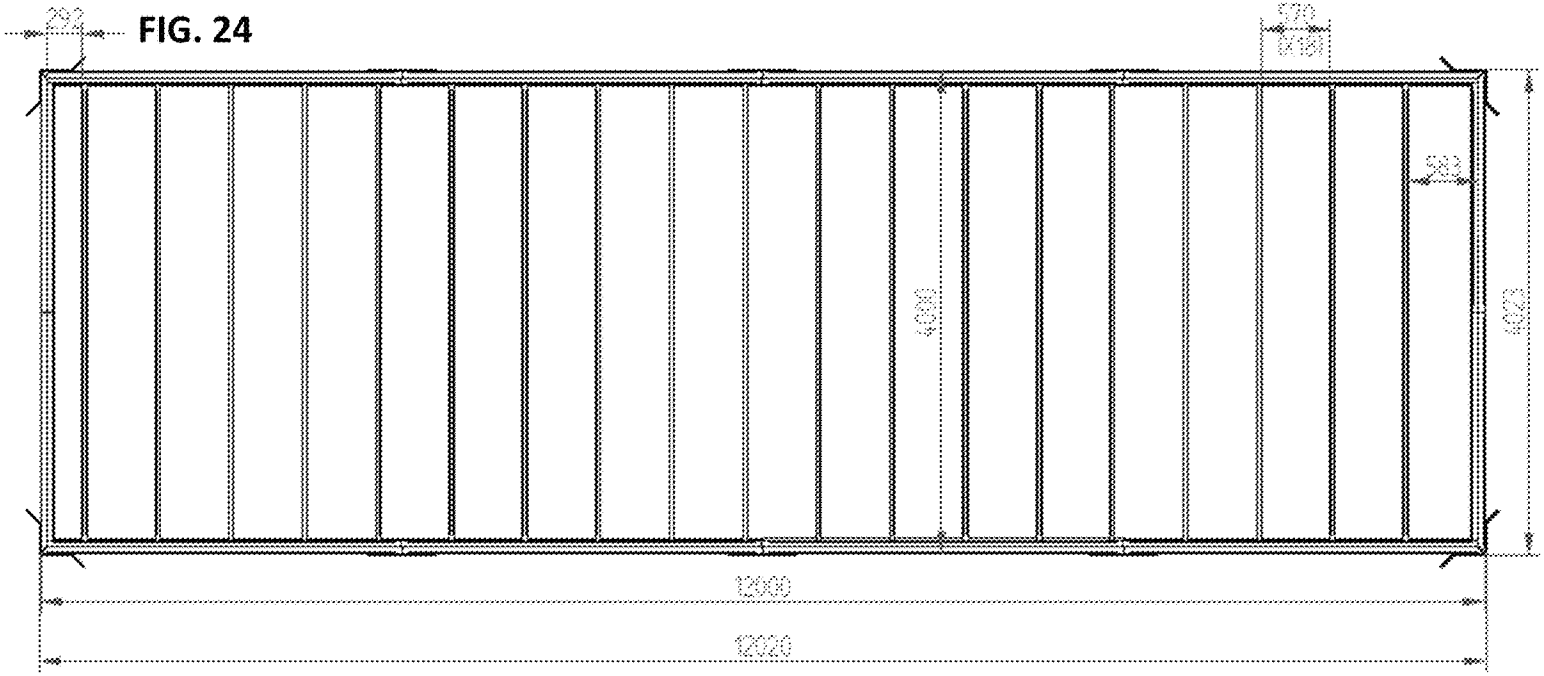

FIG. 23 illustrates a front view of the structure 400, including exemplary dimensions in millimeters. FIG. 24 illustrates a top view of structure 400. The height differences between the front and rear rods are evident in FIG. 23. The exemplary structure 400 is comprised of eleven (11) front rods 408, eleven (11) rear rods 402 and four (4) side rods. Of the side rods, there are two side-front rods 410 (one on each side) and two side-rear rods 412.

Figures 25, 26:
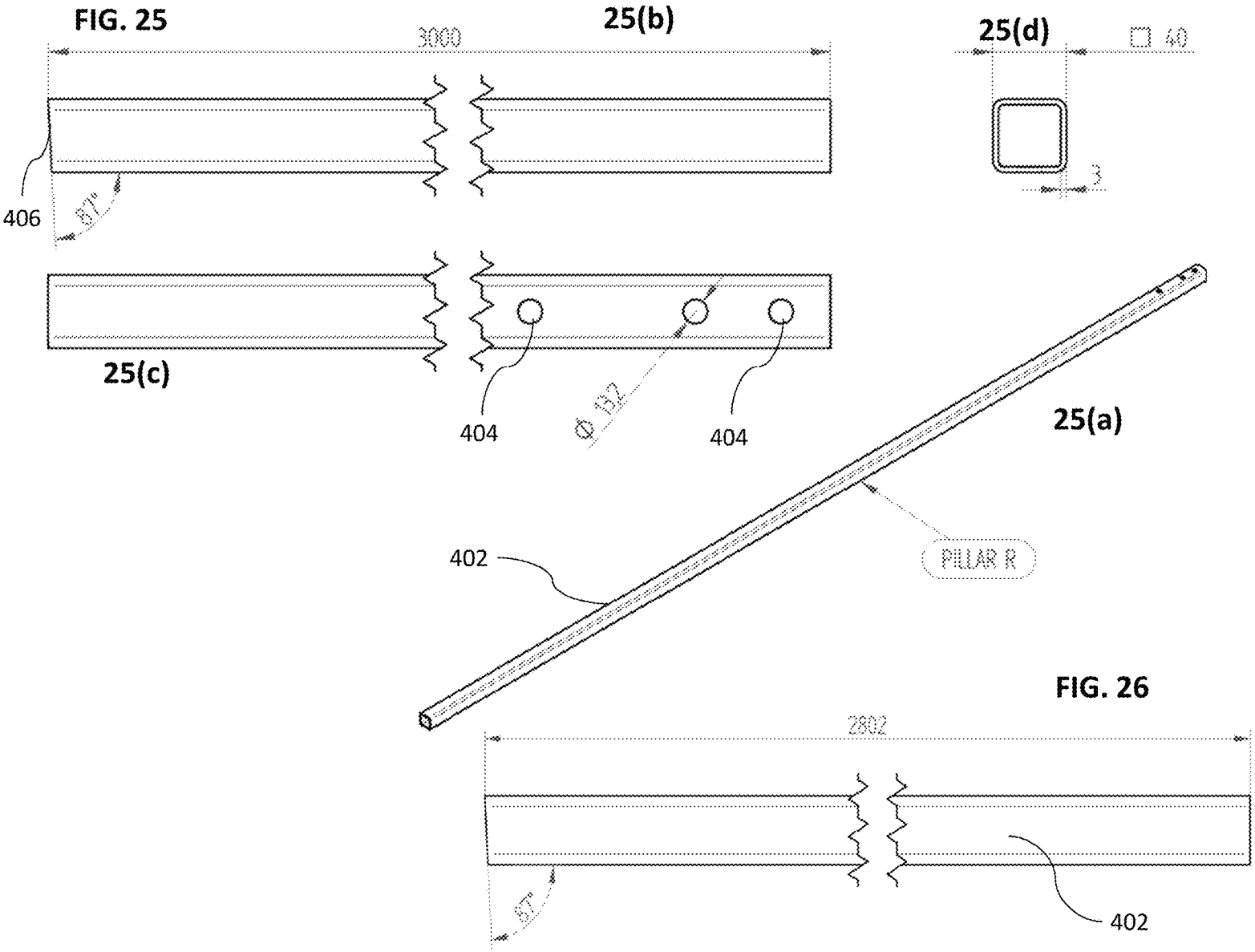

FIG. 25 illustrates various views of a rear rod 402. All of the rods 402 are adapted to be vertically oriented, have a square cross-section and are hollow. In the exemplary embodiment, each of the eleven rear rods is 3000 mm (3 meters) in length (i.e. stands 3 meters high) with each face of the rod having a width of 40 mm. FIG. 25(*a*) is an isometric view of the rear rod 402. FIG. 25(*b*) is a view of rear rod 402 from the side and FIG. 25(*c*) is a view of the rod from the front. FIG. 25(*d*) is a top-down view of the square rod (which is also a view of the cross-section of the rod).

The bottom end of the rod has three screw holes 404 and the top edge 406 of the rod is beveled. The bevel is best seen in FIG. 25(*b*), where it is shown that head of rod is slightly angled (a 3° slant from the straight). In the exemplary structure, the rear rods are 3 meters high while the front rods are only 2.8 meters high (see below). The gradual 3° angle off the straight provides a slight slope (dropping approximately 200 mm over an almost 4 meter stretch) for a roof (not shown) that will be installed over the frame. The roof is not within the scope of the instant structure, however the top side profile pieces lay on top of the side pieces. The top side pieces are discussed below.

FIG. 26 is a side view of a front rod 408. The front rod has the exact same characteristics and components as the rear rod 402, with the exception of the length/height of the rod. The front rod is 2802 mm high. There are eleven front rods, as mentioned above. The front rods are in line with the rear rods 402.

Figure 27:
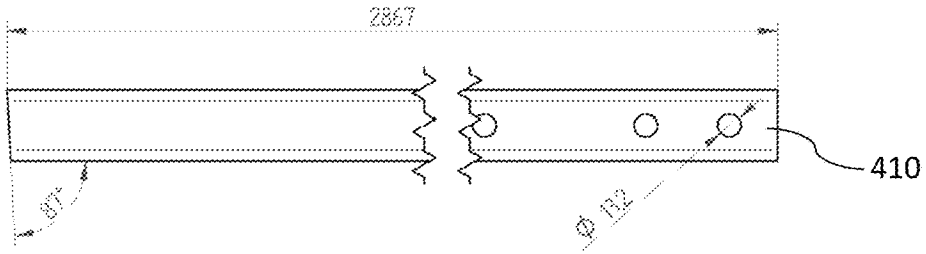

FIG. 27 is a side view of a side-front rod 410. There are two side-front rods, one of each side of the structure. The side-front rods have similar characteristics and components to the front and rear rods, except that for each side-front rod 410 the screw holes 404 are on the side face of the rod and not on the front face of the rod. Another difference is the length/height of each of the two side-front rods, which is 2867 mm.

Figure 28:
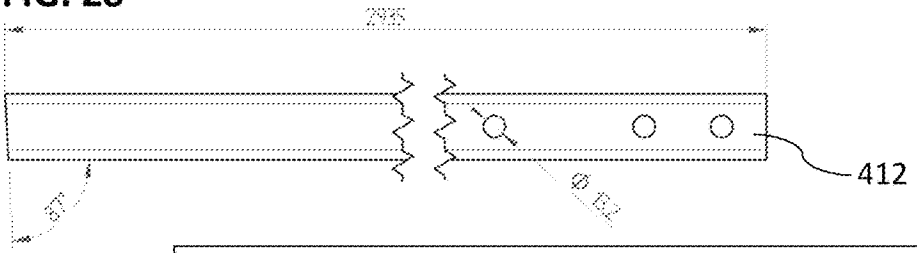

FIG. 28 is a side view of a side-rear rod 412. There are two side-rear rods, one of each side of the structure. The side-rear rods have similar characteristics and components to the side-front rods, except that the length/height of each of the two side-rear rods is 2935 mm.

Figure 29:
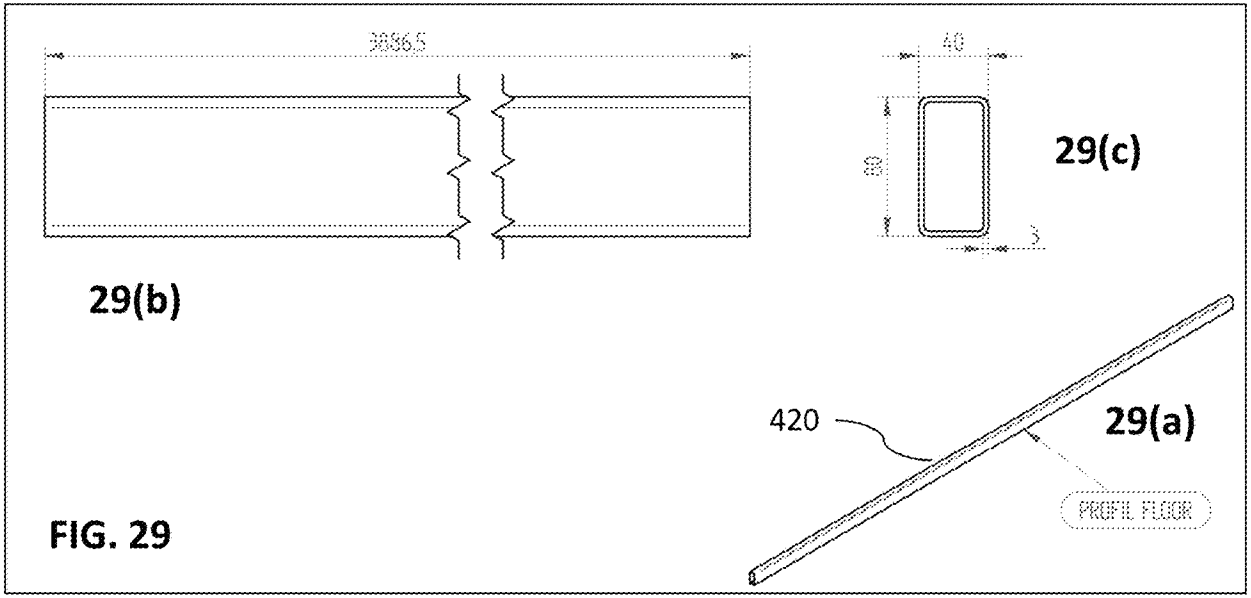

FIG. 29 illustrates various views of a floor profile 420. FIG. 29(*a*) is an isometric view of the profile. FIG. 29(*b*) is a side view of the profile and FIG. 29(*c*) is a front view of the profile (which is also a cross-sectional view). The floor profile has a rectangular cross-section and is an elongated rectangular steel tube. In the exemplary structure, the floor profile is 3886.5 mm long. The profile has a width of 40 mm and a height of 80 mm. Nineteen profiles 420 make up the floor of the frame 400.

The bottom frame of structure 400 is made up of four (4) length-wise profiles in the front (left front, middle left front, middle right front and right front, abbreviated as: length LF, MLF, MRF, RF) and four in the rear (left rear, middle left rear, middle right rear and right rear, abbreviated as: length LR, MLR, MRR, RR) as well as two widthwise profiles on either side. The front and rear profiles are laid parallel to each other and perpendicular (on the X-axis or horizontal plane) to the floor profiles fitted between them. Each front profile has a similar, corresponding, rear profile. There are two (2) width-wise profiles on each side of the structure (right front, right rear, left front and left rear, abbreviated: width RL, RR, LF, LR). The width-wise profiles are identical to each other.

Figure 30:
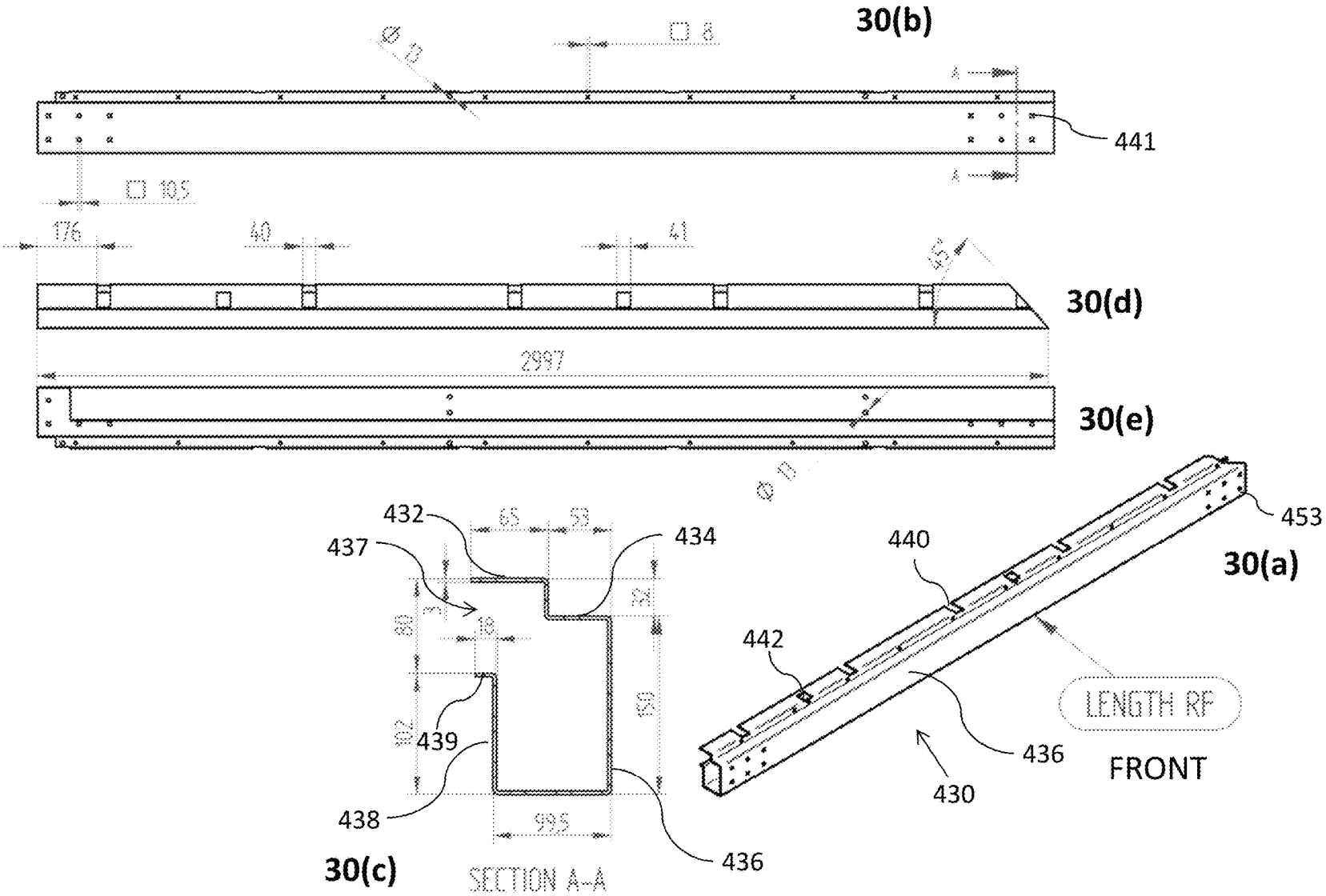

FIG. 30 illustrates various views of a bottom, right-most front profile (hereafter 'length RF', the abbreviation of "right front") 430. FIG. 30(*a*) is a front, isometric view of the profile. FIG. 30(*b*) is a front view of the profile. FIG. 30(*c*) is a cross-sectional view of Section A-A of length RF 430 depicted in FIG. 30(*b*). FIG. 30(*d*) is a top-down view of length RF 430. From this view, it is clear to discern that the right-hand end of the length RF is beveled at 45° where is fits into the front-right corner of the base of the structure (see FIG. 22). FIG. 30(*e*) is a bottom-up view of length RF 430.

Looking at FIG. 30(*c*) a view is presented with the cross-section A-A. Describing the various contours of the cross-section going from the top and moving clock-wise, the viewer will discern a shelf 432 at the top of the profile, then a step down 434 (comprised of a vertical part and a horizontal part) before the profile turns at a right angle to define the right side 436 of the cross-sectional view. The right side 436 is actually the front face of the profile that is best seen in FIGS. 30(*a*) and 30(*b*). Continuing with the clock-wise description, the next side at right angles with the right side (front face 436) is the bottom side of the profile piece. At right angles with the bottom side is the left side of the profile piece which is the inner face 438 of the piece. The inner face extends from the bottom side to an opening 437 at which point the left side bends slightly to the left (at a 90°) to form a short ledge 439.

As seen best in FIG. 30(*a*), there are four openings 440 in the shelf 432 with three closed-in sides and a fourth open side. The open side faces towards the rear side of the structure. The openings 440 are configured to receive the floor profiles 420. Exemplarily, the width of each opening 440 is 40 mm as shown in FIG. 30(*d*). This is the width of the floor profile 420. The height of opening 437, from ledge 439 to shelf 432 is 80 mm which is the height of the floor profile. The depth of the shelf 432 is 65 mm. Therefore, the profile extends approximately 65 mm into the body of the length RF, with the bottom of the floor profile 420 resting on the ledge 439. The vertical part of step 434 prevents the floor profile from moving further into the inner volume of length RF 430.

In addition to the openings 440, there are two square-shaped openings 442 in the shelf 432 of the length RF. The square openings 442 are adapted to receive vertical rods 408. The rods enter the openings in shelf 432 and come to rest inside the volume of length RF 430, on the bottom side.

As detailed above, there are four bottom front pieces. The middle two pieces length MRF 444 and length MLF 446 have essentially the same structure as the length RF, with the difference being that the edges/ends of the pieces are not angled (like the right-hand side of FIG. 30(*a*), (*d*)) but are rather straight (like the left-hand side of the FIG. 30(*a*)). The left front piece length LF 448 is basically the mirror image of length RF 430 (the positions of the openings may not be exactly aligned), where the angled end is adapted to fit in the front left corner. Length RR 431 is a mirror image of Length RF 430. Length LR 449 is a mirror image of length LF 448. Length MRR 445 mirrors Length MRF 444 and Length MLR 447 mirrors Length MLF 446.

Figures 31, 32A, 32B, 33:
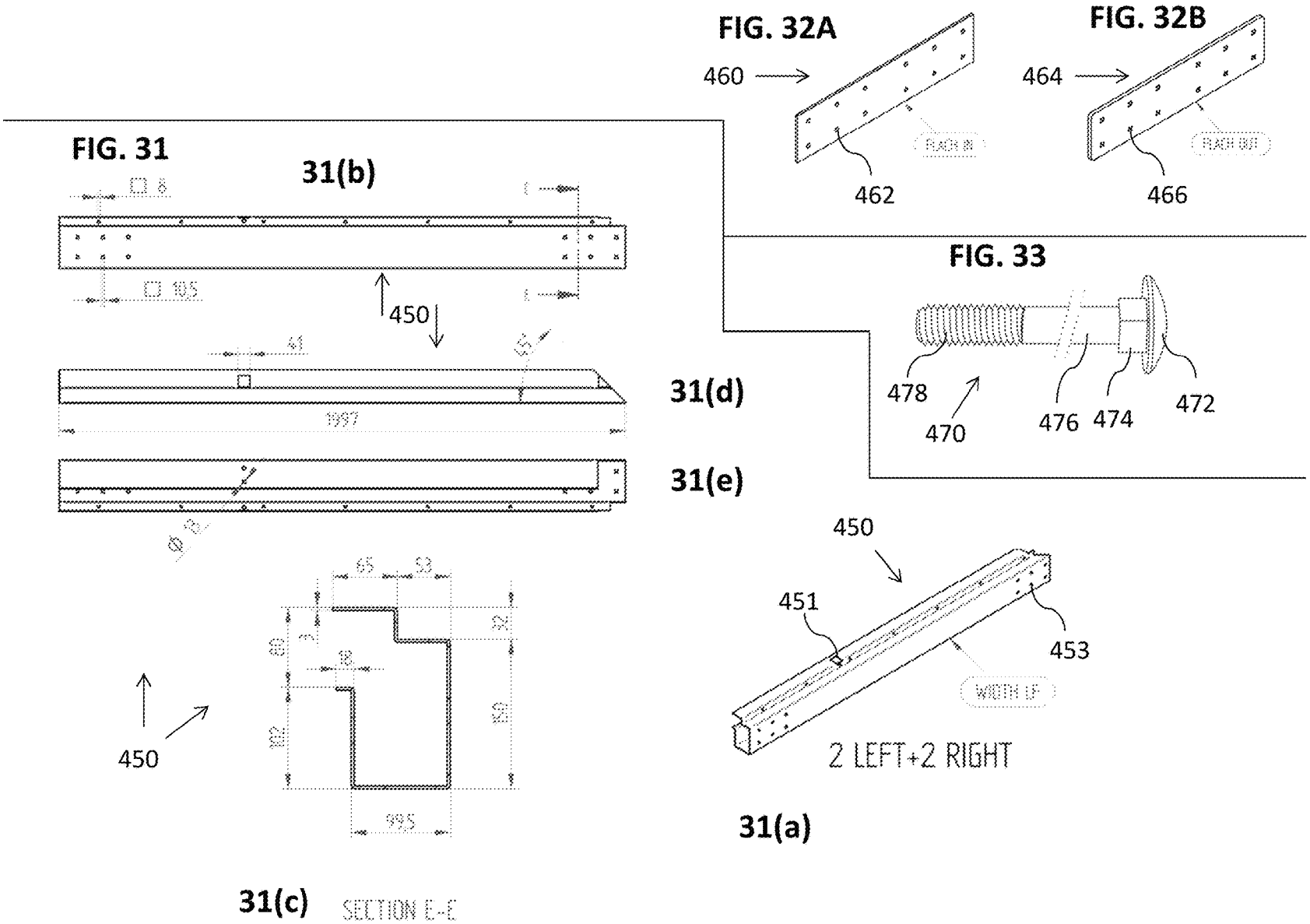

FIG. 31 illustrates various views of a bottom, left side, front width (hereafter 'width LF', the abbreviation of "left front") 450. FIG. 31(*a*) is a front, isometric view of width LF. FIG. 31(*b*) is a side view of the profile. FIG. 31(*c*) is a cross-sectional view of Section E-E of width LF 450 depicted in FIG. 31(*b*). FIG. 31(*d*) is a top-down view of width LF 450. From this view, it is clear to discern that the right-hand end of the width LF is beveled at 45° where is fits into the front-left corner of the base of the structure (see FIG. 22)—abutting length LF 448. FIG. 30(*e*) is a bottom-up view of width LF 450. A square-shaped opening 451 is adapted to receive side-front rod 410.

Each side of the structure has two width-wise profiles. Width LF 450 is the left front width, width LR 452 is the left rear width, width RF 454 is the right front width and width RR 456 is the right rear width-wise profile. Each piece has one straight edge/end and one angled end which is adapted, mutatis mutandis, to fit into a respective corner.

FIG. 32A is an isometric view of an inside connector plate 460. FIG. 32B is an isometric view of an outside connector plate 464. The inside plate is rectangular in shape and has twelve circular holes 462 therein. Outside plate 464 is also rectangular in shape and has twelve corresponding square holes 466. The holes on each of the pieces line up with each other and also line up with six holes on the end of one profile piece and six holes on the adjacent end of a second profile piece, placed between the plates (see hereafter).

The plates are used to couple two abutting bottom profile pieces together (e.g. length RF and length MRF). The plates are placed on each side of bottom profile pieces, where two pieces meet/abut one another. The inside plate 460, is placed within the volume of the profile pieces and the outside plate is positioned on the outer faces of the profiles (e.g. front face 436 of length RF 430 and the front face of the length MRF) lined up with the square holes 441. Each bottom profile piece has a grouping of six square holes 441 on each end of the profile piece. The circular 462 and square holes 466 line up with the square holes 441 of the profile pieces. A fastener, preferably a carriage bolt 470 (shown in FIG. 33) is inserted through the square hole of the outside plate, the square hole of the front face of the profile and the circular hole of the inside plate. A nut is screwed onto the threaded end of the carriage bolt.

As mentioned heretofore, FIG. 33 is a side view of a mushroom head, square neck bold 470. This type of bolt has been discussed above with relation to various embodiments discussed heretofore. The bolt, also known as a carriage bolt, has a cup or mushroom-shaped head 472 with no drive on the head. The entire shank or part of the shank in square in shape, this part is referred to as the square neck 474 or simply neck. In the depicted, exemplary bolt, there is a square neck 474 and a cylindrical shank 476. The thread 478 extends from the shank to distal edge of the bolt. In the aforementioned embodiments, the square neck of the bolt fits in the square holes while the thread of the bolt fits through the circular holes. The square neck depicted in the Figure is relatively short, however, the square neck may be or any length and may be longer than the circular, threaded section 478. The shank may be very short or there may be no shank at all.

Figures 34, 35:
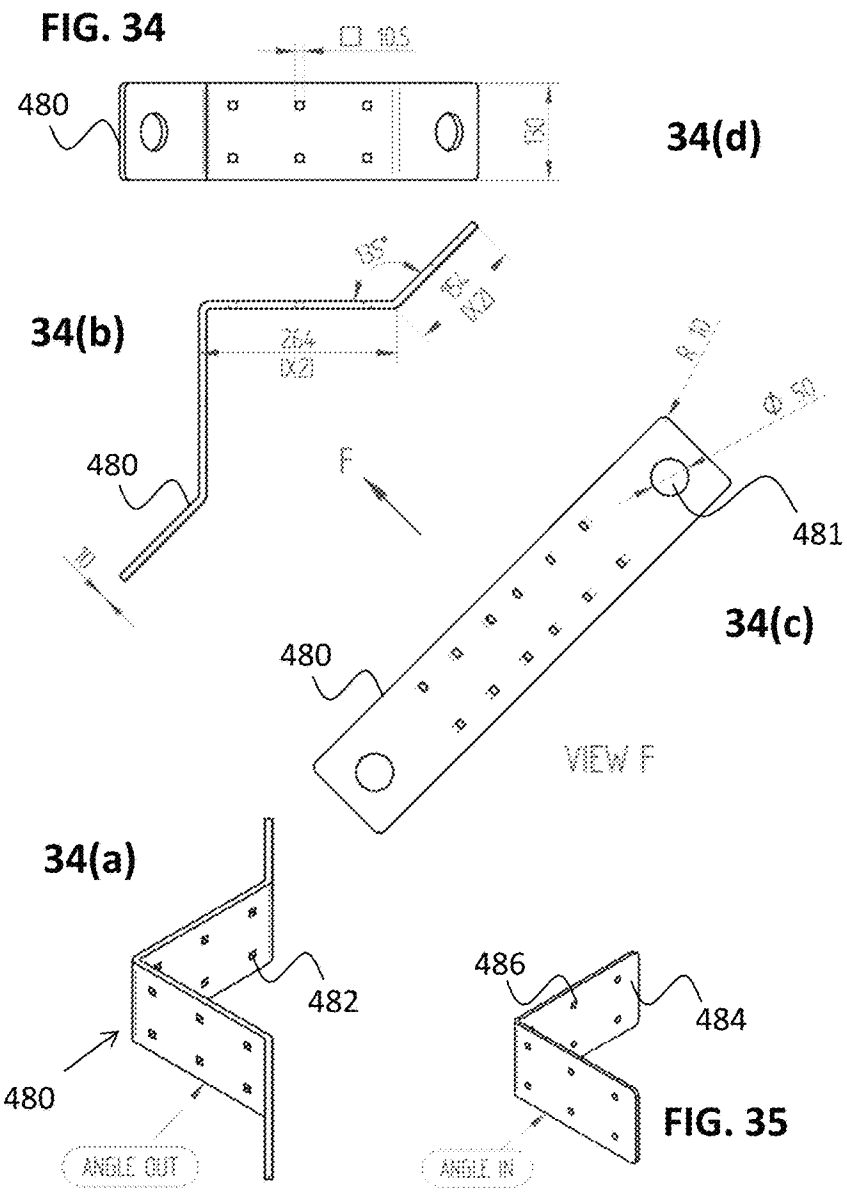

FIG. 34 depicts various views of a corner fastener (hereafter 'Angle Out' or simply 'angle') 480. There are four angle pieces 480, one on each corner of the structure, at the base of the structure. Angle 480 is a wide flat elongated piece of metal piece bent at different angles and populated with twelve square holes 482. The midpoint of the piece is bent at a 90° angle. The ends of the piece are further bent at an angle of 135°. FIG. 34(*a*) is an isometric view of the angle. FIG. 34(*b*) is a top view of the angle. FIG. 34(*c*) is an inside view (View F) of the angle. FIG. 34(*d*) is a side view of the angle.

The angles 480 are assembled to the structure with carriage bolts. Taking the front right corner as an example, length RF 430 makes a 90° angle with width RF 454. Angle out 480 fits around the outside of the front right corner. The square holes 482 line up with square holes 453 of width RF 454 and length RF 430.

FIG. 35 depicts the internal corner piece 484 (hereafter 'Angle In'). Angle In 484 is a flat, wide piece of metal bent at a 90° angle and populated with twelve circular holes 486. Carriage bolts 470 are inserted from the outside of Angle Out pieces, through the angle and width or length pieces and through the Angle In pieces 484. Nuts are threaded onto the circular thread of the carriage bolts and fastened into place. Lifting holes 481 are disposed on the peripheral ends of the angle out pieces 480. Once assembled, the entire structure can be lifted by a crane that is coupled to the lifting holes.

Figures 36, 37, 38:
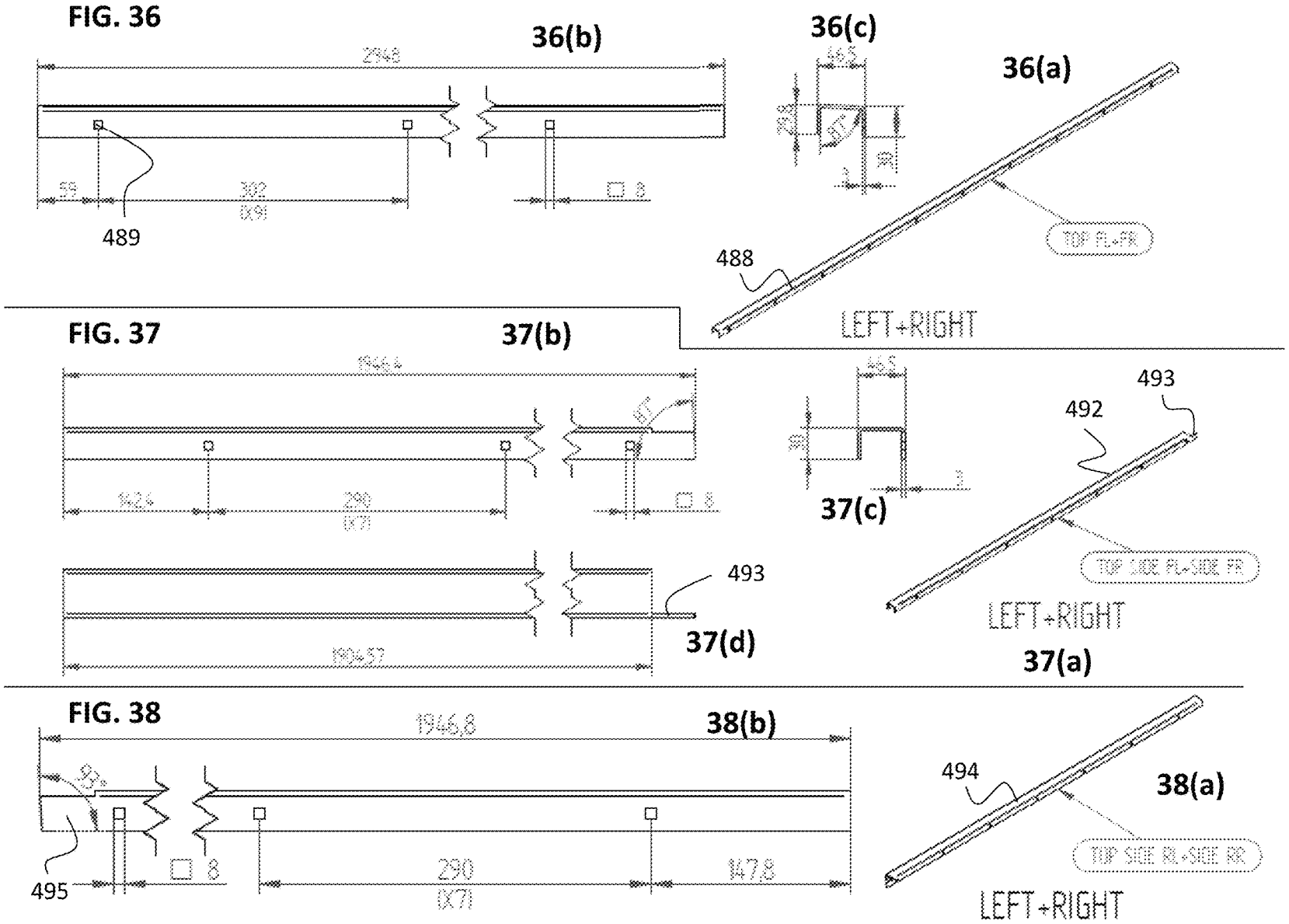

The tops of the vertical rods are covered with top covering pieces. FIG. 36 depicts various view of the top front right ('Top FR') and front left ('Top FL') pieces 488. FIG. 36(*a*) is an isometric view of the top piece. The top front left and front right pieces have the same structure. FIG. 36(*b*) is a side view of the top piece 488. The top pieces are populated with square holes 489. FIG. 36(*c*) is a cross-sectional or profile view of the piece 488. The piece is made up of two side panels and a top panel, all formed of a single piece bent into the aforementioned shape. The top panel is not at a right angle to the side panel but rather slanted (as the entire roof is slanted, as discussed above). The side panel is at an 87° angle to the top panel, as indicated in the figure. The left side (29.8 mm) is slightly shorter than the right side (30 mm). In fact, all the measurements (sizes and angles) disclosed in the written description and the accompanying Figures (both for the instant structure and all the other structures disclosed herein) are both exemplary and representative, allowing scaling where desired.

Between Top FR and Top FL there are two more cover pieces: Top FRM (top front right middle) and Top FLM (top front left middle) 490. These pieces are almost exactly the same as the Top FR and Top FL pieces, except that the Top FR/FL pieces are shorter in length, at 2948 mm as opposed to the longer middle pieces which are 3000 mm in length. The locations of the holes also differ slightly.

FIG. 37 depicts various views of the top side left and right front pieces, Top Side FL and Top Side FR 492. The top side front pieces have one extended side panel, where the extension 493 terminates in a tapered edge (87° from the horizontal). FIG. 37(*a*) is an isometric view of Top Side FL/FR 492. FIG. 37(*b*) is a side view of the piece 492. FIG. 37(*c*) is a profile view. From the profile view it is clear that each of the top and side panels are at respective right angles with each other. FIG. 37(*d*) is a top-down view of the piece 492.

FIG. 38 depicts various views of the top side left and right rear pieces, Top Side RL and Top Side RR 494. The top side rear pieces have one extended side panel, where the extension 495 terminates in a tapered edge (93° from the horizontal). FIG. 38(*a*) is an isometric view of Top Side RL/RR 494. FIG. 38(*b*) is a side view of the piece 494. The remaining aspects of the rear side pieces are similar to the front side pieces, mutatis mutandis. The rear top left and right pieces 496 are mirror images of the front top left and right pieces 488. The top rear middle left and right pieces 498 are mirror pieces of the Top FLM and FRM pieces 490

A two-man team can quickly and efficiently assemble the entire structure without any welding or specialty tools. No on-site cutting, shaping or fitting is needed. All the pieces are laser cut in the factory and galvanized prior to shipping to the assembly location.

Metal Canopy I

Figure 39:
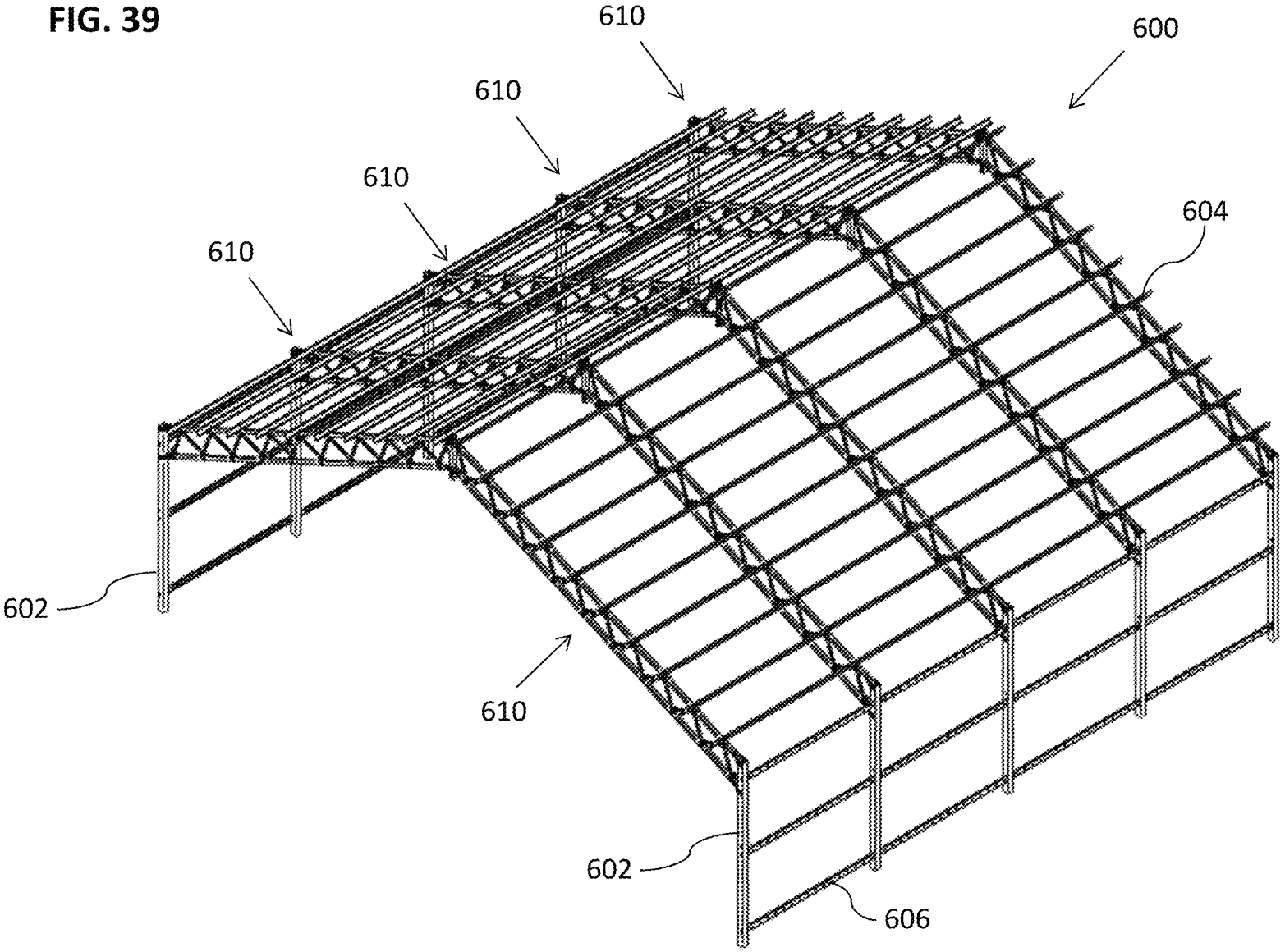

An assembled metal canopy 600 is depicted in FIG. 39. The canopy is made up of five metal arches 610, where each arch rests on two support poles 602. The support poles are buried in the ground and cemented in place. Coupling poles 606 run between the support poles, stabilizing the support structure. The coupling poles run through openings in the support poles and are fixed to the support poles where they intersect.

Cross beams 604 run the length of the structure on top of the arches. The cross beams are equally spaced apart and each beam is secured to each arch at the point of contact between the beam and the arch. The length of the structure can be scaled up or down by adding or removing arches and consequently lengthening or shortening the cross beams.

Figures 40, 40A, 40B, 40C, 40D, 40E, 40F:
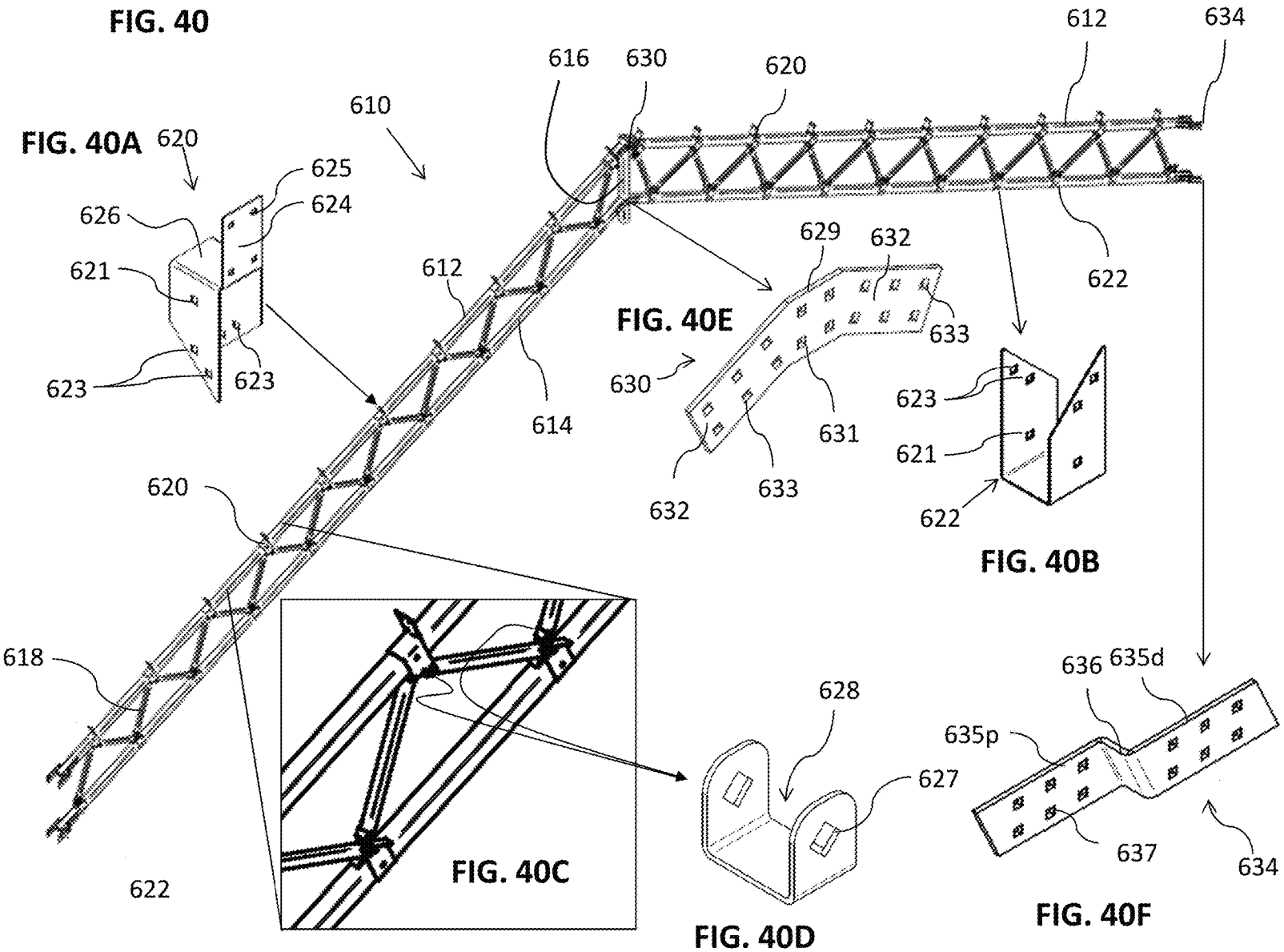

FIG. 40 is an angled view of an arch 610. Each arch has an upper profile 612 and a lower profile 614 on each side of a vertical profile 616. Between the upper and lower profiles are a plurality of short thin profile pieces 618 (thirty eight pieces in total) that are arranged in a head-to-toe formation, one piece angled on a diagonal in one direction and the adjacent piece angled in the opposite direction, with the tops of adjacent pieces overlapping and the bottoms of adjacent pieces overlapping. The width of the upper and lower profile are double the width of the short profiles. Accordingly, the overlapping ends together have the same width as the upper and lower profiles.

In the instant exemplary configuration, the width of both the upper and lower profiles is 100 mm. The width of each of the short profiles is 50 mm. These sizes are merely exemplary and can be scaled up (e.g. 120 mm and 60 mm) or scaled down (e.g. 80 mm and 40 mm). The short profiles are held in place by holding pieces (hereafter 'holders'). There are upper holders 620 and lower holders 622. The upper holders 620 have a dual function of both holding the short profiles in place (when fastened with screws) as well as serving as connector pieces (beams are secured to a connector plate portion of the upper holder, see below for further details) for attaching to the cross beams 604. Upper holders on the left hand side are mirror images of the upper holders on the right hand side. The difference being which side the connector plate for the cross beam is located. The lower holders 622 have only a single function of holding the short profiles in place (when fastened with screws).

FIG. 40A is an isometric view (enlarged) of an upper holder 620. Upper holder 620 has a complex shape. The upper holder has an upper part 624 and a lower part 626. The upper part 624 of holder 620 is referred to as a connector/coupling plate 624 which has four square screw holes 625 for coupling to the cross-beams.

The lower part 626 of the holder is a flat, wide piece bent into a U shape, where each of the sides of the flat U tapers to a point, and where each of the points on an opposite end of the flat sides of U shape (such that the point do not overlap when viewed from the side). The upper holder fits over the profile 612 and is fastened to the profile by a fastener, preferably a carriage bolt, which is threaded through square screw holes 621 and secured by a nut. There are two holes 623 along each of the tapered edges of the side of the U-shape. Short profiles 618 are affixed to the upper holders via holes 623, as detailed hereafter.

FIG. 40B is an isometric view (enlarged) of a lower holder 622. The lower holder 622 has the same shape, screw holes and function as the lower part 626 of the upper holder 620. The distinction being that lower holder couples with the lower profile 614. The lower holder is devoid of a coupling plate. Due to the similarities between the upper and lower holders, the screw holes are identified with the same reference numbers. Accordingly, the lower holder fits under the lower profile 614 and is fastened to the profile by a carriage bolt through square screw holes 621. There are two holes 623 along each of the tapered edges. Short profiles 618 are affixed to the lower holders via holes 623, as detailed hereafter.

FIG. 40C is an enlarged view of a portion of the metal canopy arch 610. FIG. 40D is an isometric view of a small holder 628. Small holders 628 fit over each short profile piece 618, with one at the bottom and one at the top of each piece. The small holders fit between the short profiles 618 and the upper or lower holders.

Two holes at the top end of each short profile line up with the holes 627 in the upper holders. The holes in the small holders line up with one of the two holes 627 on each side of the upper holder as well. Carriage bolts fasten the overlapping short profiles to small holders and to the upper holders via the screw holes 627.

In summary, there is provided a metal canopy structure, including a plurality of arches arranged in parallel formation, equally spaced apart, each of the arches having a planar construction and disposed on a plane running along a first axis. In addition, a plurality of cross beams, at least a portion thereof arranged in parallel formation, each of the cross beams disposed on a second axis perpendicular to the first axis and mechanically coupled to at least a portion of the plurality of arches. Also, there are a plurality of support poles, wherein each of the arches is mechanically coupled to a pair of support poles. In some embodiments, there are a plurality of coupling poles, the coupling poles disposed along the second axis and mechanically coupled to the plurality of support poles, at least a portion of the coupling poles arranged in a parallel formation.

With regards to the arches themselves, each arch has a vertical profile, disposed along a third axis, perpendicular to both the first axis and the second axis. There is a left hand upper profile and a right hand upper profile mechanically coupled to the vertical profile and a left hand lower profile and a right hand lower profile both mechanically coupled to the vertical profile. The upper and lower profiles each disposed at an acute angle relative to the vertical profile. A plurality of short profiles, a first half of the short profiles disposed between the left hand upper and lower profiles and a second half of the short profiles are disposed between the right hand upper and lower profiles. The short profiles mechanically couples to the upper and lower profiles.

FIG. 40E depicts an isometric view (enlarged) of a holder leg 630. There are two holder legs on the front side of the arch visible in the figures. Another two holder legs 630 are disposed on the back side of the arch. Two holder legs 630 for the upper profiles and two for the lower profiles. Each pair of holder legs sandwiches the right-hand profile, the vertical profile and the left-hand profile between them and secures them together with fasteners (e.g. carriage bolts). There is one pair of holder legs for the upper profiles 612 and one for the lower profiles 614. The holder leg 630 has a straight (horizontally level) central section 629 with four square screw holes 631, and slanted right- and left-hand sections 632, each with six screw holes 633 formed therein. The angle of the slanted sections relative to the straight section is the same as the angle of the upper and lower profiles to the vertical profile (i.e. 65° in the immediate, exemplary structure).

FIG. 40F depicts a connector piece 634. Two connector pieces 634 are disposed on the ends of each of the right and left, upper and lower profile pieces. The connectors couple the arches to the support poles 602. Each arch is coupled to each support pole by four connector pieces. The connector piece 634 is a flat elongated piece of metal bent midway almost perpendicular and the bent again to be parallel to the unbent portion. The piece therefore has two sections 635 that are spaced apart by a short middle portion 636 that is almost perpendicular to the two other sections. The another way, sections 635 lie on parallel planes while portion 636 connects the two sections, spanning the distance between these planes. Each of the two sections has six square screw holes 637. One of the sections, termed hereafter proximal section 635*p*, connects to the profile while the other section, termed hereafter distal section 635*d*, connects to the support pole. The support poles are wider than the profile pieces therefore the connector pieces are attached such that the distal sections of the connector pieces are disposed outwardly from the virtual plane of the profile piece. This arrangement can be seen by careful view of FIG. 40.

FIG. 41 depicts the vertical profile 616. Vertical profile 616 has two groupings of four square screw holes 615. One grouping is near the top end of the profile and the other grouping is near the bottom. It is to these groupings that the holder legs 630 are coupled with carriage bolts. There are two parallel holes 617 at the top end of the vertical profile. One hole 617 is formed in the front face of the profile piece and the other hole 617 is provided in the back face of the vertical profile piece. During assembly of the metal canopy, arch 610 can be assembled on the ground. A single worker can assemble an entire arch within a couple of hours(!).

Once assembled, a crane suspends the assembled arch by a hook or hooks (or other simple coupling arrangement) threaded through holes 617. The arch is perfectly balanced such that it is sufficient to raise the arch by the central piece, vertical profile 616. The arch is suspended by the crane over the support poles while one or two workers attach the arch to the poles with carriage bolts. The entire procedure can take between 5 and 10 minutes(!).

FIG. 42 depicts various views of the upper and lower profiles. FIG. 42(*a*) is an isometric view of lower profile 614. FIG. 42(*b*) is a frontal view of the profile. FIG. 42(*c*) is a cross-sectional view of the profile. Lower profile 614 is essentially the same piece as upper profile 612. The right and left profiles are also interchangeable. In the exemplary embodiment, the profiles are 12 meters in length. One end of the profile (the left side, in the figure) tapers to a point. The angle of the edge corresponds to the angled portions of the holder legs (i.e. 65° off the vertical axis descending below the vertical profile). Six square screw holes 638 on the angled end (left side) correspond to holes 633 on the angled sections 632 of the holder leg 630. When assembled, the angled edge of each profile 612, 614 abuts the vertical profile and is secured in place with carriage bolts fastened to the holder legs, the vertical profile and the left and right, upper and lower profiles. Screw holes 631 on the holder legs correspond to screw holes 615 on the vertical profile 616.

The profiles 612, 614 have screw holes 613 spaced along the front and back faces of the piece at equal intervals. Screw holes 621 in the upper and lower holders correspond to screw holes 613. Likewise, holes 627 of the small holders 628 correspond to holes 621 and 613. All the holes are lined up and carriage bolts fastened through them, affixing the holders and the short profiles in place.

On the distal or outer end of the profile, the right hand side in the depicted view, the edge is straight. A grouping of six screw holes 639 is disposed on the outer end of the profile. These screw holes correspond to the screw holes 637 of the proximal section 635*p*. There are two more screw holes 640 right on the outer edge of the profile. The terminal section, i.e. the outer edge of the profile 612, 614, when assembled, enters into the support pole 602 (either via a hole in the pole or via an open section of the pole, namely the inner section of the pole, facing the arch). The screw holes 637 of the distal section of the connector piece 634 correspond to six screw holes in the support pole. Two of the holes on the support pole (closest to the arch) correspond to the first two holes on the distal section and to the two holes 640 on the terminal section of the profile. Carriage bolts fastened through the aforementioned holes firmly lock the profiles to the support poles. The other four holes provide additional support and locking power.

FIG. 43 depicts various views of the short profile piece 618. In the exemplary arch 610 depicted in FIG. 40, there are 38 short profile pieces 618. The short profile pieces are parallelepiped in shape. In the example, each short piece is 1078 mm in length. Each end 642 is angled or beveled so that the edges 642 fit flush against the upper and lower profiles when correctly positioned. FIG. 43(*a*) is an isometric view of the short profile 618. FIG. 43(*b*) is a front view of the short profile 618. FIG. 43(*c*) is a view of the cross-section of the short profile. Whereas the upper and lower profile pieces are 100 mm in height and width, the short profile pieces are half the width at 50 mm. The short profile pieces are also 50 mm in height. Whatever the width of the long profile pieces, the short profile pieces will be half that width, so if the long profile piece is 80 mm in width, the corresponding short profile piece will be 40 mm in width and so on.

The short profile pieces 618 are arranged head-to-toe with the adjacent pieces, overlapping at the top and bottom ends as discussed elsewhere. Square screw holes 644 of the overlapping pieces line up with each other and with the holes 623 on the tapered ends of the upper and lower holders 620, 622. On each of the outer ends of the arch, there is no corresponding short profile to overlap with the last short profile where it abuts the lower profile. In order to keep the last profile (on either end) in place, there is a need for a filler piece of the same width as the short profile, and the piece also needs a beveled edge like the short profile.

To fill this need, there is provided a mini profile 646. FIG. 43 is an isometric view of mini profile 646. The mini profile is a truncated short profile with opposing beveled edges 648 (in contrast to the short profiles where the edges are beveled in the same direction). The mini profile has two square screw holes 650. These holes line up with the holes on the lower end of the last short profile and the corresponding holes on the lower holder. Another two mini profiles are found on either side of, and abutting, the vertical profile. In these cases, the mini profiles overlap with the top ends of the short profiles that abut the vertical profile. Upper holders with corresponding holes hold the pieces in place with carriage bolts.

Metal Canopy II

Figure 44:
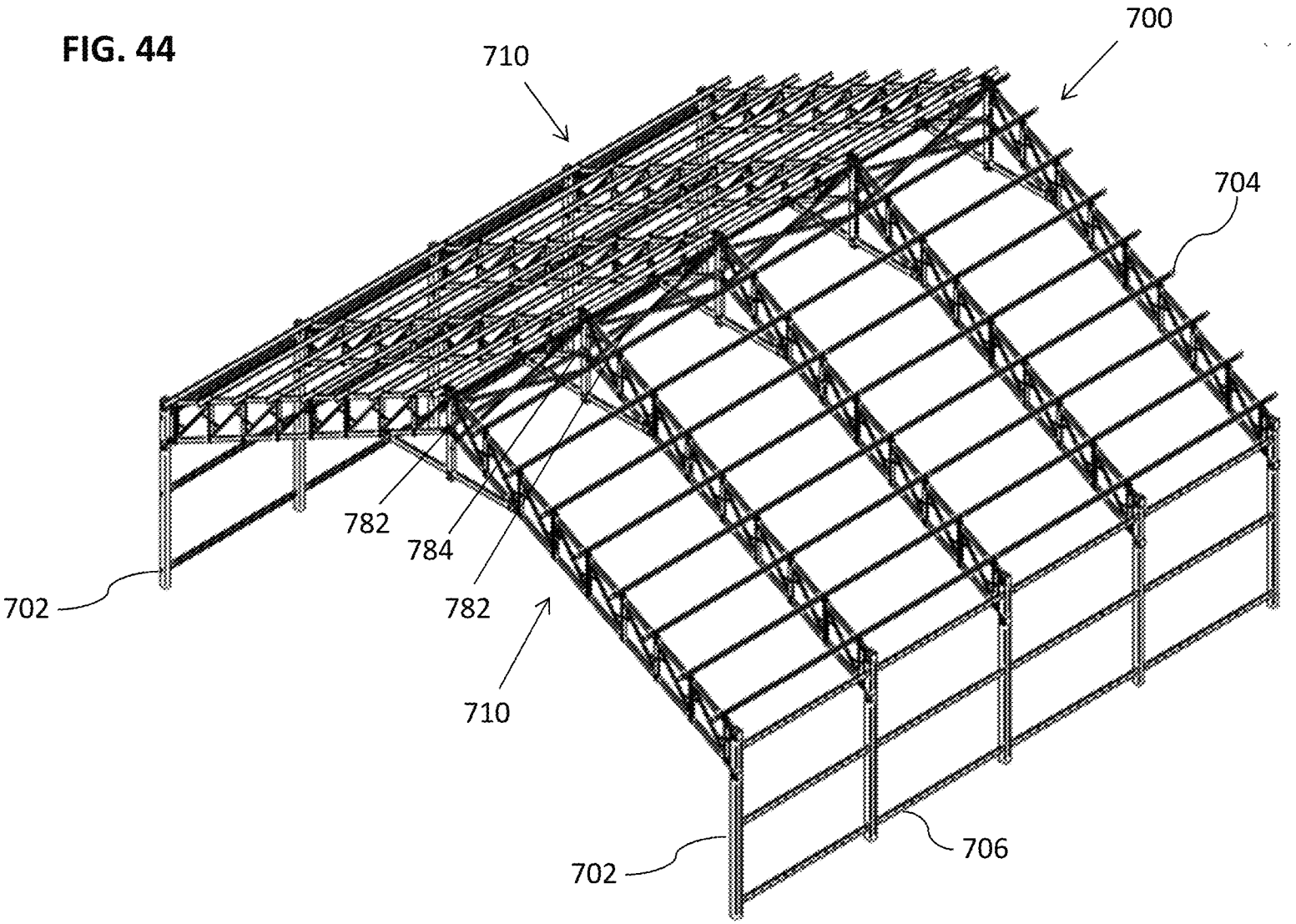

FIG. 44 is an isometric view of a second embodiment of the metal canopy. Metal canopy 700 is similar in many respects to the first embodiment, metal canopy 600, with various differences in the structure of the arches and some minor differences in the entire structure. A metal canopy structure 700 includes a plurality of arches 710 arranged in parallel formation, equally spaced apart. Each of the arches has a planar construction and is disposed on a separate plane running along a first axis. For the sake of clarity, the first axis is referred to herein as the X-axis.

A plurality of cross beams 704, are placed on top of the arches. At least a portion of beams 704 are arranged in parallel formation. In one embodiment, each beam span the length of the entire canopy. In other embodiments, more than one beam 704 can be arranged in sequence so that two or more beams together span the length of the canopy 700. Accordingly, in the latter embodiments, a portion of the cross beams are arranged sequentially along the second axis, in addition to being arranged in parallel.

In all the embodiments, each of the cross beams is disposed on a second axis perpendicular to the first axis. For the sake of clarity, this axis is referred to herein as the Z-axis. Each of the beams is mechanically coupled to at least a portion of the plurality of arches (e.g. one beam may be coupled to half the arches while a second beam is also coupled to half the arches and both beams are coupled to the middle arch; or, each beam is coupled to all the arches).

There are a plurality of support poles 702 on which the arches rest. Each of the arches is mechanically coupled to a pair of support poles 702. As such, the support poles are positioned at regular intervals along the second axis. To be sure, each support pole itself is installed in the ground longitudinally, along a third, vertical axis (hereafter Y-axis).

There is also a plurality of coupling poles 706, that are disposed between the support poles which provide increased support and rigidity to the structure. The coupling poles 706 are disposed along the second axis (Z-axis). The coupling poles are mechanically coupled to the plurality of support poles, such that at least a portion of the coupling poles are arranged in a parallel formation, spaced apart at equal intervals (on a plane disposed on the Y-axis). In some embodiments, each coupling poles traverses the entire length of the structure, connecting to all the poles on one side of the structure. In other embodiments, the coupling poles are shorter and two or more poles 706 are disposed sequentially along the Z-axis, together spanning the entire length of the structure. Accordingly, in the latter embodiments a portion of the coupling poles are arranged sequentially along the second axis. In the instantly depicted embodiment of FIG. 44, each coupling pole 706 couples only two support poles. The arch 710 will be discussed in detail immediately hereafter and then the overall structure will be discussed in summation.

Figures 45A, 45B:
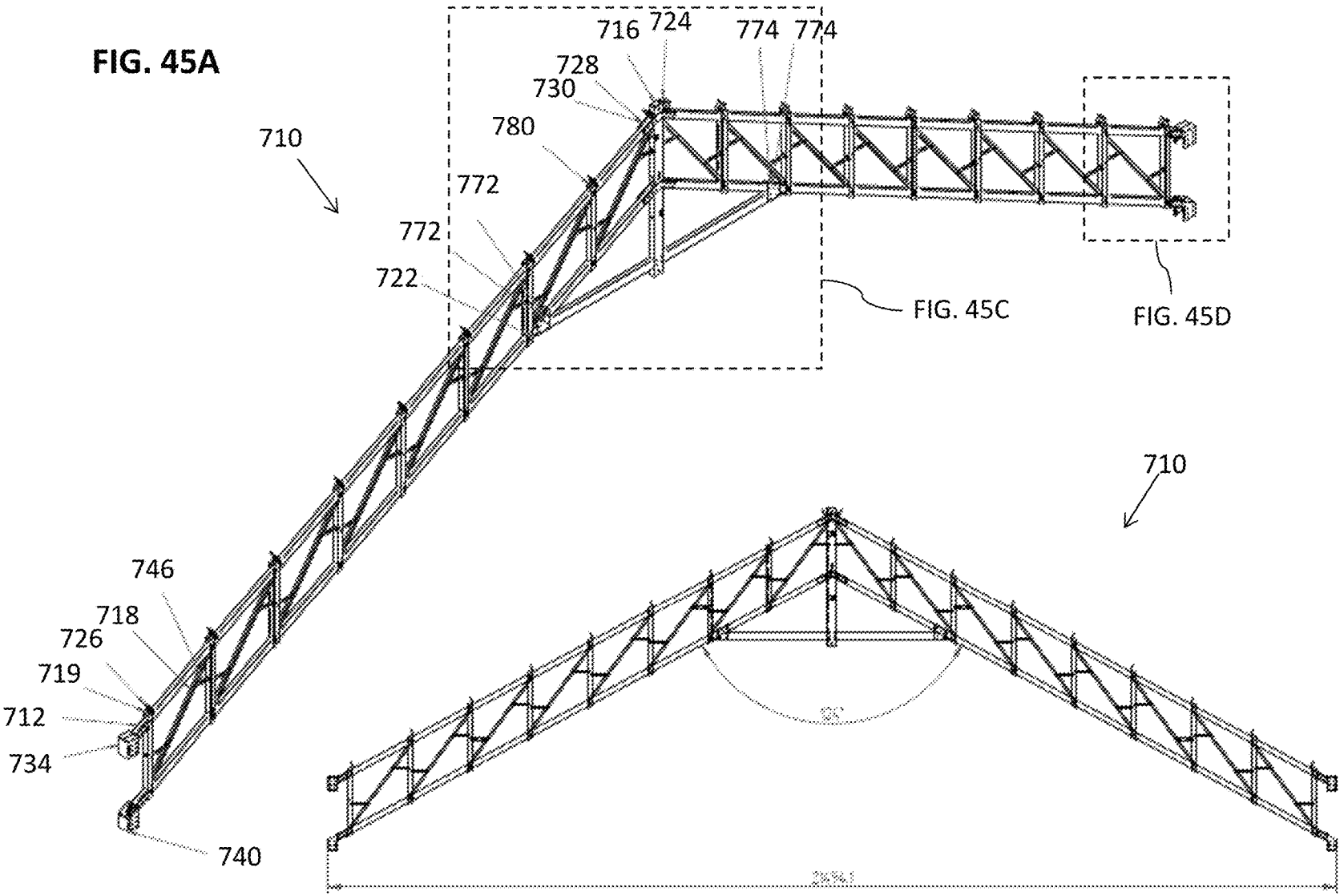
Figures 45C, 45D:
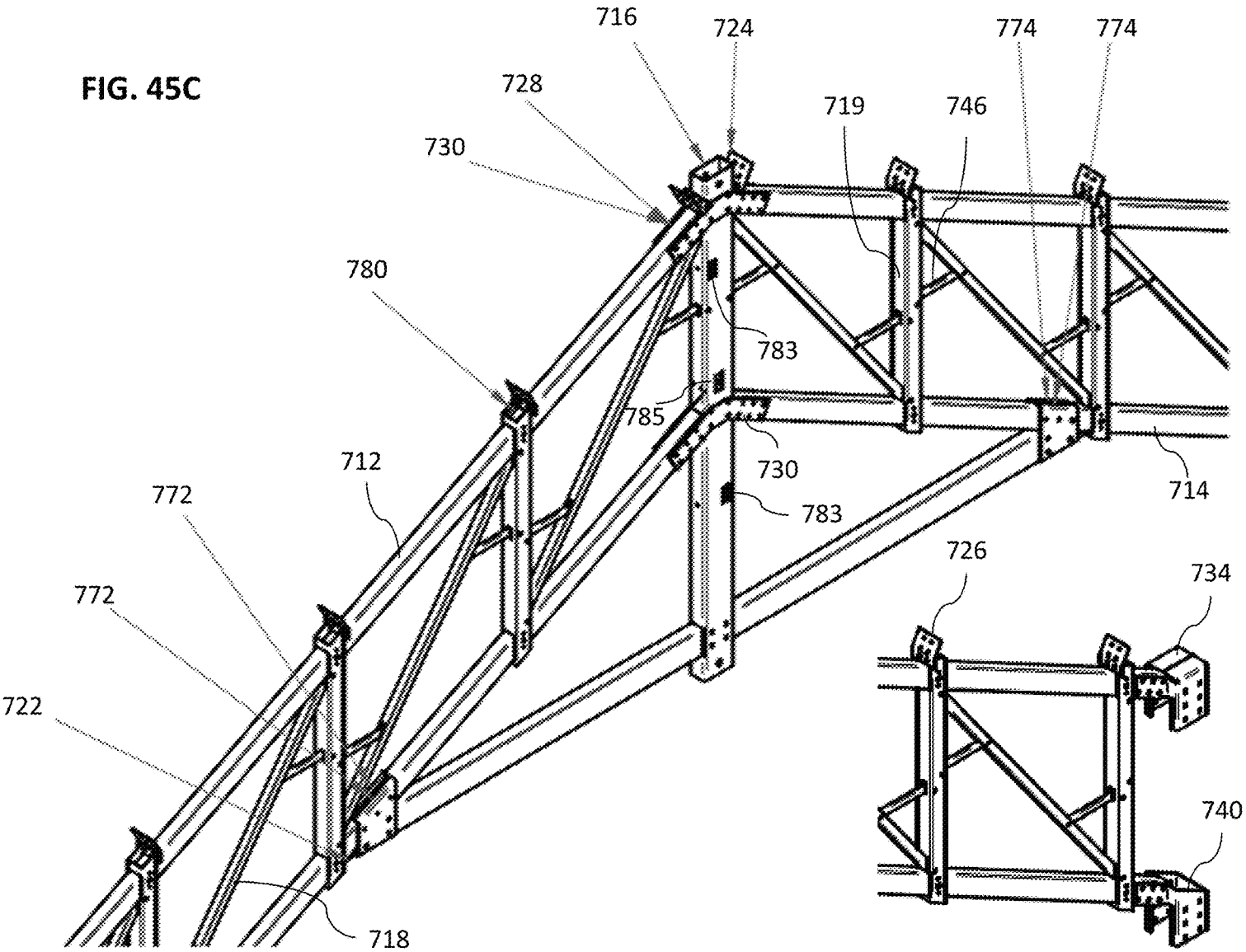

FIGS. 45A and 45B are different views of an arch 710. Arch 710 is one of a plurality of arches that are arranged together with interconnecting pieces to form a metal canopy 700. FIG. 45A is an isometric view of arch 710. FIG. 45B is a front view of arch 710. FIG. 45C is an enlarged view of the central portion of the arch. FIG. 45D is an enlarged view of the right hand end of the arch.

Each of the plurality of arches includes a vertical profile 716. The vertical profile is located in the middle of the arch. The vertical profile is disposed along a third, longitudinal axis. The third axis (as mentioned above) is referred to herein as the Y-axis. The third axis is perpendicular to both the first axis (X-axis) and the second axis (Z-axis).

The lower/upper profiles are at a 62° angle off the vertical axis of the vertical profile 716. The angle between the left and right profiles is 124°. This is both an exemplary and a preferred angle for the slant of the arch. Further exemplary measurements are marked on the Figures and considered as if set forth herein. For example, the entire length of the arch (i.e. the width of the canopy) is 21494.1 mm.

The arch 710 has a left hand upper profile 712 and a right hand upper profile 712. When needing to distinguish between the left hand upper profile and the right hand upper profile, the reference number 712L is used for left hand and the reference number 712R is used for the right hand. Both of the upper profiles are mechanically coupled to the vertical profile 716 at an angle, such that the top of the vertical profile is the apex of the arch which slants downwards on either side from the central vertical profile 716.

The arch further includes a left hand lower profile 714 and a right hand lower profile 714. When needing to distinguish between the left hand upper profile and the right hand upper profile, the reference number 714L is used for left hand and the reference number 714R is used for the right hand. Both of which are mechanically coupled to the vertical profile at the same angle that the upper profiles are coupled to the vertical profile. Therefore, the upper and lower profiles 712, 714 are each disposed at, or form between them, an acute angle relative to the vertical profile 716.

The structure further includes a plurality of short profiles. A first half of the short profiles are disposed between the left hand upper and lower profiles and a second half of the short profiles disposed between the right hand upper and lower profiles. The short profiles are mechanically coupled to the upper and lower profiles.

In the instant configuration, as opposed to the previous configuration (metal canopy I), there are two types of short profiles: angled short profiles 718 and vertical short profiles 719. The vertical short profiles (VSPs) 719 are disposed parallel to vertical profile 716. The angled short profiles are laid on a diagonal between the vertical short profiles. So the angled short profiles (ASPs) 718 have a first end (e.g. the bottom end) that is proximal to a first adjacent vertical short profile (e.g. a VSP on the left hand side of the ASP) and a second end (e.g. the top end of the ASP) that is proximal to a second adjacent vertical short profile (e.g. on the right hand side of the ASP).

Figure 46:
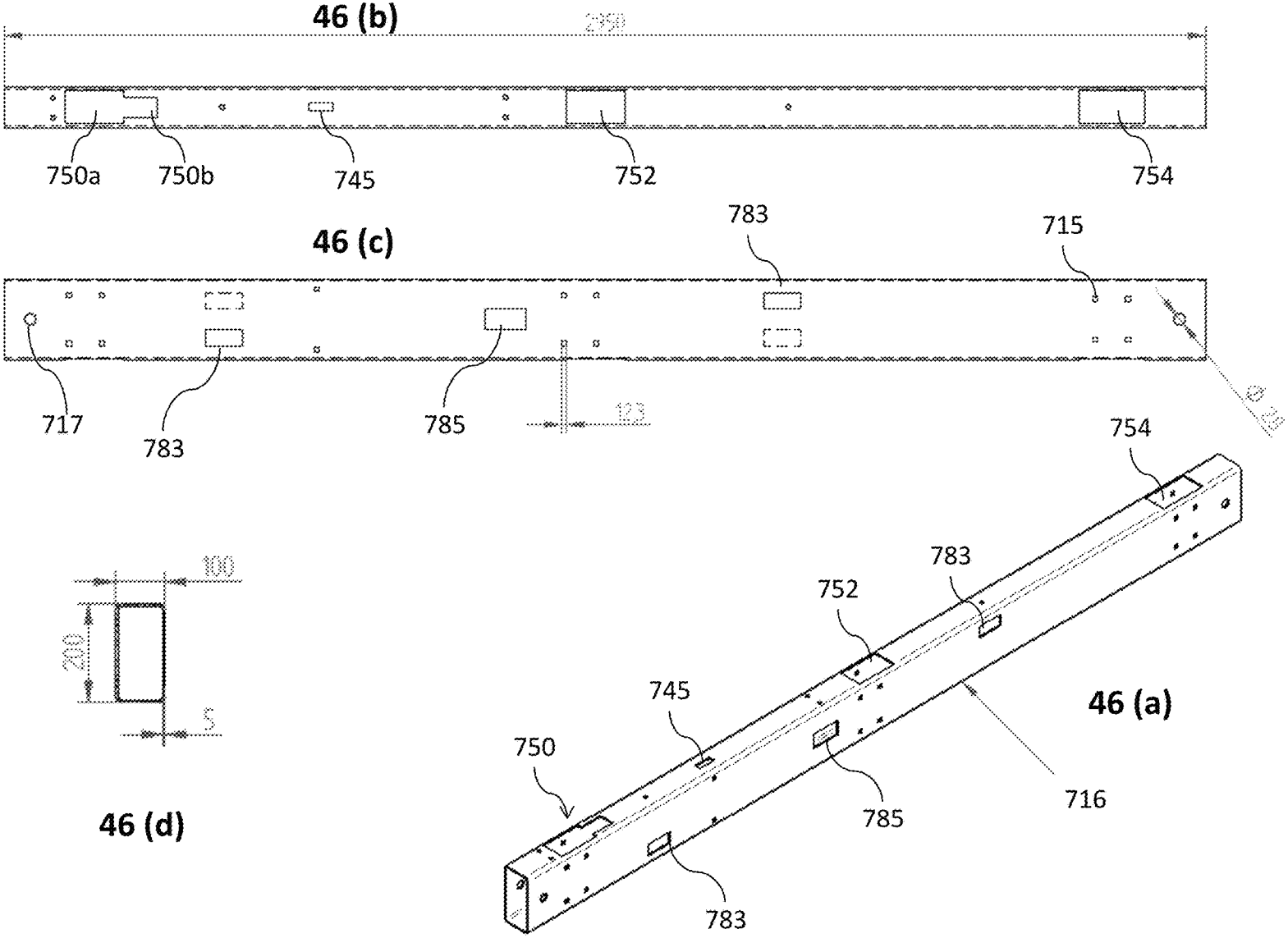

FIG. 46 includes various views of vertical profile 716. FIG. 46(*a*) is an isometric view of the vertical profile. FIG. 46(*b*) is a side view of the profile. FIG. 46(*c*) is a front view of the profile and FIG. 46(*d*) is a cross-sectional view of the profile. Vertical profile 716 is a rectangular elongated profile with narrow sides and wider back and front faces. The narrow sides are identical. The front and back faces are also identical and as a result, two of the openings do not line up (see below).

The narrow sides each include an upper opening 750 (left side of FIG. 46(*b*)), an approximately mid-way opening 752 and a lower opening 754. Each upper opening (i.e. on either side of the profile) is shaped like a larger rectangle 750*a* with a smaller rectangle 750*b* below it. The upper profiles 712 are inserted into the larger rectangular sections 750*a* of the upper openings while angled short profiles 718 fit into the smaller rectangles 750*b* on either side of the vertical profile.

The lower profiles 714 fit into the mid-way openings 752. A cross profile 722 is threaded through the lower opening 754. The profiles are held in place by carriage screws threaded through square screw holes 715 on the front and back faces. In the depicted embodiments, the narrow sides are 100 mm in width and the wide front and back sides are 200 mm in width.

There are two parallel holes 717 at the top end of the vertical profile. One hole 717 is formed in the front face of the profile piece and the other hole 717 is provided in the back face of the vertical profile piece. During assembly of the metal canopy, arch 710 can be assembled on the ground. A single worker can assemble an entire arch within a couple of hours(!).

Once assembled, a crane suspends the assembled arch by a hook or hooks (or other simple coupling arrangement) threaded through holes 717. The arch is perfectly balanced such that it is sufficient to raise the arch by the central piece, vertical profile 716. The arch is suspended by the crane over the support poles while one or two workers attach the arch to the poles with carriage bolts. The entire procedure can take between 5 and 10 minutes(!).

Figure 47:
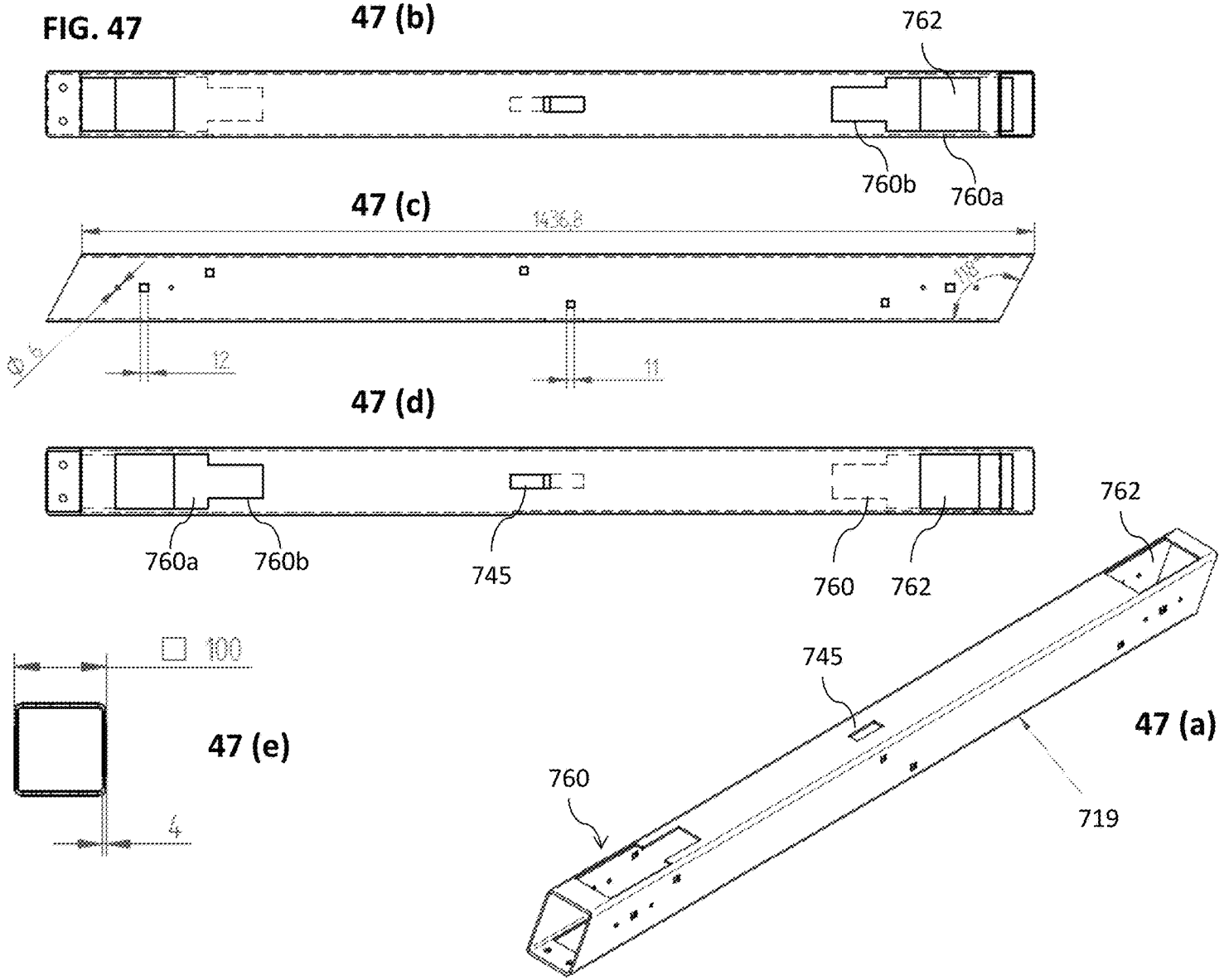

FIG. 47 illustrates various views of vertical short profile 719. FIG. 47(*a*) is an isometric view of the vertical short profile. FIG. 47(*b*) is a view of a first side of the VSP and FIG. 47(*d*) is a view of a second side of the VSP. FIG. 47(*c*) is a front (or back) view of the VSP. FIG. 46(*e*) is a cross-sectional view of the profile, which has a square cross section. Each of the plurality of vertical short profiles is a parallelepiped with a front face, a back face and side faces. On each of the side faces there is a first rectangular opening 762 near one end and near the other end there is a second opening 760 in the form of a small rectangle 760*b* (smaller than and) abutting a large rectangle 760*a*. The large rectangle 760*a* has the same dimensions as the first rectangular opening 762. The first rectangular opening 762 and the larger rectangle 760*a* of the second opening 760 are adapted to receive there-through either an upper profile 712 or a lower profile 714. The small rectangle 760*b* is adapted to receive one end of an angled short profile 718 therein. The positions of the first opening and the second opening are reversed on the two side faces of the VSP. Adjacent VSPs have an ASP disposed diagonally there-between. One end of the ASP is disposed on the second opening at the bottom of one of the VSPs and the other end of the ASP is disposed in the second opening at the top of the adjacent VSP. The AVPs are fixed to the VSPs and the VSPs are fixed to the upper and lower profiles by carriage bolts, and in some case with regular screws, such as self drill screws.

In addition to AVPs disposed between the VSPs, there are also a plurality of mini profiles 746 that are disposed between the each ASP and the connected VSPs that are coupled thereto. The mini profiles 746 are inserted into rectangular openings 745 on the ASPs, VSP, and vertical profile 716.

Figure 48:
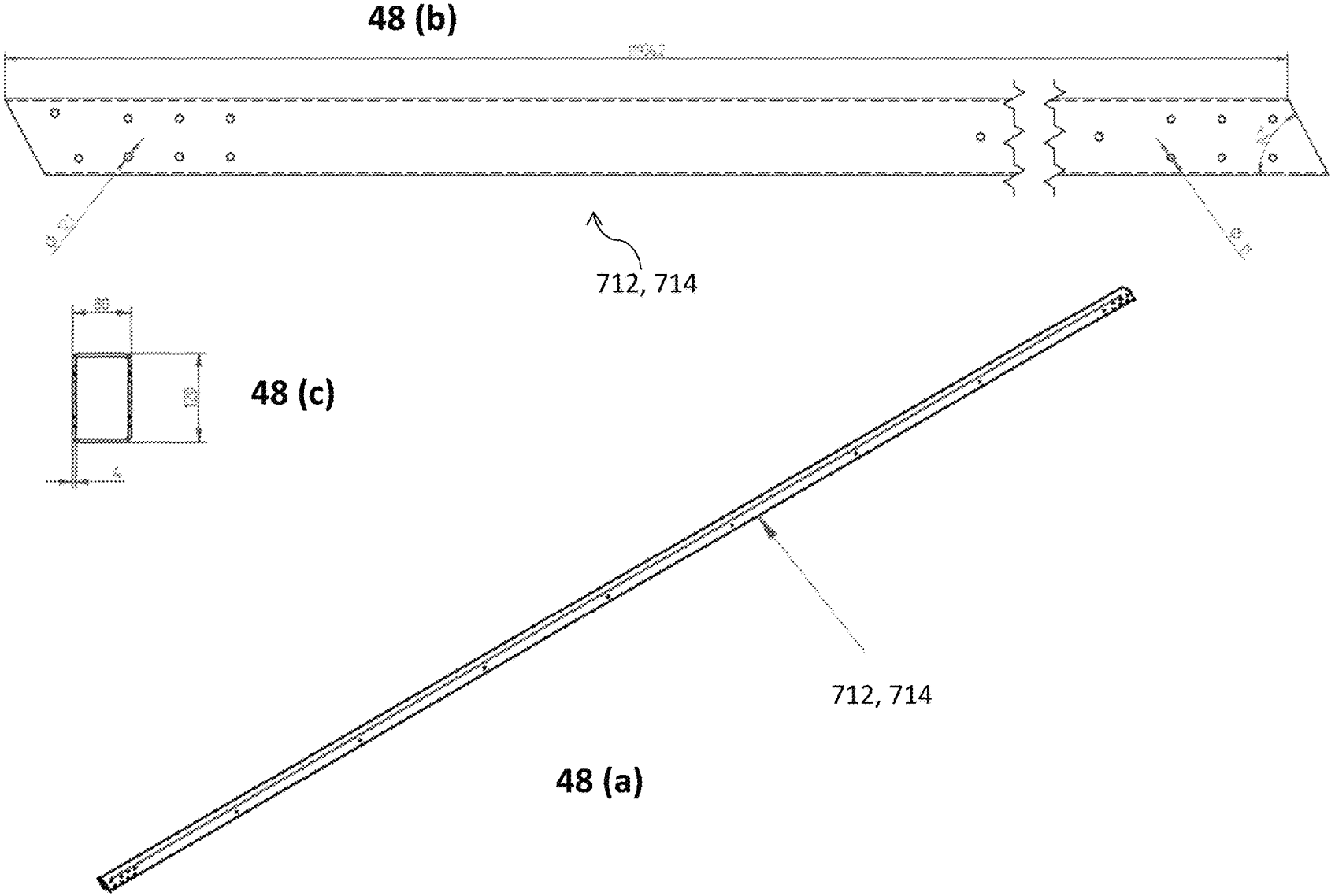

FIG. 48 illustrates various views of the upper/lower profile 712, 714. FIG. 47(*a*) is an isometric view of the profile. FIG. 47(*b*) is a front view of the profile. FIG. 47(*c*) is a cross-sectional view of the profile, which has a rectangular cross section (exemplarily, 80×120 mm). Each of the profiles is a parallelepiped with a front face, a back face, a top face and a bottom face. Exemplarily, the profile is 11936.2 mm in length. Screw holes are disposed at regular intervals along the length of the profile. The beveled ends of the parallelepiped profile are disposed as a 62° angle to the horizontal.

Figure 49:
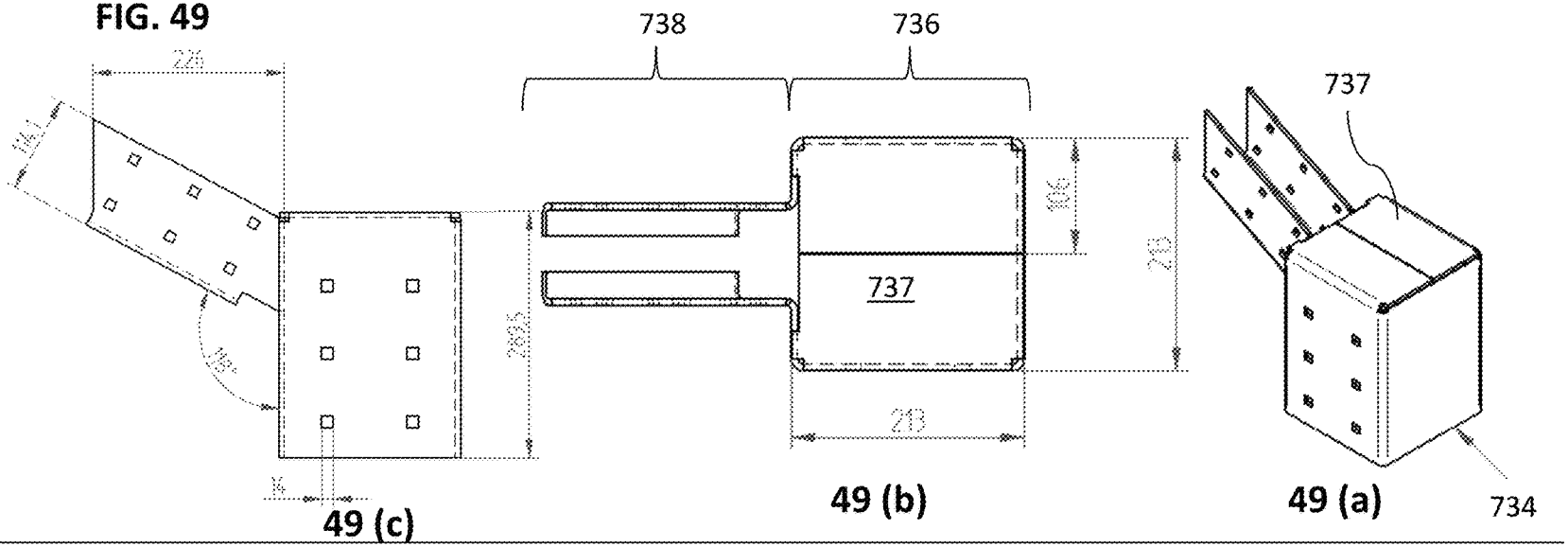

FIG. 49 illustrates various views of a closed connector piece 734. FIG. 49(*a*) is an isometric view of the closed connector piece. FIG. 49(*b*) is a top-down view of the piece. FIG. 49(*c*) is a front view of the connector piece. Two connector pieces 734 are disposed on the ends of each of the right and left, upper profile pieces 712. The connectors couple the arches to the support poles 702. The closed connector piece has a box-like main section 736 that is closed on the front, back and one of the sides. A top 737 closes over the square volume of the main section 736, while bottom end is open. Out of the second side (facing the profile) is a spout-like protrusion 738 set at an angle (e.g. 118°). The box-like main section 736 fits over the top of a support pole 702 and the upper profile 712 fits into spout 738. The parts are fixed together with fasteners applied to corresponding screw holes.

Figure 50:
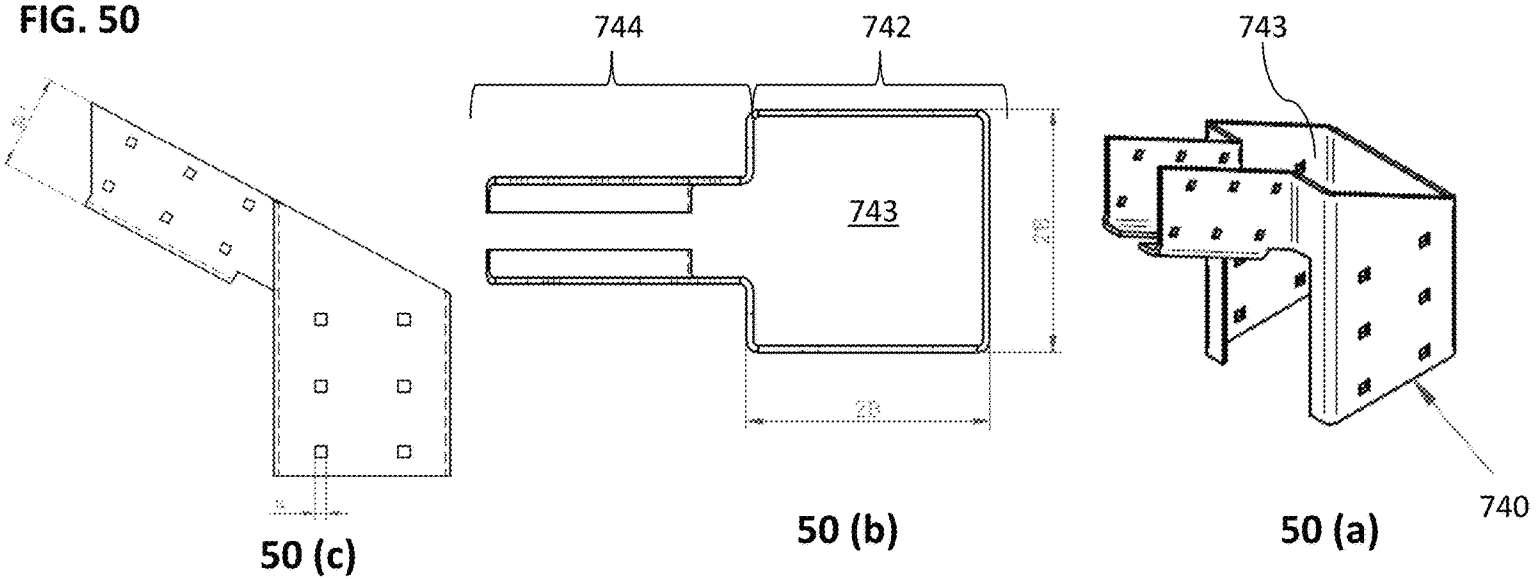

FIG. 50 illustrates various views of a open connector piece 740. FIG. 50(*a*) is an isometric view of the open connector piece. FIG. 50(*b*) is a top-down view of the piece. FIG. 50(*c*) is a front view of the connector piece. Two connector pieces 740 are disposed on the ends of each of the right and left, lower profile pieces 714. The connectors couple the arches to the support poles 702. The open connector piece has a box-like main section 742 that is closed on the front, back and one of the sides. The top and bottom are open, such that the sides of the box-like section define a volume 743. The open top and bottom ends allow the connector pieces to be thread onto the support poles (the closed tops of the closed connector pieces 734 come to rest on the tops of the support poles).

The second side (facing the profile) is open with a spout-like protrusion 744 extending there-from, at an angle (e.g. 118°). The box-like main section 742 threads onto a support pole 702 and the lower profile 714 fits into spout 744. The parts are fixed together with fasteners applied to corresponding screw holes.

Figure 51:
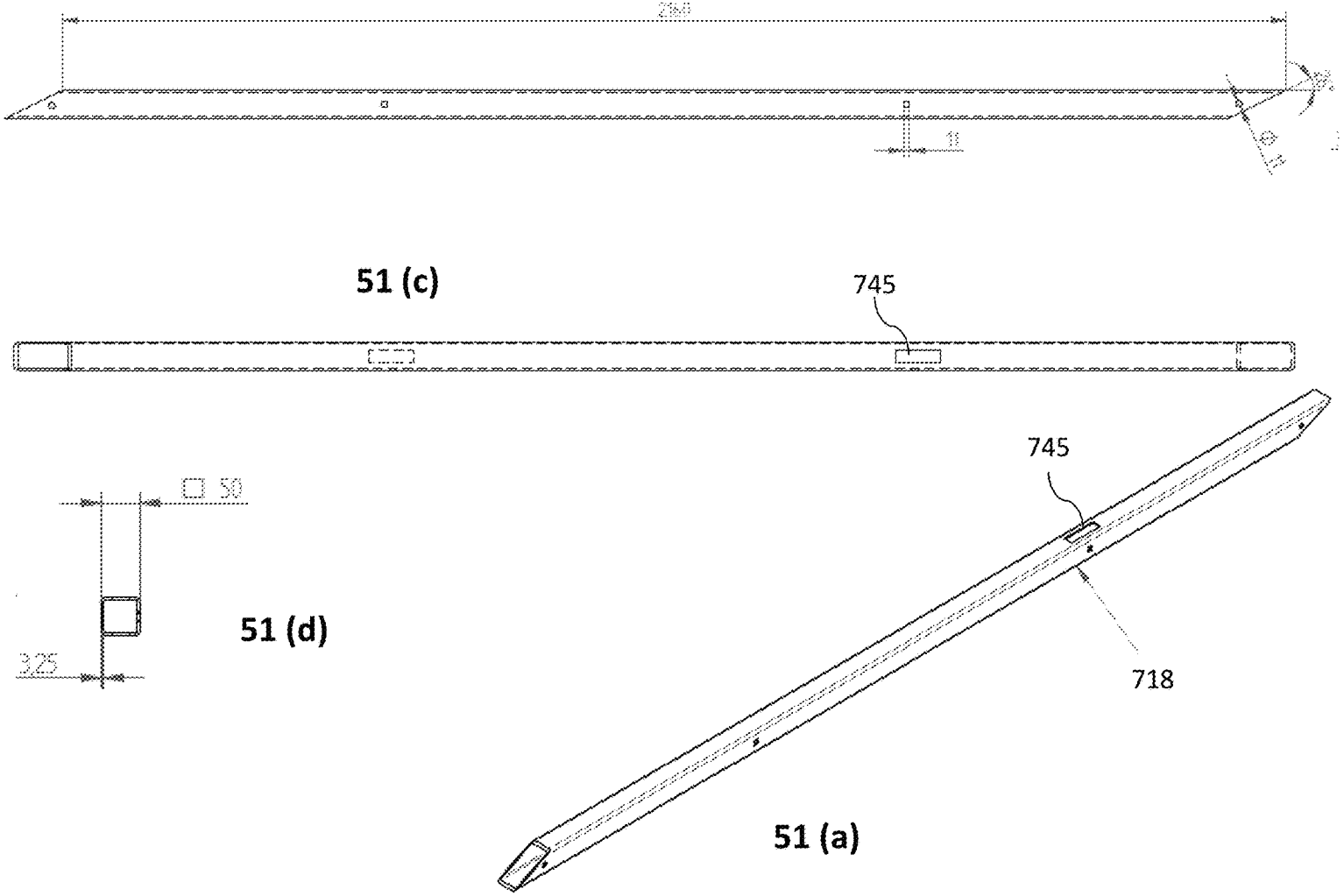

FIG. 51 illustrates various views of angled short profile (ASP) 718. FIG. 51(*a*) is an isometric view of the angled short profile. FIG. 51(*b*) is a front view of the ASP. FIG. 51(*c*) is a side view of the short profile and FIG. 51(*d*) is a cross-sectional view of the profile. The ASP 718 is a parallelepiped with a front face and a back face, which have corresponding screw holes at the points of connection between the ASP and other pieces. The ASP has two side faces, each side face has one rectangular opening 745 for receiving a mini profile 746 therein. Exemplarily, each ASP is 2160 mm long with a square cross-section and a width and height 50 mm.

Figure 52:
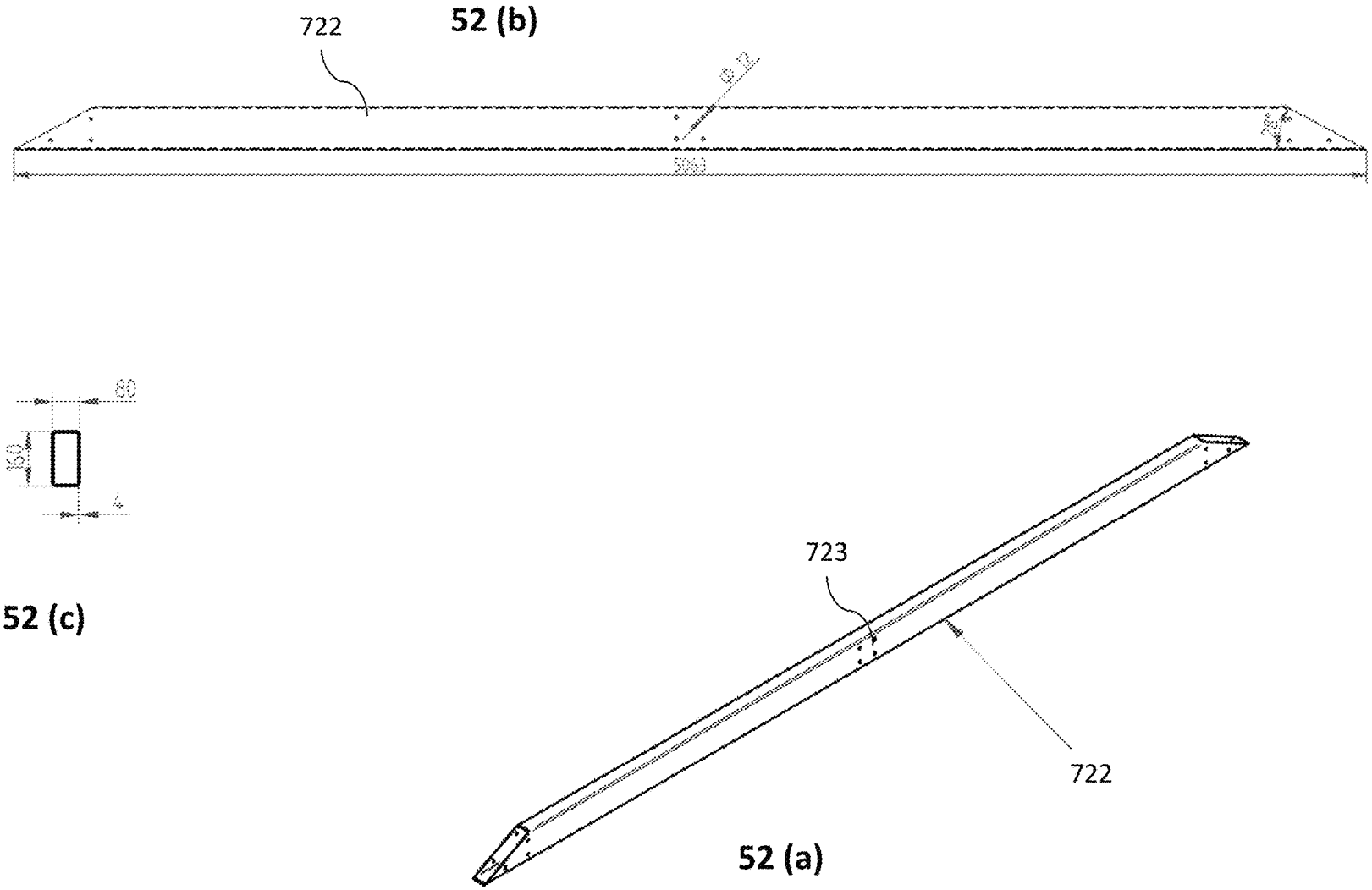
Figure 53B:
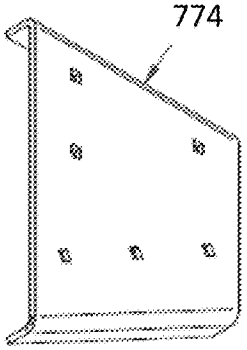
Figure 53A:
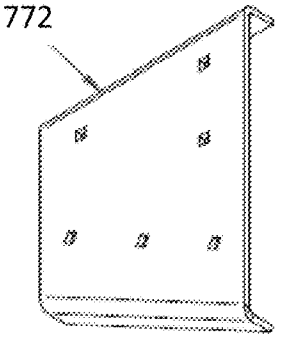

FIG. 52 depicts various views of the cross profile 722. FIG. 52(*a*) is an isometric view of the cross profile 722. FIG. 52(*b*) is a front view of the cross profile 722. FIG. 52(*c*) is a view of the rectangular cross-section (e.g. 160×80 mm) of the cross profile. As mentioned elsewhere, cross profile 722 threads through the lower opening 754 of the vertical profile 716. The cross profile is fixed to the vertical profile with fasteners threaded through screw holes 723. Each end of the cross profile abuts one of the lower profiles 714. The cross profile is secured to the lower profiles by two left holder plates 772 and two right holder plates 774. A left holder plate 772 is depicted in FIG. 53A and a right holder plate is depicted in FIG. 53B. The holder plates are placed on the front and back sides, over the cross profile and lower profile, where they abut.

Figure 54:
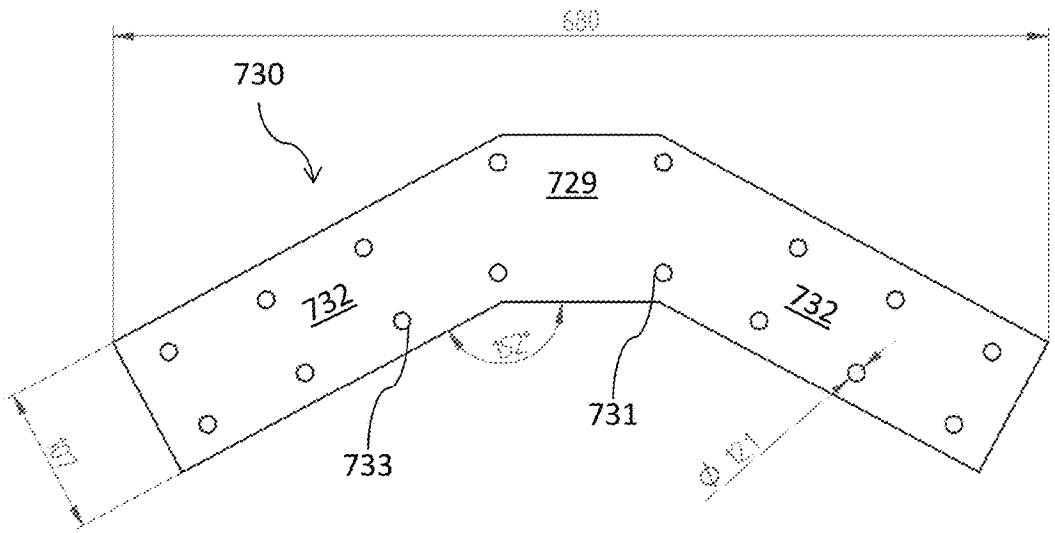

FIG. 54 depicts an isometric view of a holder leg 730. There are two holder legs on the front side of the arch visible in the figures. Another two holder legs 730 are disposed on the back side of the arch. Two holder legs 730 for the upper profiles and two for the lower profiles. Each pair of holder legs sandwiches the right-hand profile, the vertical profile and the left-hand profile between them and secures them together with fasteners (e.g. carriage bolts). There is one pair of holder legs for the upper profiles 712 and one for the lower profiles 714. The holder leg 730 has a straight (horizontally level) central section 729 with four square screw holes 731, and slanted right- and left-hand sections 732, each with six screw holes 733 formed therein. The angle of the slanted sections relative to the straight section is the same as the angle of the upper and lower profiles to the vertical profile (i.e. 152° in the immediate, exemplary structure).

Figure 55A:
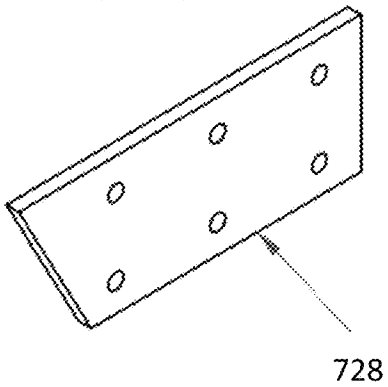
Figure 55B:
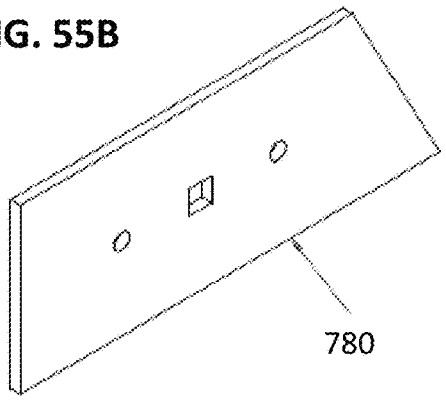

However, the upper and lower profiles are not level with the vertical profile. Therefore it is necessary to have a leg piece 728 which is positioned between the holder leg and the upper/lower profile. Leg piece 728 is depicted in FIG. 55A. Leg piece 728 has six corresponding screw holes. Similarly, each of the vertical short profile pieces needs four gasket pieces 780, each piece interposed between the upper/lower profile and the VSP, where the upper/lower profile is threaded through the VSP. A gasket 780 is depicted in FIG. 55B. The gasket has a corresponding square screw hole and corresponding smaller circular screw holes.

Cross beams 704 are coupled to the arches at coupling plates. There are two types of coupling plates: folded coupling plates 724 and bent coupling plates 726. FIG. 56 illustrates various views of a folded coupling plate 724. There are two folded coupling plates for each arch, one attached to each side of the vertical profile. FIG. 56(*a*) is an isometric view of the folded coupling plate 724. FIG. 56(*b*) is front (profile) view of the folded coupling plate 724.

FIG. 57 illustrates various views of a bent coupling plate 726. There are sixteen bent coupling plates for each arch, one attached to each vertical short profile. FIG. 56(*a*) is an isometric view of the folded coupling plate 724. FIG. 56(*b*) is front (profile) view of the folded coupling plate 724.

No welding is necessary in the entire construction of the metal canopy. This is true for all the structures mentioned herein. Even structures that are described as having a single welding point can be replaced with components that do not require welding (as discussed elsewhere).

Assembly is started from the vertical profile. The cross profile is inserted first. Thereafter the upper and lower profiles are inserted into to the vertical profile and fixed in place with fasteners. A mini profile is inserted in the vertical profile and into an ASP. The ASP is inserted into the vertical profile. A VSP is thread onto the upper and lower profiles 712, 714 and another mini profile is inserted between the ASP and the VSP. The bottom of the ASP is inserted into the VSP. The pieces are fixed into place with fasteners. The procedure is repeated with all the VSPs and ASPs on both sides of the vertical profile. The cross profile is fixed in place with holder plates. The holder legs and leg pieces are fixed to secure the structure. The connector pieces are attached to the ends of the profiles. A crane lifts the arch and places it on the support poles as described. The process is repeated for each arch. The cross beams are attached to the coupling plates.

To conclude the summary, referring back to FIG. 44, the vertical profile 716 of each arch 710 is coupled to the vertical profile of the adjacent arch by three profiles (disposed along the Z-axis). A central profile 784 passes through a middle opening 785 in the vertical profile 716 (see for e.g. FIG. 46(*c*)). The central profile is rectangular in shape (e.g. 50×100 mm) and 5005 mm in length. Two diagonal profiles 782 crisscross the space between the vertical profiles of two adjacent arches. One diagonal profile is inserted into a top opening 783 in the one vertical profile and into a bottom opening 783 in the adjacent vertical profile and vice-versa for the second diagonal profile. The diagonal profile is parallelepiped shaped with a rectangular cross-section (e.g. 40×80 mm). The cross connecting beams (central and diagonal profiles) are fixed in place with fasteners attached through respective screw holes.

While the invention has been described with respect to a limited number of embodiments, it will be appreciated that many variations, modifications and other applications of the invention may be made. Therefore, the claimed invention as recited in the claims that follow is not limited to the embodiments described herein.

What is claimed is:

1. A metal canopy structure, comprising:

(a) a plurality of arches arranged in parallel formation, equally spaced apart, each of said arches having a planar construction and disposed on a plane running along a first axis;

(b) a plurality of cross beams, at least a portion thereof arranged in parallel formation, each of said cross beams disposed on a second axis perpendicular to said first axis and mechanically coupled to at least a portion of said plurality of arches; and (c) a plurality of support poles, wherein each of said arches is mechanically coupled to a pair of said plurality of support poles;

wherein each of said plurality of arches comprises:

(i) a vertical profile, disposed along a third axis, said third axis perpendicular to both said first axis and said second axis;

(ii) a left hand upper profile and a right hand upper profile mechanically coupled to said vertical profile;

(iii) a left hand lower profile and a right hand lower profile both mechanically coupled to said vertical profile, said upper and lower profiles each disposed at an acute angle relative to said vertical profile;

(iv) a plurality of short profiles, a first half of said short profiles disposed between said left hand upper and lower profiles and a second half of said short profiles disposed between said right hand upper and lower profiles, said short profiles mechanically couples to said upper and lower profiles;

wherein said plurality of short profiles includes:

(A) a plurality of vertical short profiles, each of said plurality of vertical short profiles being disposed parallel to said vertical profile; and (B) a plurality of angled short profiles, each of said plurality of angled short profiles having a first end thereof proximal a first adjacent vertical short profile and a second end thereof proximal a second adjacent vertical short profile wherein each of said plurality of vertical short profiles is a parallelepiped with a front face, a back face and side faces, wherein each of said side faces has disposed therein a first rectangular opening near one end and near another end there is a second opening, said second opening formed from a large rectangle having same dimensions as said first rectangular opening and a small rectangle abutting said large rectangle and having smaller dimensions than said large rectangle;

wherein said first rectangular opening and said larger rectangle of said second opening are adapted to receive there-through said upper profile or said lower profile;

wherein said small rectangle of said second opening is adapted to receive one of said angled short profiles therein; and wherein positions of said first rectangular opening and said second opening are reversed on each of said side faces.

2. The metal canopy of claim 1, wherein said right and left hand upper profiles are secured to an upper portion of said vertical profile by sandwiching adjacent portions of said right and left hand upper profiles and said vertical profile between two holder legs and affixing said holder legs thereto with fasteners.

3. The metal canopy of claim 1, wherein said vertical profile includes two parallel holes at a top end thereof by which each of said arches can be raised by a lifting mechanism.

* * * * *